US006551450B1

(12) United States Patent
Thomas et al.

(10) Patent No.: US 6,551,450 B1
(45) **Date of Patent: *Apr. 22, 2003**

(54) UNIQUE AIR AND SONIC MASSAGING APPARATUS

(75) Inventors: Paul B. Thomas, San Pedro, CA (US); Robert D. Leventhal, Los Angeles, CA (US)

(73) Assignee: D2RM Corp., Gardena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/949,459

(22) Filed: Sep. 7, 2001

Related U.S. Application Data

(63) Continuation-in-part of application No. 09/802,230, filed on Mar. 8, 2001, which is a continuation-in-part of application No. 09/353,842, filed on Jul. 15, 1999, now Pat. No. 6,200,403, which is a continuation-in-part of application No. 09/311,088, filed on May 13, 1999, now Pat. No. 6,212,719, which is a continuation-in-part of application No. 08/948,763, filed on Oct. 10, 1997, now Pat. No. 5,907,878.

(51) Int. Cl.[7] ..... A47C 27/10

(52) U.S. Cl. ..... 156/580.1; 5/706; 5/710; 5/713; 5/654; 297/452.41; 297/284.6

(58) Field of Search ..... 156/580.1, 580.2; 5/706, 710, 713, 654, 655.3, 915; 297/452.41, 284.6; 601/49, 57

(56) References Cited

U.S. PATENT DOCUMENTS 3,879,776 A 4/1975 Solen
4,005,236 A 1/1977 Graebe
4,120,061 A 10/1978 Clark
4,454,615 A 6/1984 Whitney
4,629,253 A 12/1986 Williams
4,631,767 A 12/1986 Carr et al.
4,827,546 A 5/1989 Cvetkovic
4,895,352 A 1/1990 Stumpf
4,967,431 A 11/1990 Hargest et al.
5,097,552 A 3/1992 Viesturs
5,907,878 A * 6/1999 Thomas et al. ..... 5/710
6,212,719 B1 * 4/2001 Thomas et al. ..... 5/713

* cited by examiner

*Primary Examiner*—James Sells
(74) *Attorney, Agent, or Firm*—Thomas I. Rozsa; Tony D. Chen

(57) ABSTRACT

An air and sonic massaging apparatus for providing an improved massaging effect with opposing lower air nodes beneath the upper air nodes in order to provide the user with greater displacement when patterned inflation and deflation of the device occurs. The apparatus includes an air device and a sonic device which is located underneath the air device. The air and sonic massaging apparatus inhibits turning forces and sideway motions, and keeps the motion more linear and at a higher consistent force. The apparatus has separate air flow circuits that provide alternating or conjoined patterns of inflation and deflation on a single device. The sonic device includes a sonic transducer that creates acoustic waves generated by a rigid transmission plate through movement by the translation of significant solid mass. The sonic device provides high magnitudes of acoustic energy to the directly coupled air device or directly coupled to the user's body air cavity.

73 Claims, 48 Drawing Sheets

UNIQUE AIR AND SONIC MASSAGING APPARATUS

This application is a continuation-in-part of application Ser. No. 09/802,230 filed on Mar. 8, 2001, now pending, which is a continuation-in-part-of application Ser. No. 09/353,842 filed on Jul. 15, 1999, now U.S. Pat. No. 6,200,403, which is a continuation-in-part of application Ser. No. 09/311,088 filed on May 13, 1999, now U.S. Pat. No. 6,212,719, which is a continuation-in-part of application Ser. No. 08/948,763 filed on Oct. 10, 1997, now U.S. Pat. No. 5,907,878.

BACKGROUND OF THE INVENTION

1. Field of the Invention

The present invention generally relates to the field of bed systems. More particularly, the present invention relates to the field of adjustable air mattresses for beds. In particular, the present invention relates to the field of automatic and passively pressurized air massager cushioning devices or the like. Particularly, the present invention relates to a method of forming and sealing air structures used in seating devices, sleeping devices, massage and therapeutic devices, etc. In particular, the present invention relates to an air and sonic massaging apparatus for providing entertainment and a massaging effect with greater displacement on the body part of the individual positioned on the apparatus when patterned inflation and deflation of the apparatus occurs.

2. Description of the Prior Art

Air bed systems are well known in the art. Many of the prior art air bed systems include an air mattress and a box spring. The prior art air mattress construction have problems which can cause discomfort and disruption to the sleeping process. One of the prior art mattresses is a conventional air mattress which comprises simply a flexible enclosure filled with air. When depressed, the enclosure depresses slightly in the vicinity of the loading and also increases pressure in the remaining volume of the enclosure. The response is both resistive and bouncy, which are undesirable characteristics as far as the comfort of the user is concerned.

The following ten (10) prior art patents are found to be pertinent to the field of the present invention:

1. U.S. Pat. No. 3,879,776 issued to Solen on Apr. 29, 1996 for "Variable Tension Fluid Mattress" (hereafter the "Solen Patent");
2. U.S. Pat. No. 4,005,236 issued to Graebe on Jan. 25, 1977 for "Expandable Multicelled Cushioning Structure" (hereafter the "Graebe Patent");
3. U.S. Pat. No. 4,120,061 issued to Clark on Oct. 17, 1978 for "Pneumatic Mattress With Valved Cylinders Of Variable Diameter" (hereafter the "Clark Patent");
4. U.S. Pat. No. 4,454,615 issued to Whitney on Jun. 19, 1984 for "Air Pad With Integral Securement Straps" (hereafter the "Whitney Patent");
5. U.S. Pat. No. 4,629,253 issued to Williams on Dec. 16, 1986 for "Seat Occupant-Activated Underseat Support Air-Cushion" (hereafter the "Williams Patent");
6. U.S. Pat. No. 4,631,767 issued to Carr et al on Dec. 30, 1986 for "Air Flotation Mattress" (hereafter the "Carr Patent");
7. U.S. Pat. No. 4,827,546 issued to Cvetkovic on May 9, 1989 for "Fluid Mattress" (hereafter the "Cvetkovic Patent");
8. U.S. Pat. No. 4,895,352 issued to Stumpf on Jan. 23, 1990 for "Mattress Or Cushion Spring Array" (hereafter the "Stumpf Patent");

9. U.S. Pat. No. 4,967,431 issued to Hargest et al. on Nov. 6, 1990 for "Fluidized Bed With Modular Fluidizable Portion" (hereafter the "Hargest Patent"); and
10. U.S. Pat. No. 5,097,552 issued to Viesturs on Mar. 24, 1992 for "Inflatable Air Mattress With Straps To Attach It To A Conventional Mattress" (hereafter the "Viesturs Patent").

The Solen Patent discloses a variable tension fluid mattress. It comprises a fluid chamber defined by an upper wall and a bottom wall which form a base. The fluid chamber can be compartmentalized by a longitudinal divider and cross dividers to provide individual zones of the fluid chamber. A plurality of pressure expandable pads are clamped to the upper wall by a disc which is secured to a hollow stem which communicates with the fluid chamber. A restraining chain is mounted within each pad and merely serves to limit the upward expansion of the pad regardless of the internal pressure.

The Graebe Patent discloses an expandable multicelled cushioning structure. It comprises a common base and a plurality of cells which are attached to the base, and are initially in a configuration so that the cells when formed are spaced apart but when later expanded by a pressurized fluid, will contact or be closely spaced to one another at their sidewalls.

The Clark Patent discloses a pneumatic mattress with valved cylinders of variable diameter. It comprises a plurality of valved cylinder cells held by a cover in a side-by-side relationship. Each cell comprises upper and lower cylindrical sections of equal diameter interconnected by a corrugated cylindrical section which has a smaller diameter. Each lower cylindrical section has an orifice which connects the interior of the cell with an air plenum that extends along the entire underside of the mattress. Each orifice registers with a valve that projects from the inner surface of the plenum opposite the cell orifice and is supported by a small, collapsible section of the cell in a normally open position, so that when a load is applied to the top of the cell it automatically closes the orifice against the registering valve.

The Whitney Patent discloses an air pad with integral securement straps. It comprises an upper layer and a lower layer which are joined together at a heat seal extending around the entire periphery of the pad. The pad is filled with air, water, a gel or the like. Securement straps are provided on the pad and fitted around and under the comers of a standard bed mattress to hold the pad in position on the mattress.

The Williams Patent discloses a seat occupant-activated underseat support air-cushion. It comprises a support base and an airtight expandable air cushion which rests on the support base. The top of the air-cushion is pressed upward against the bottom side of the vehicle seat cushion. A bellows type air pump is disposed within the air cushion and provides an outside air-intake.

The Carr Patent discloses an air flotation mattress. It comprises a lower inflatable chamber with a series of side-by-side air supply channels and an air-pervious upper wall. An inflatable compartment is overlaid on the chamber and forms a secondary air-pervious wall. A fan assembly is operatively coupled with the lower inflatable chamber to supply pressurized air.

The Cvetkovic Patent discloses a fluid mattress. It comprises side frames, a bottom support, and flexible and contractible bellows distributed over the bottom support. Connecting tubings are connected from the bellows to adjacent bellows to permit fluid flow therebetween. A top cover is extended over the bellows. Coil springs are mounted on top of the bellows to support the top cover.

The Stumpf Patent discloses a mattress or cushion spring array. It comprises a plurality of spring units. Each spring unit has a body, a top deformable end, and a bottom deformable end, where the ends are free for axial compression. The spring units are interconnected together by connecting fins which extend from the body of each spring unit.

The Hargest Patent discloses a fluidized bed with a modular fluidizable portion. A plurality of fluidizable cells are disposed and attached atop of an air permeable support. Each cell contains a discrete mass of fluidizable material which can be manually detachable and removable from the support for ease of cleaning and replacement.

The Viesturs Patent discloses an inflatable air mattress with straps to attach it to a conventional mattress. It comprises an upper air impervious flexible layer and a lower air impervious flexible layer. The peripheries of the first and second layers are joined together in an air impervious sealed relationship.

None of these prior art patents teach an air spring bedding system, resting or therapeutic structure to provide a matrix surface that is both supportive and pliable with minimal surface tension. It is desirable to have a very efficient and also very effective design and construction of an air spring bedding system for providing comfort and tranquillity to a user during his or her sleep by two different air support structures to create a matrix surface that is both supportive and pliable with minimal surface tension.

The following two (2) prior art patents were further found to be pertinent to the field of the present invention:

1. U.S. Pat. No. 4,852,195 issued to Schulman on Aug. 1, 1989 for "Fluid Pressurized Cushion" (hereafter the "Schulman Patent"); and
2. U.S. Pat. No. 4,005,236 issued to Purdy et al. on Oct. 28, 1997 for "Cushioning Mattress For Reducing Shear And Friction" (hereafter the "Purdy Patent").

The Schulman Patent discloses a fluid pressurized cushion. It comprises a hollow air filled body support cushion which is formed from three interfitting matrices. Each matrix has a set of hollow cells, wherein the cells of each matrix are spaced apart to accommodate between them cells of each of the other matrices to define a body support surface made up of the tops of all of the cells. Each matrix has separate fluid ducts between its cells. A fluid pressurizing and control means such as air pumps is used to inflate and deflate the matrices in sequence to shift body support from one set of cells to another for promoting blood circulation and enhancing comfort.

The Purdy Patent discloses a cushioning mattress for reducing shear and friction. It comprises a top surface, a bottom surface, and a series of alternating tunnel billow compartments and loop billow compartments. Each of the tunnel billows comprises a separate piece of material affixed to the top or bottom surface along two parallel seams to define a wide-based closed billow or cell. Each of the loop billows comprises a separate piece of material affixed to the top or bottom surface along a single seam to define a narrow-based closed billow or cell.

It is further desirable to provide an air massager cushioning device or the like, which provides a matrix surface that is both supportive and pliable with minimal surface tension. It is also further desirable to provide an air massager cushioning device or the like that not only support a weight of an individual who sits or rests on the cushioning device but also provides a massaging effect on the body part of the individual positioned on the air massager cushioning device.

It is still further desirable to provide a method of forming and sealing an air structure having a plurality of air glands and a plurality of air ducts, where the air glands form a matrix surface that is both supportive and pliable with minimal surface tension and can be used with many applications, such as seating devices, sleeping devices, massage and therapeutic devices, etc.

It is again further desirable to provide a method of forming and sealing an air structure having a plurality of opposing air nodes and a plurality of air channels, where the opposing air nodes form an upper matrix surface and a lower matrix surface that are both supportive and pliable with minimal surface tension and can be used in many applications, such as seating devices, sleeping devices, massage and therapeutic devices, etc.

The following eight (8) prior art patents were further found to be pertinent to the field of the present invention:

1. U.S. Pat. No. 4,064,376 issued to Yamada on Dec. 20, 1977 for "Sound Reproduction System And Device" (hereafter "the '376 Yamada Patent");
2. U.S. Pat. No. 4,354,067 issued to Yamada et al. on Oct. 12, 1982 for "Audio-Band Electromechanical Vibration Converter" (hereafter "the '067 Yamada Patent");
3. U.S. Pat. No. 4,506,379 issued to Komatsu on Mar. 19, 1985 for "Method And System For Discriminating Human Voice Signal" (hereafter "the '379 Komatsu Patent");
4. U.S. Pat. No. 4,750,208 issued to Yamada et al. on Jun. 7, 1988 for "Audio-Band Electromechanical Vibration Converter" (hereafter "the '208 Yamada Patent");
5. U.S. Pat. No. 5,442,710 issued to Komatsu on Aug. 15, 1995 for "Body-Felt Sound Unit And Vibration Transmitting Method Therefor" (hereafter "the '710 Komatsu Patent");
6. U.S. Pat. No. 5,536,984 issued to Stuart et al. on Jul. 16, 1996 for "Voice Coil Actuator" (hereafter the "Stuart Patent");
7. U.S. Pat. No. 5,076,260 issued to Komatsu on Dec. 31, 1991 for "Sensible Body Vibration" (hereafter "the '260 Komatsu Patent"); and
8. U.S. Pat. No. 5,951,500 issued to Cutler on Sep. 14, 1999 for "Audio Responsive Massage System" (hereafter the "Cutler Patent").

The '376 Yamada Patent discloses a sound reproduction system and device built into a furniture piece such as a chair. A transducer is vibrated by a sound signal of appropriate frequency. The vibrating shaft of the transducer is directly fitted to the framework of the chair. The sound signal is provided to an acoustic device including a speaker located near the chair.

The '067 Yamada Patent discloses an audio-band electromechanical vibration converter. The converter includes a yoke having a magnetic pole and a magnetic gap formed therein which is displaceably housed by a damper in the casing to which a vibration plate is attached. A coil is also attached to the casing and placed in the magnetic gap. The casing gives an output of a mechanical vibration synchronized with a low band audio signal. The converter may be built into a furniture piece such as a chair. This is not a massage device so that the transducer does not generate vibrations. Rather, it is part of an audio system where the transducers generate low frequency audio band.

The '379 Komatsu Patent discloses a method and system for discriminating human voice signal. It has a low-pass filter to produce audio signals having frequencies in the range of 0–150 Hz.

The '208 Yamada Patent is a divisional of the '067 Yamada Patent. Again, it is not a massage device but rather, an audio device. As in the '067 Yamada Patent, the vibrational transducers are mounted on a flat damper held within the converter casing and the casing is in turn imbedded in the vibration plate. The vibration is in response to a low frequency audio-band.

The '710 Komatsu Patent discloses a body-felt sound unit and vibration transmitting method therefor. The unit has a vibration transmitting member imbedded in a human body support member such as a chair or a bed, etc. and also has an electromechanical transducer attached to the vibration transmitting member. The transducer generates a vibration which is transmitted to the vibration transmitting member through a vibration receiving plate where the vibration receiving plate and the transducer are both arranged to be substantially perpendicular to the vibration transmitting member. While multiple transducers are used, they are connected to a same frequency source and generate the same vibrations.

The Stuart Patent discloses a voice coil actuator. It is unrelated to a massage device.

The '260 Komatsu Patent discloses a sensible body vibration having a vibration unit mounted in a human body support such as a bed or a chair and adapted to generate mechanical vibrations upon receipt of a low frequency signal. The '260 Komatsu Patent discloses an arrangement where a multiplicity of transducers are placed on the two opposite sides of a bed and the vibration transducers on the opposite sides of the bed may be connected with opposite polarities to impart a stronger vibration. However, the transducers on the opposite sides of a bed are not mounted on a same vibrating plate but rather, on two opposite vibrating plates.

The Cutler Patent discloses an audio responsive massage system. The system includes a pad for contacting a user and a plurality of vibrational transducers for vibrating the pad at variable intensity and associated vibration frequencies in response to a power signal. The feature of the Cutler Patent system is that the amplitude of the vibrations are controlled in response to the amplitude of the audio signal while the vibrators are operated at frequencies that are effective for massaging the user without regard to the audio frequency. While multiple pairs of transducers are mounted to the pad, there is no provision in the Cutler Patent to provide the two transducers in each respective pairs to vibrate distinctively to provide a vibration.

From the above patents, it appears that while various audio systems and massage devices are disclosed by the cited prior art patents, none of them have disclosed an air and sonic massaging apparatus for entertainment and providing a massaging effect with greater displacement on the body part of the individual positioned on the apparatus when patterned inflation and deflation of the apparatus occurs.

SUMMARY OF THE INVENTION

The present invention is a novel and unique air spring bedding system. It comprises a mattress matrix assembly and a box spring assembly. The mattress matrix assembly comprises first and second air support structures. The first air support structure comprises a base, a plurality of spaced apart alternating offset compressible and expandable members extending upwardly from the base, a plurality of alternating offset apertures respectively located adjacent to the plurality of alternating offset compressible and expandable members, and a plurality of connecting members formed with the base and interconnected to a pair of adjacent alternating offset compressible and expandable members for distributing air between the other compressible and expandable members.

The second air support structure comprises a base, a plurality of alternating offset compressible and expandable members, and a plurality of connecting members formed with the base and interconnected to a pair of adjacent alternating offset compressible and expandable members for distributing air between the other compressible and expandable members. The compressible and expandable members are respectively aligned with the plurality of apertures of the first air support structure. The second air support structure is assembled below the first air support structure such that the compressible and expandable members of the second air support structure are respectively inserted into the apertures of the first air support structure, where the base of the first air support structure abuts against the base of the second air support structure, and the compressible and expandable members of the first and second air support structures are arranged in a matrix arrangement (rows and columns).

In addition, the air spring bedding system further comprises means for supplying air under pressure to inflate the compressible and expandable members of the first and second support structures to a desired stiffness, such that the compressible and expandable members of the first and second air support structures are relatively close together and air is respectively transferrable from the compressible and expandable members by the respective connecting members of the first and second air support structures.

The box spring assembly includes upper and lower airtight support structures. The upper support structure has an upper plenum and a plurality of spaced apart vertical hollow cylinders which extend downwardly from and communicate with the upper plenum. These hollow cylinders are arranged in a matrix arrangement (rows and columns). The lower support structure has a lower plenum and a plurality of spaced apart vertical hollow cylinders which extend upwardly from and communicate with the lower plenum. These hollow cylinders of the lower support structure are also arranged in a matrix arrangement (rows and column) which are offset from the cylinders of the upper support structure.

The hollow cylinders of the upper support structure are respectively inserted in-between the hollow cylinders of the lower support structure such that the hollow cylinders of the upper and lower support structures are respectively located adjacent to one another. In addition, the upper and lower support structures further include means for supplying air under pressure to the interiors of the upper and lower support structures.

It is therefore an object of the present invention to provide a new and improved type of air spring bedding system wherein the construction of a bedding provides a resting or therapeutic structure formed by mushroom shaped air springs to create a matrix surface that is both supportive and pliable with minimal surface tension. Pressure exerted upwardly against the weight of a resting body by the first air support structure can be adjusted to be less than or greater than the pressure exerted upwardly by the second air support structure. The difference in pressure between the first and second air support structures creates portions of the mattress matrix assembly that are pliable with minimal surface tension between supportive portions. The stress produced is reduced because the pliable portions can conform to the complex curves of the human form and thus increase the area supported. Stress concentrations are reduced due to the increase in area supported, overall reduction in supportive pressures and minimized surface tension.

It is a further object of the present invention to provide a new and improved type of air spring bedding system so additional comfort is created by the mattress matrix assembly's ability to adjust the relative pressure over a large range to suit the various shapes and masses of resting bodies. The mushroom shaped air springs can be further customized to suit individuals by utilizing zoned construction fostered by both its fluid system and matrix design. Also inherent in the basic design is the ability to dynamically adapt to a variety of changing resting positions by the proper sizing of the same interconnection of the mushroom shaped air springs required for pressurization of a zone or the entire structure.

Alternatively, the present invention is an air massager cushioning device or the like that not only support a weight of an individual who sits or rests on the air massager cushioning device with minimal surface tension but also provides a massaging effect on the body part of the individual positioned on the cushioning device. One of the unique features of the present invention is that it can be applied to many applications, such as a seat topper apparatus having at least a head support section, a thoracic support section, a lumbar support section, and a buttock and thigh support section. Another example of an application for the present invention massager cushioning device is a lounge chair having at least a head support section, a thoracic support section, a lumbar support section, a buttock and thigh support section, a calf support section, and a foot support section. A further example of an application for the present invention massager cushioning device is a cuff apparatus for wrapping around a body part of an individual.

It is an object of the present invention to provide a new and improved type of air massager cushioning device wherein the construction of the cushioning device provides a resting or massaging effect structure formed by a plurality of air glands to create a matrix surface that is both supportive and pliable with minimal surface tension. Pressure exerted upwardly against the weight of a resting body by a first air support structure can be adjusted to be less than or greater than the pressure exerted upwardly by a second air support structure. The difference in pressure between the first and second air support structures creates portions of the cushioning matrix arrangement that are pliable with minimal surface tension between supportive portions. The stress produced is reduced because the pliable portions can conform to the complex curves of the human body and thus increase the area supported. Stress concentrations are reduced due to the increase in area supported, overall reduction in supportive pressures and minimized surface tension.

It is also an object of the present invention to provide a new and improved type of air massager cushioning device so additional comfort is created by the cushion matrix arrangement ability to adjust the relative pressure over a large range to suit the various shapes and masses of resting bodies. A plurality of air glands can be further customized to suit individuals by utilizing zoned construction fostered by both its fluid system and matrix design. Also inherent in the basic design is the ability to dynarnically adapt to a variety of changing resting positions by the proper sizing of the same interconnection of the air glands required for pressurization of a zone or the entire structure.

It is an additional object of the present invention to provide a new and improved type of air massager cushioning device that not only support a body part of an individual who sits or rests on the cushioning device but also provides a massaging effect on the body part of the individual positioned on the cushioning device. The air cushioning device includes a first air structure with a plurality of air glands and a second air structure with a plurality of air glands, where the plurality of air glands of the first air structure is relative rapidly inflated while the plurality of air glands of the second structure is relative rapidly deflated and so forth, thereby creating a massaging effect to the body part of the individual.

It is a further object of the present invention to provide a new and improved type of air massager cushioning device which includes a magnetic vibratory means for generating vibrations to and through a transmitting means which in turn creates resonance vibrations to the cushioning device and the body part positioned on the cushioning device.

Further alternatively, the present invention is a method of forming and sealing an air structure having a plurality of air glands and a plurality of air ducts, and which are respectively and integrally connected together, where the air glands form a matrix surface that is both supportive and pliable with minimal surface tension and can be used with many applications, such as seating devices, sleeping devices, massage and therapeutic devices, etc.

Traditionally, these two processes are not combined in order to form air structures. An air structure is a pre-shaped and formed flexible system composed of at least one air gland and at least one air channel. These air structures can be used with many applications, for example, seating devices, sleeping devices, massage and therapeutic devices, etc.

Again further alternatively, the present invention is a method of forming and sealing a fluid or air structure having a plurality of opposing upper and lower fluid or air nodes and a plurality of fluid or air channels, and which are respectively and integrally connected together, where the air nodes form an upper matrix surface and a lower matrix surface that are both supportive and pliable with minimal surface tension and can be used in many applications, such as seating devices, sleeping devices, massage and therapeutic devices, etc.

An air structure is a pre-shaped and formed flexible system comprised of a first layer of material having at least one air node extending upwardly, a second layer of material having at least one air node extending downwardly, and at least one air channel connecting the air nodes.

It is an object of the present invention to provide a method of forming a fluid or air structure having a plurality of spaced apart upper fluid nodes and a plurality of spaced apart lower fluid nodes which respectively oppose the plurality of upper fluid nodes so that the displacement of the upper and lower fluid nodes is twice the displacement of a single fluid node.

Alternatively, the present invention is an air and sonic massaging apparatus for entertainment and providing an improved massaging effect with opposing lower air nodes beneath the upper air nodes in order to provide the user with greater displacement when patterned inflation and deflation of the device occurs. Additionally, by keeping a base portion between the upper and lower air nodes centrally located, the node displacement is away from the center on both sides of the flat base portion and is structurally sounder. This construction of the air and sonic massaging apparatus inhibits turning forces and sideway motions, and keeps the motion more linear and at a higher consistent force.

It is an object of the present invention to provide an air and sonic massaging apparatus which includes separate air or fluid flow circuits that provide alternating or conjoined patterns of inflation and deflation on a single device.

It is also an object of the present invention to provide an air and sonic massaging apparatus which can be used with other air and sonic massaging apparatuses with electronic preprogrammed pattern programs or pattern programs down loaded via the Internet or by user selected variation and/or biological sensor factors.

It is an additional object of the present invention to provide a sonic device that has a sonic transducer design that creates acoustic waves generated by a rigid transmission plate through movement by the translation of significant solid mass. This construction will provide high magnitudes of acoustic energy to the directly coupled air massaging device or directly coupled to the user's air cavity. It also ignores the normal standard in sound generation to provide large and significant air modulations by cone or panel displacement wherein the coil is the moving member.

It is a further object of the present invention to provide a sonic device which is improved by centrally locating the improved sonic transducer within a central opening on a flat rigid transmission plate. This construction enhances deflection of the rigid plate by eliminating the central portion and providing easer movement of the rigid plate.

It is still an object of the present invention to provide a sonic device which can be further enhanced by winding the coil twice in separate directions in order to create both significant flux and reduced heat generation due to reduction of resistance.

It is still another object of the present invention to provide a sonic device with a foam material strategically positioned behind a rigid wave generating plate and a thin layer of foam material so that it will enhance the user comfort without significantly diminishing the sonic effect. It should also be noted due to the positioning of the sonic device in relation to the user and also that of the air device when used in combination, that Huygens' principle regarding plane waves applies and is enhanced. Wave fronts are recreated by the leading edge of wavelets creating the next successive wave front in a constant perpendicular direction from the transducer generator as it transverse into the user. The benefits of this are substantially less wave energy cancellation, stronger intensity, and enhanced user interest in that the internal vibration is less distorted and more distinctly complex.

It is still a further object of the present invention to provide an air and sonic massaging apparatus for providing a massaging effect with greater displacement on the body part of the individual positioned on the apparatus as well as providing an entertainment and relaxation device for a user.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is an air spring bedding system. The concept of the present invention is the construction of a bedding, resting or therapeutic structure by two different air support structures to create a matrix surface that is both supportive and pliable with minimal surface tension.

Figure 1:
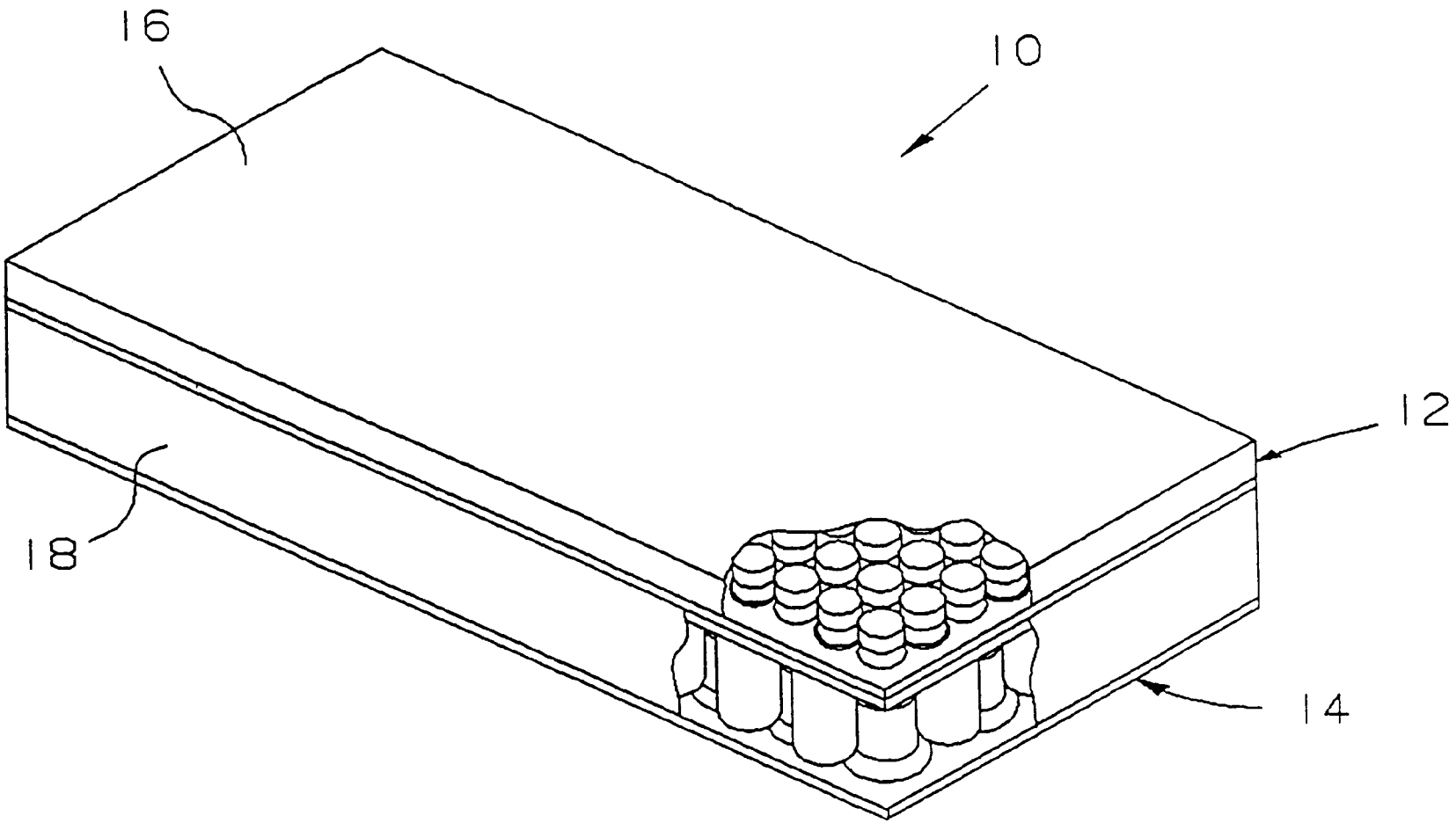
FIG. 1 is a partial cutout perspective view of the present invention air spring bedding system, showing a mattress matrix assembly and a box spring assembly.

Referring to FIG. 1, there is shown at 10 a preferred embodiment of the present invention air spring bedding system. The bedding system 10 comprises a mattress matrix assembly 12 and a box spring assembly 14. It may also include a cushion layer (not shown). The mattress matrix assembly 12 may be manufactured with a mattress: cover 16 for covering the entire surface of the mattress matrix assembly 12. The box spring assembly 14 may also be manufactured with a box spring cover 18 for covering the entire surface of the box spring assembly 14.

Figure 2:
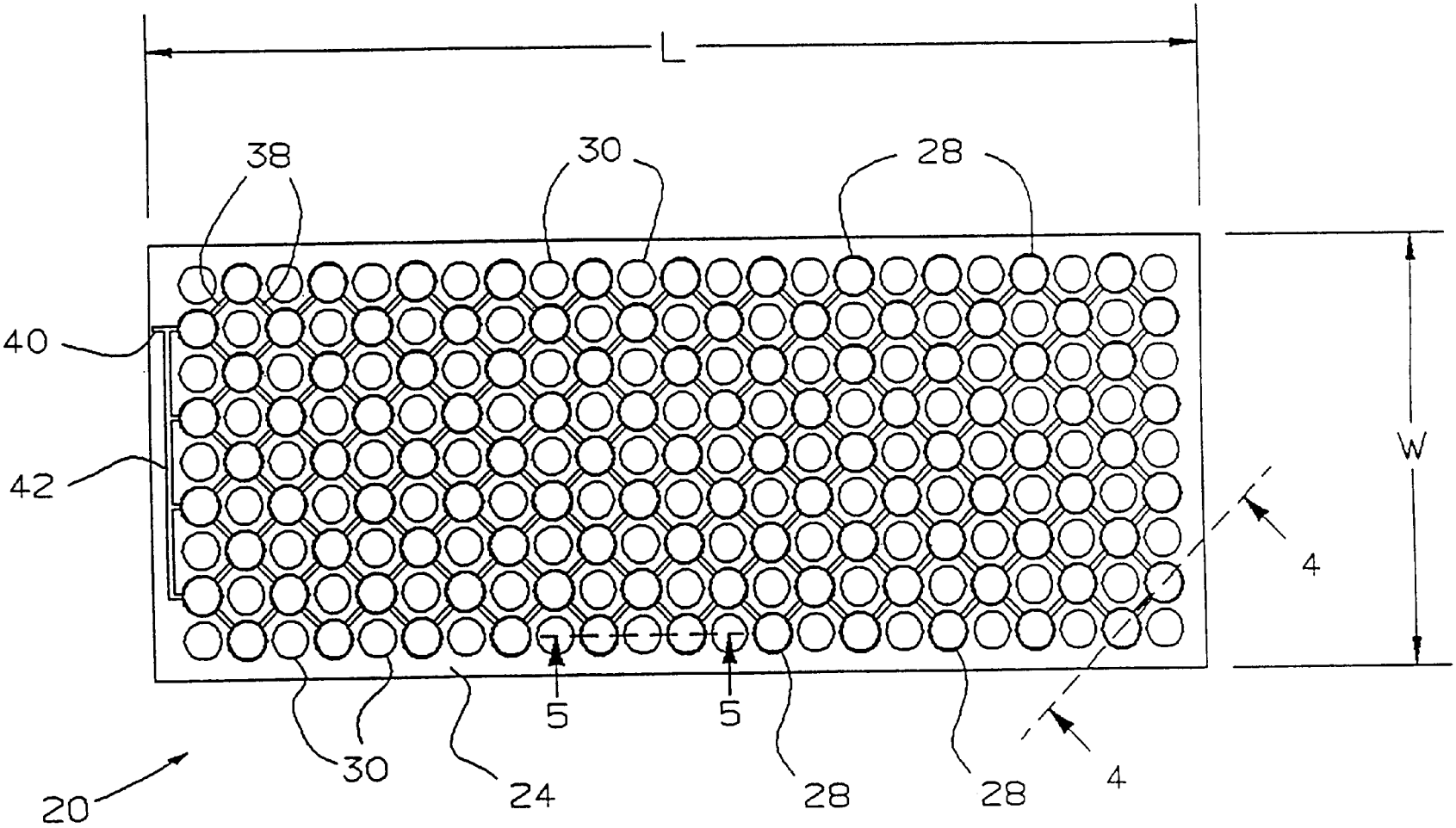
FIG. 2 is a top plan view of a first air support structure with a plurality of compressible and expandable members.
Figure 6:
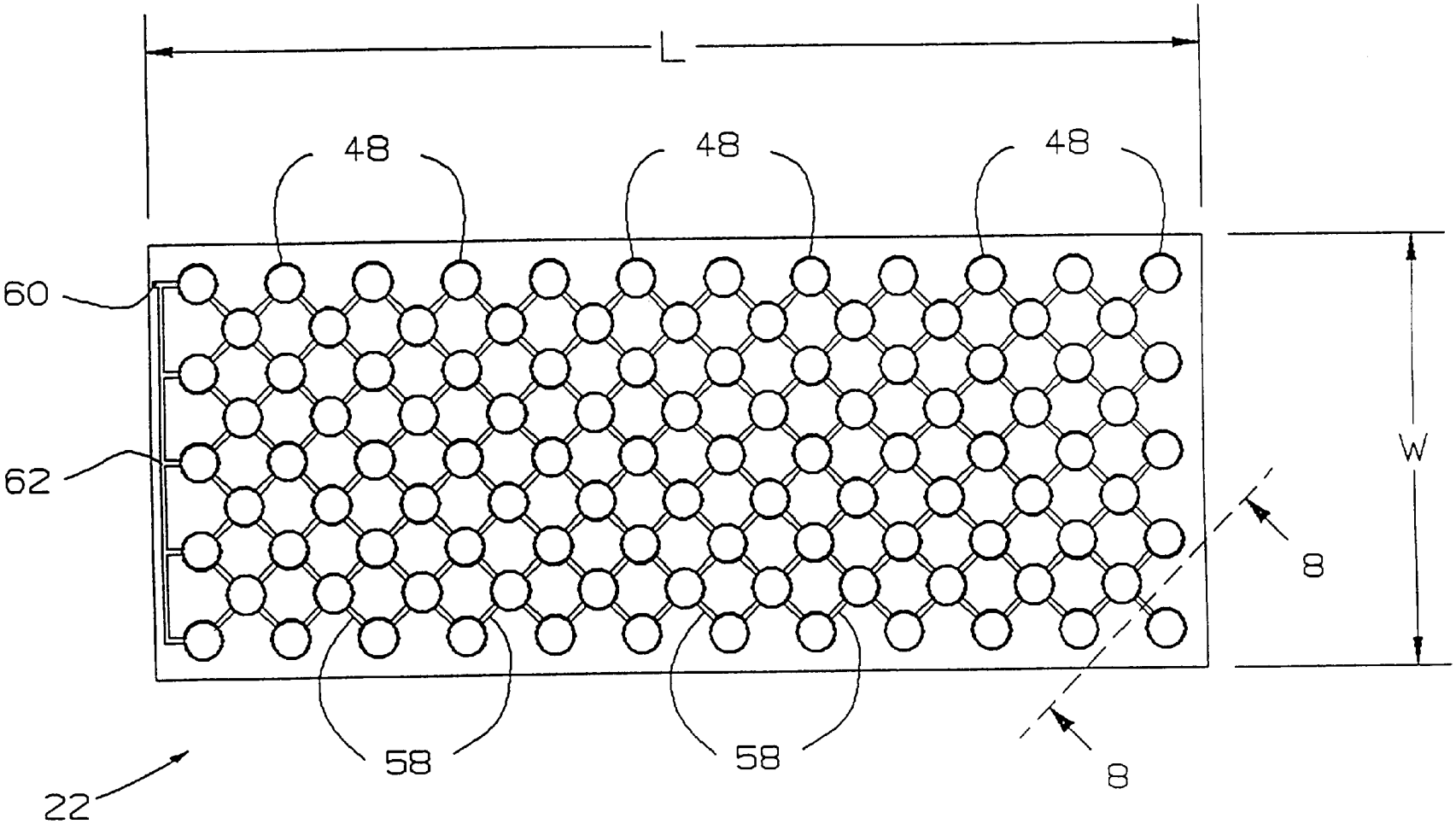
FIG. 6 is a top plan view of a second air support structure with also a plurality of compressible and expandable members.

Referring to FIGS. 1, 2 and 6, the mattress matrix assembly 12 includes a first air support structure 20 and a second air support structure 22, and both structures are airtight and fluid-tight and are generally rectangular shaped. By way of example, the overall length "L" and width "W" of both of the air support structures 20 and 22 are approximately 72.25 inches by 29.25 inches respectively. It will be appreciated that the dimensions described above are merely one illustrative embodiment, and it is within the spirit and scope of the present invention to include many other comparable sets of dimensions.

Figure 3:
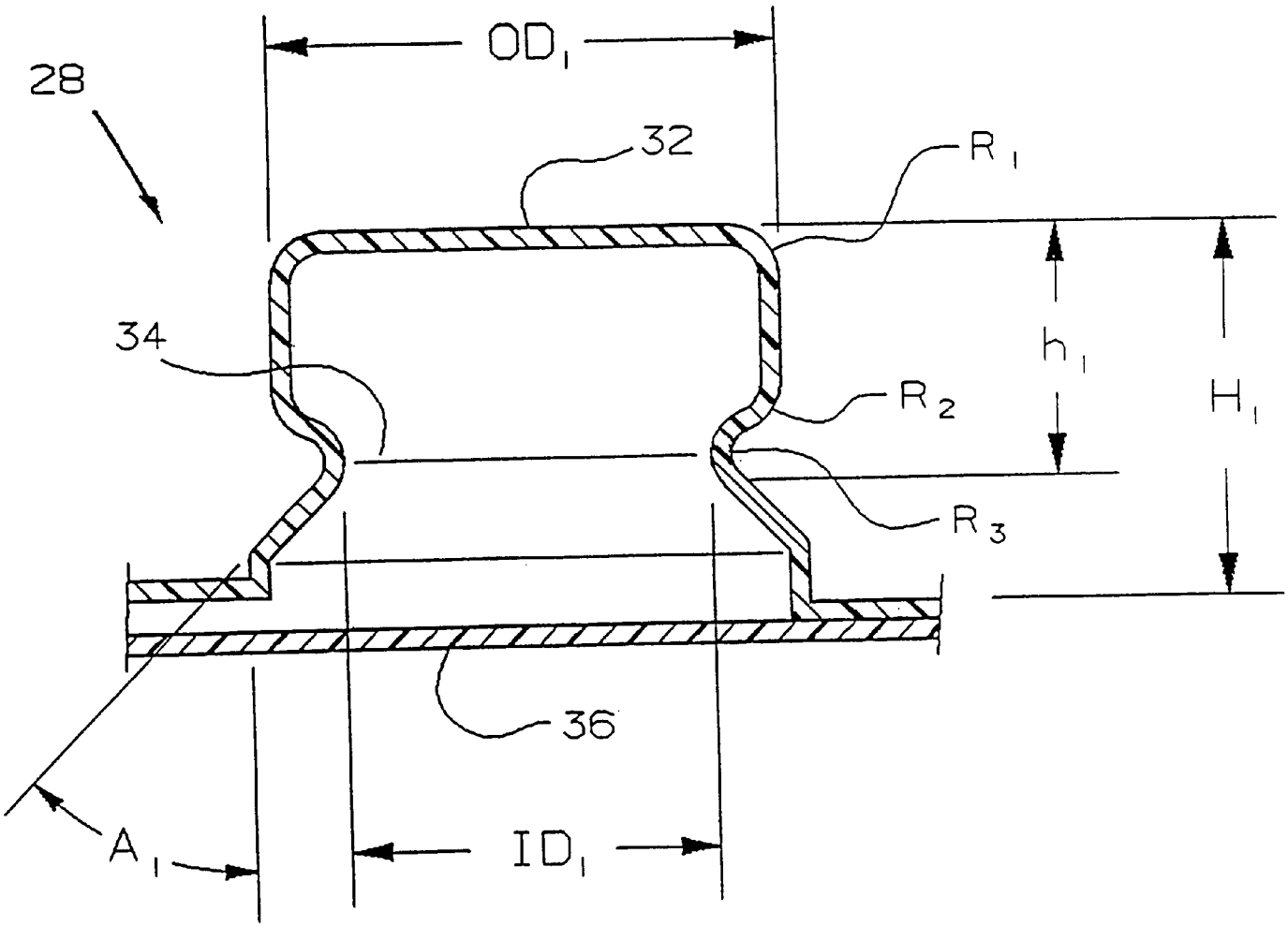
FIG. 3 is a side elevational view of one of the plurality of compressible and expandable members shown in FIG. 2.
Figure 4:
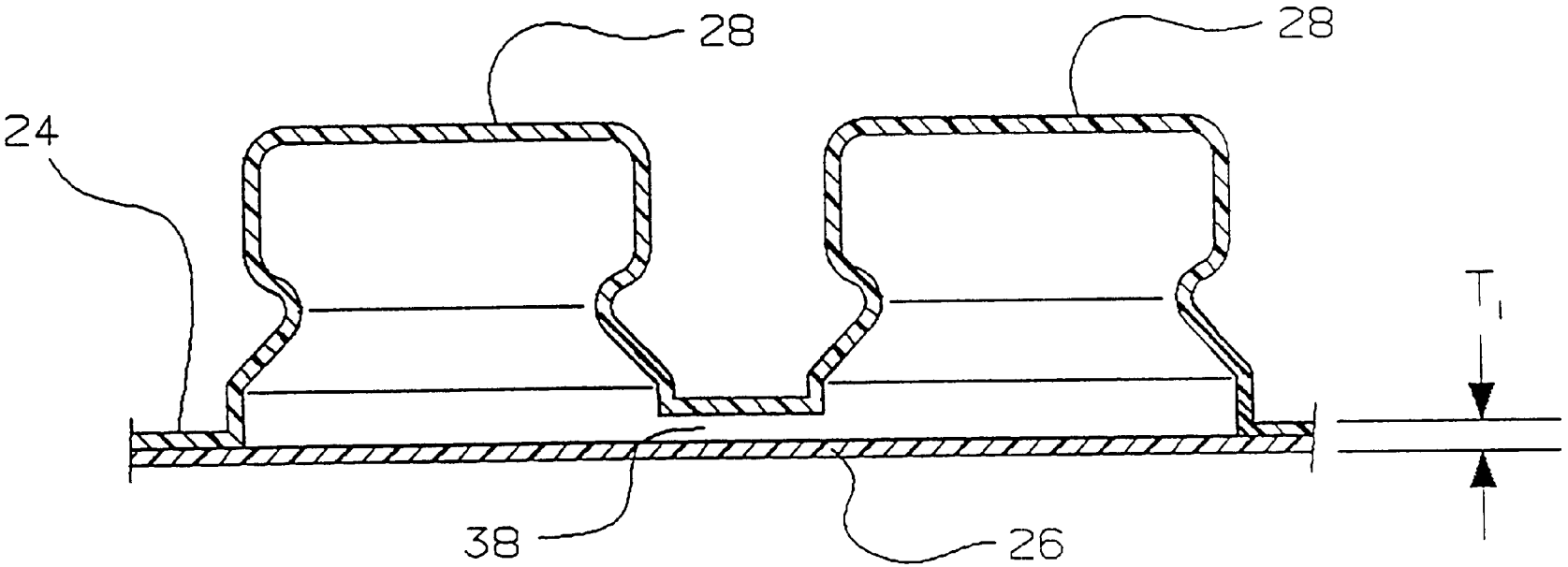
FIG. 4 is a cross-sectional view taken along line 4—4 of FIG. 2.

Referring to FIGS. 2, 3 and 4, the first air support structure 20 is constructed by a flexible top layer 24 and a flexible bottom layer 26 permanently affixed to the top layer 24 by ultrasonic welding, radio frequency (RF) and heat welding or other suitable means to form a plurality of spaced apart vertical adjustable hollow mushroom shaped air springs or compressible and expandable members 28. The top and bottom layers 24 and 26 form a base portion, where the adjustable hollow mushroom shaped air springs 28 extend upwardly therefrom. By way of example, the thickness "$T_1$" of the two layers 24 and 26 when combined is approximately 0.25 inch. The hollow air springs 28 are arranged in an alternating offset arrangement from one another (see FIG. 2). A plurality of circular shaped apertures 30 are provided with the first air support structure 20. These apertures 30 are also arranged in an alternating offset arrangement from one another. The apertures 30 may be stamped out from the two layers 24 and 26, cut out or may be removed by any suitable means known to one skilled in the art. These apertures 30 are substantially identical in size.

Referring to FIGS. 3 and 4, the plurality of hollow air springs 28 are substantially identical, and to the extent they are, only one will be described in detail below. Each hollow air spring 28 has a wide closed distal end 32, a narrow middle 34, and a wide open proximal end 36. The wide proximal end 36 is integrally formed with the top layer 24 of the first air support structure 20 such that the hollow air spring 28 is compressible and expandable when a downward pressure is applied. By way of example, the overall height "$H_1$" of the hollow air spring 28 is approximately 1.66 inches, while the height "$h_1$" which is the distance between the top of the wide closed distal end 32 to the narrow middle 34 is approximately 1.10 inches. The hollow air spring 28 has two different diameters, the outer diameter "$OD_1$" which is the wide distal and proximal ends 32 and 36, and the inner diameter "$ID_1$" which is the narrow middle part 34. By way of example, the "$OD_1$" is approximately in a range of 3.50–3.70 inches, while the "$ID_1$" is approximately 2.00 inches. In addition, the hollow air spring 28 is made with several curved surfaces $R_1$, $R_2$ and $R_3$. By way of example, $R_1$ and $R_2$ are approximately 0.25 inch, while $R_3$ is approximately 0.13 inch. By way of example, the hollow air spring 28 has an angle "$A_1$", where "$A_1$" is approximately a 45° angle. By way of example, two adjacent hollow air springs 28 which are in the same row or column are spaced apart from one another approximately 6.00 inches from center to center (see FIG. 2). By way of example, two adjacent hollow air springs 28 which are not in the same row or column are spaced apart from one another approximately 3.00 inches from center to center (see FIG. 2).

Referring to FIGS. 2 and 4, there is shown a first group of a plurality of connecting tubes or members 38 which are substantially identical, and to the extent they are, only one will be described in detail. Each connecting tube 38 is integrally formed with the top layer 24 of the first air support structure 20, where each connecting tube 38 is respectively interconnected to two adjacent air springs 28 for allowing air to flow between the plurality of spaced apart vertical hollow mushroom shaped air springs 28.

The first air support structure 20 is also provided with a main inlet port 40 which is connected to an air supply line 42 which in turn connects to specified air springs 28 for supplying air under pressure to the other vertical hollow mushroom shaped air springs 28. The first air support structure 20 may be further customized to suit individuals by utilizing zoned distribution, where the first air support structure 20 may include at least three different zones therein. To fill the first air support structure 20, air, or the like, is adapted to be supplied to the plurality of mushroom shaped air springs 28 by the main inlet port 40 which in turn supplies it to the air supply line 42, which in turn supplies it to the plurality of air springs 28. The main inlet port 40 may have a conventional valve (not shown), which operates in a known manner to control the flow of gas into or out of the plurality of air springs 28 of the first air support structure 20. In the preparation of the first air spring support structure 20 for use, the valve is open, so that any air under pressure is supplied through the main inlet port 40 to the air supply line 42 which in turn supplies the specified air springs 28. The connecting tubes 38 are then supplying the air under pressure to all of the other air springs 28. The mushroom shaped air springs 28 are inflated to a desired stiffness. When the first air support structure 20 has been filled with the desired amount of air, the main inlet port 40 is closed off by a suitable cap (not shown).

Figure 7:
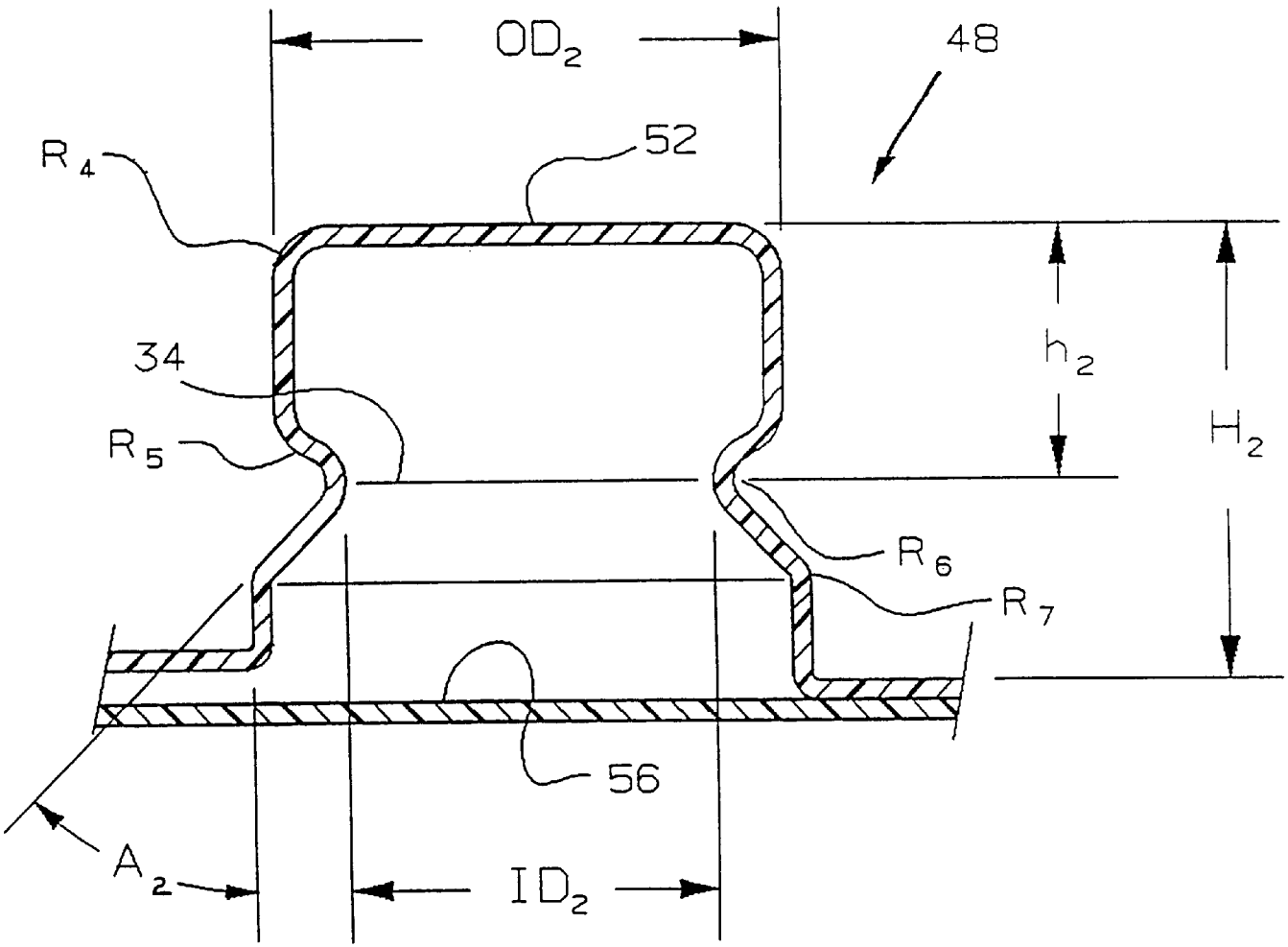
FIG. 7 is a side elevational view of one of the plurality of compressible and expandable members shown in FIG. 6.
Figure 8:
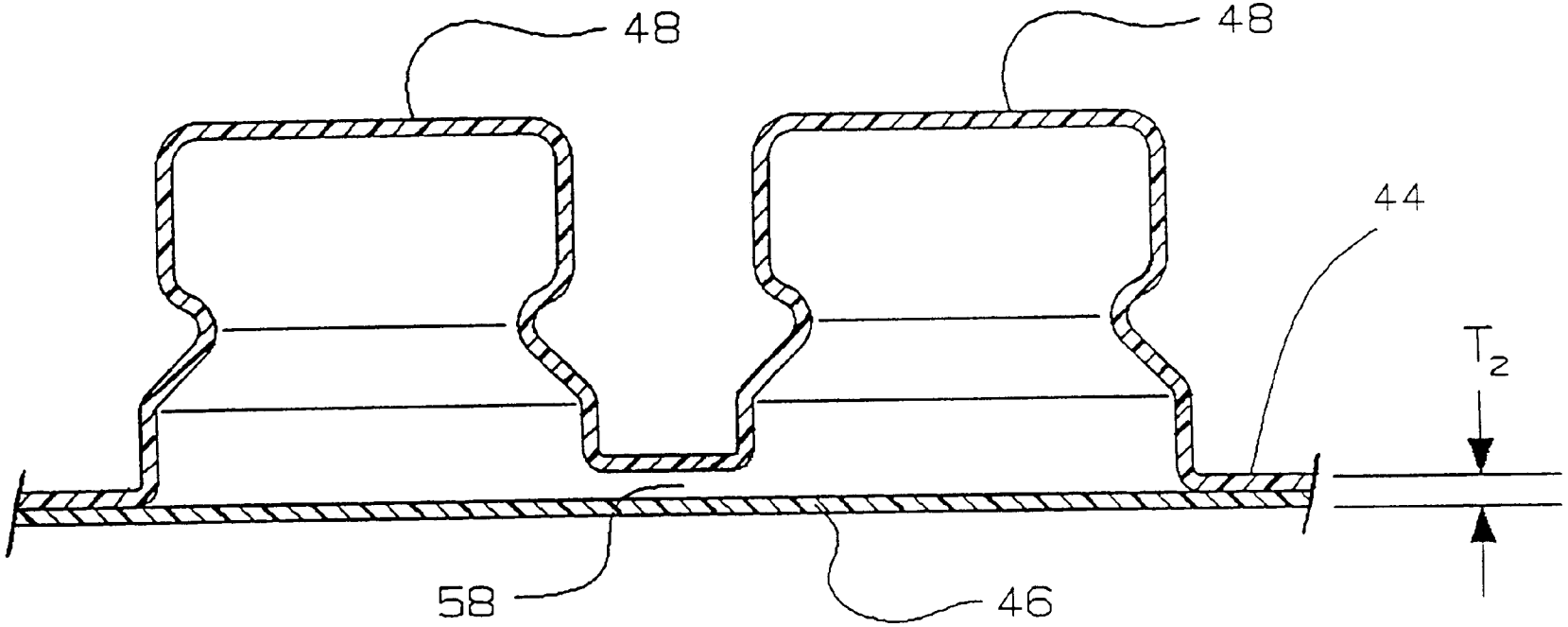
FIG. 8 is a cross-sectional view taken along line 8—8 of FIG. 6.

Referring to FIGS. 6, 7 and 8, the second air support structure 22 is constructed by a flexible top layer 44 and a flexible bottom layer 46 permanently affixed to the top layer 44 by ultrasonic welding, radio frequency (RF) and heat welding or other suitable means to form a plurality of spaced apart vertical adjustable hollow mushroom shaped air springs or compressible and expandable members 48. The two layers 44 and 46 form a base portion, where the vertical adjustable hollow mushroom shaped air springs 48 extend upwardly therefrom. By way of example, the thickness "$T_2$" of the two layers 44 and 46 when combined is approximately 0.25 inch. The plurality of hollow air springs 48 are arranged in an alternating offset arrangement from one another (see FIG. 6).

Referring to FIGS. 7 and 8, the plurality of hollow air springs 48 are substantially identical, and to the extent they are, only one will be described in detail below. Each hollow air spring 48 has a wide closed distal end 52, a narrow middle 54, and a wide open proximal end 56. The wide open proximal end 56 is integrally formed with the top layer 44 of the air support structure 22 such that the hollow air spring 48 is compressible and expandable when a downward pressure is applied. By way of example, the overall height "$H_2$" of the hollow air spring 48 is approximately 2.03 inches, while the height "$h_2$" which is the distance from the top of the wide closed distal end 52 to the narrow middle 44 is approximately 1.23 inches. The hollow air spring 48 has two different diameters, the outer diameter "$OD_2$" which is the wide distal and proximal ends 52 and 56, and the inner diameter "$ID_2$" which is the narrow middle part 54. By way of example, the "$OD_2$" is approximately in a range of 3.50–3.70 inches, while the inner diameter "$ID_2$" is approximately 2.00 inches. In addition, the hollow air spring 48 is made with several curved surfaces $R_4$, $R_5$, $R_6$, and $R_7$. By way example, $R_4$ and $R_5$ are approximately 0.25 inch, $R_6$, is approximately 0.13 inch and $R_7$ is approximately 0.06 inch. By way of example, the hollow air spring 48 has an angle $A_2$ which is a 45° angle. By way of example, two adjacent hollow air springs 48 which are in the same row or column are spaced apart from one another approximately 6.00 inches from center to center (see FIG. 6). By way of example, two adjacent hollow air springs 48 which are not in the same row or column are spaced apart from one another approximately 3.00 inches from center to center (see FIG. 6).

Referring to FIGS. 6 and 8, there is shown a second group of a plurality of connecting tubes or members 58 which are substantially identical, and to the extent they are, only one will be described in detail. Each connecting tube 58 is integrally formed with the top layer 44 of the second air support structure 22, where each connecting tube 58 is respectively interconnected to two adjacent air springs 48 for allowing air to flow between the plurality of spaced apart vertical hollow mushroom shaped air springs 48.

The second air support structure 22 is also provided with a main inlet port 60 which is connected to an air supply line 62 which in turn connects to specified air springs 48 for supplying air under pressure to the other vertical hollow mushroom shaped air springs 48. The second air support structure 22 may be further customized to suit individuals by utilizing zoned distribution, where the second air support structure 22 may include at least three different zones therein. To fill the second air support structure 22, air, or the like, is adapted to be supplied to the plurality of mushroom shaped air springs 48 by the main inlet port 60 which in turn supplies it to the air supply line 62, which in turn supplies it to the plurality of air springs 48. The main inlet port 60 may have a conventional valve (not shown), which operates in a known manner to control the flow of gas into or out of the plurality of air springs 48 of the second air support structure 22. In the preparation of the second air spring structure 22 for use, the valve is open, so that any air under pressure is supplied through the main inlet port 60 to the air supply line 62 which in turn supplies the specified air springs 48. The connecting tubes 58 are then supplying the air under pressure to all of the other air springs 48 of the second air support structure 22. The mushroom shaped air springs 48 are inflated to a desired stiffness. When the second air support structure 40 has been filled with the desired amount of air, the main inlet port 60 is closed off by a suitable cap (not shown).

Figure 5:
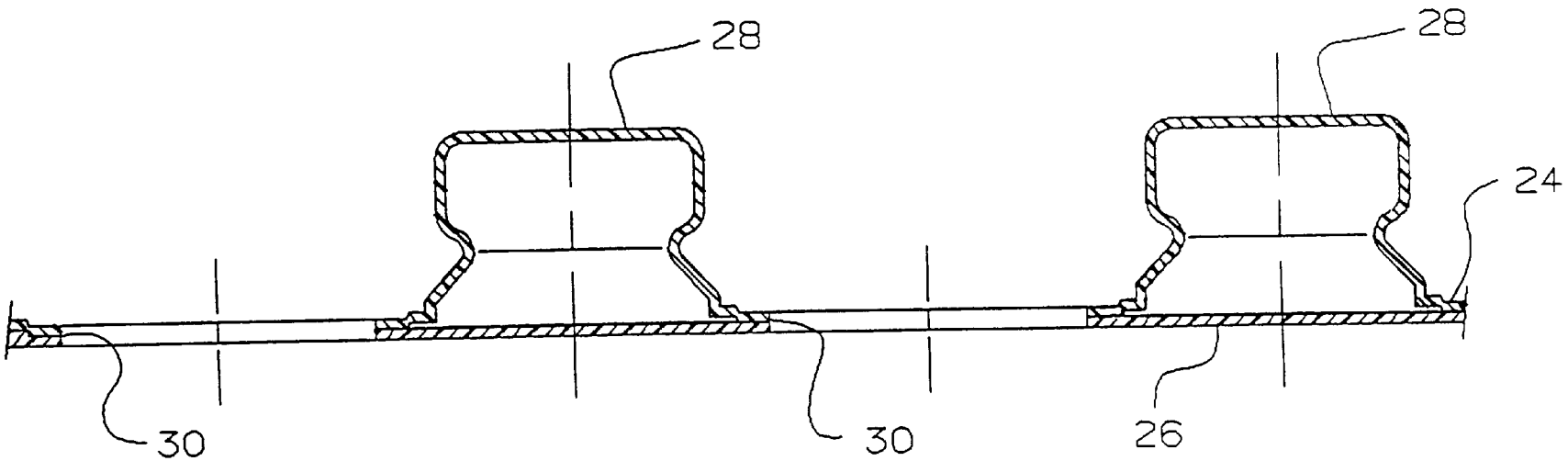
FIG. 5 is a cross-sectional view taken along line 5—5 of FIG. 2.
Figure 9:
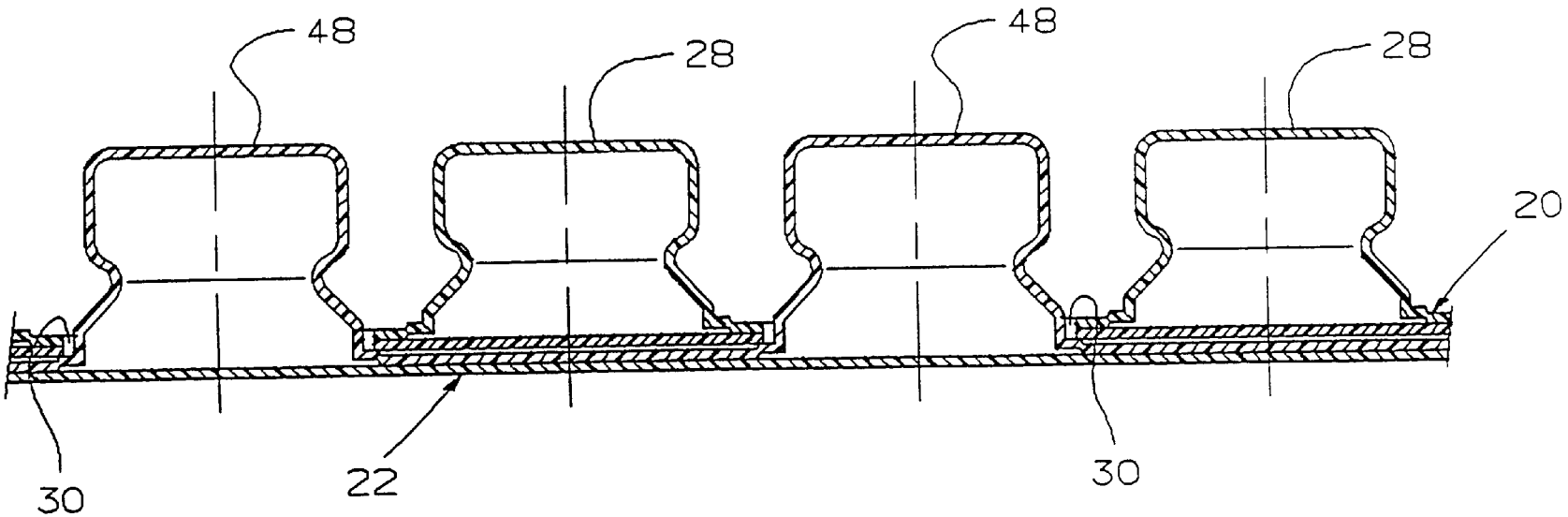
FIG. 9 is a partial cross-sectional view of the assembled mattress matrix assembly.
Figure 10:
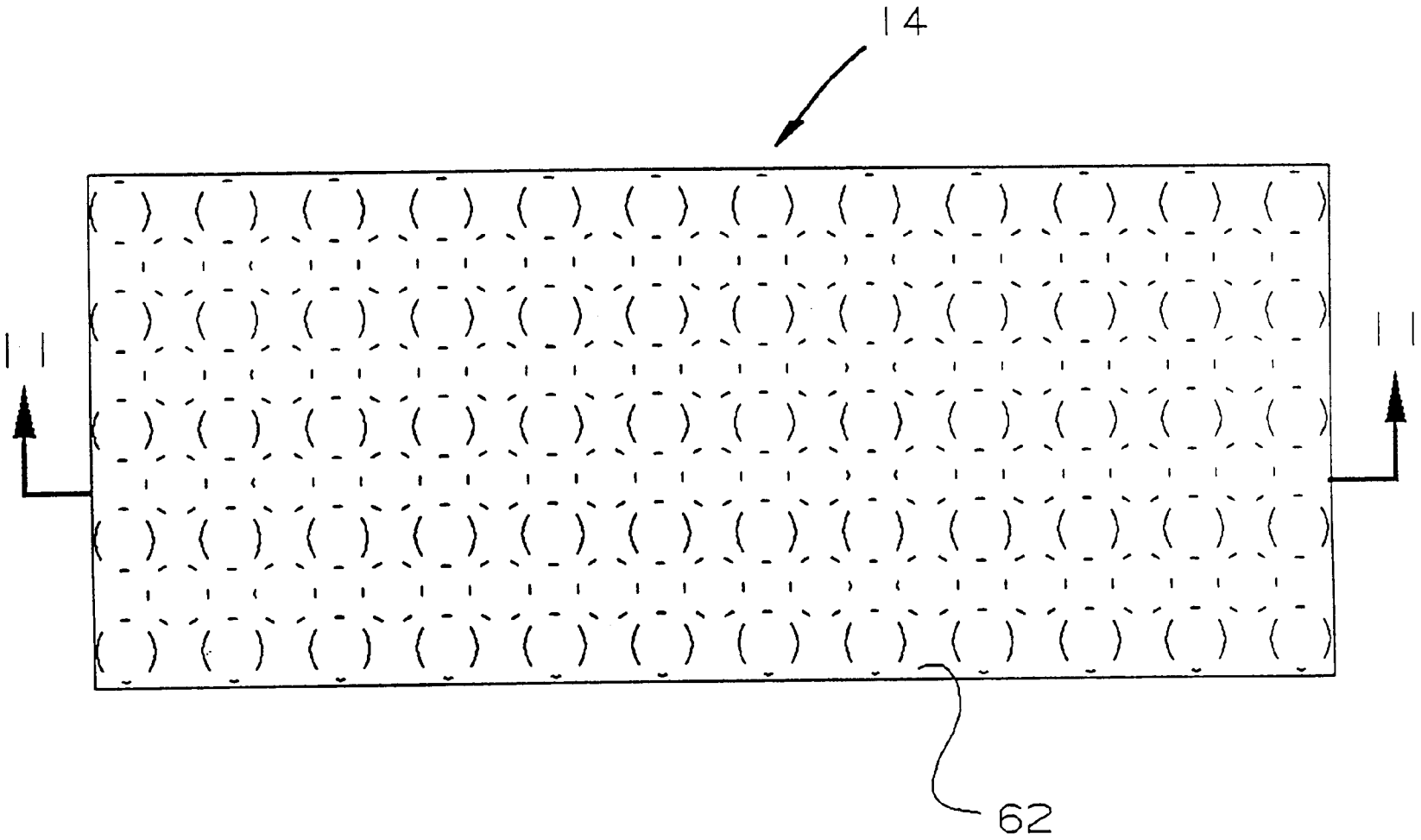
FIG. 10 is a top plan view of the box spring assembly of the present invention air spring bedding system.

Referring to FIGS. 2, 5 and 9, the plurality of apertures 30 are sized to fit a respective one of the plurality of mushroom shaped air springs 48 of the second air support structure 22. The second air support structure 22 is assembled below the first air support structure 20 such that a respective one of the plurality of mushroom shaped air springs 48 of the second air support structure 22 are aligned with and correspond to a respective one of the plurality of apertures 30 of the first air support structure 20. The mushroom shaped air springs 48 of the second air support structure 22 are respectively inserted upwardly into the plurality of apertures 30 of the first air support structure 20, such that the top layer 44 of the second air support structure 22 abuts against the bottom layer 26 of the first air support structure 20, and thereby forms a matrix arrangement of plurality of mushroom shaped air springs (rows and columns). The mushroom shaped air springs 28 of the first air support structure 20 and the mushroom shaped air springs 48 of the second air support structure 22 are relatively close together to prevent lateral movements of the air springs of the first and second air support structures 20 and 22 (see FIG. 9).

When a human body rests on top of the mattress matrix assembly 12, pressure is exerted on compressed mushroom shaped air springs 28 and 48 of the first and second air support structures 20 and 22. Where the force is heaviest, such as the buttock of the human body, air under pressure is transferred from the compressed air springs to lesser compressed air springs. The difference in pressure between the air springs of the first and second air support structures 20 and 22 creates portions of the mattress matrix assembly 12 that are pliable with minimal surface tension between supportive portions. The stress (pressure over area, P/A) produced is reduced because the pliable portions can conform to the complex curves of the human form and thus increase the area (A) supported. Stress concentrations are reduced due to the increase in area supported, overall reduction in supportive pressures and minimized surface tension.

Comfort is created by the ability of the mattress matrix assembly 12 to adjust the relative pressure over a large range to suit the various shapes and masses of resting bodies. Also inherent in the mattress matrix assembly's basic design is the ability to dynamically adapt to a variety of changing resting positions by the proper sizing of the same interconnection of air springs required for pressurization a zone or the entire structure.

Referring to FIGS. 10, 11, 12, and 13, there is shown the box spring assembly 14 which includes an upper airtight and fluid-tight support structure 62 and a lower airtight and fluid-tight support structure 64. The upper and lower airtight support structures 62 and 64 are generally rectangular shaped and have the same dimensions as the first and second air support structures of the mattress matrix assembly of the present invention air spring bedding system.

Figure 11:
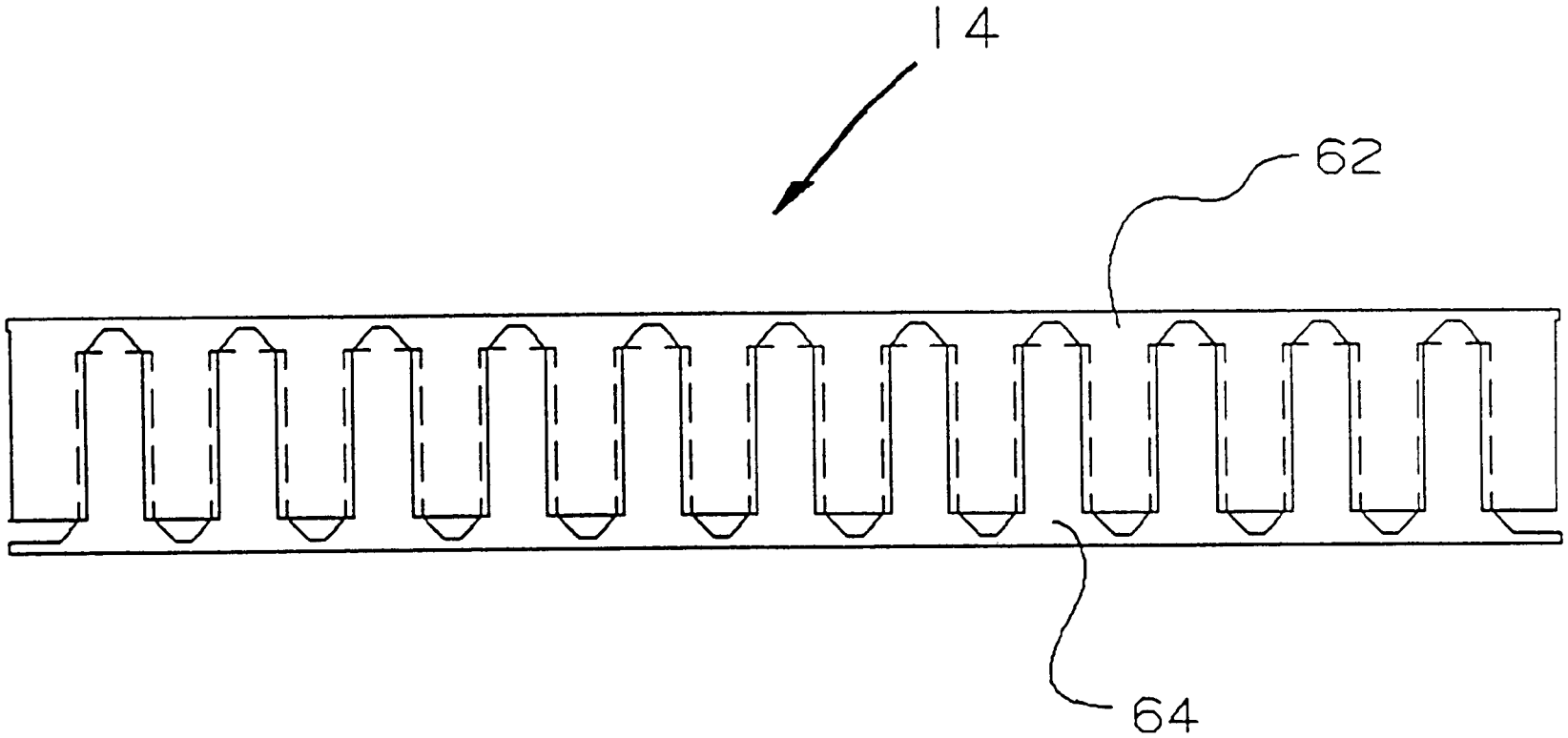
FIG. 11 is a cross-sectional view taken along line 11—11 of FIG. 10.
Figure 12:
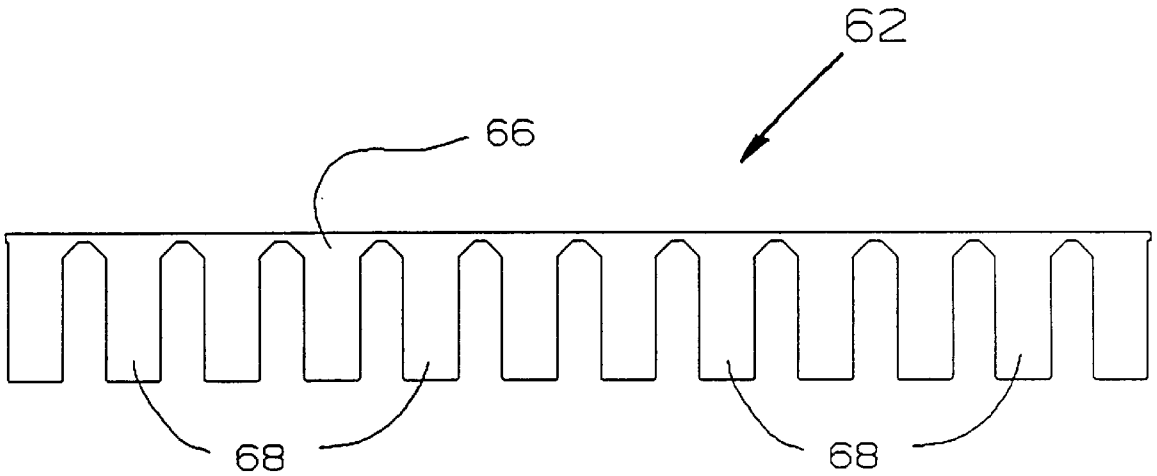
FIG. 12 is a side elevational view of an upper support structure of the box spring assembly of the present invention air spring bedding system.

Referring to FIGS. 11 and 12, the upper airtight and fluid-tight support structure 62 includes a horizontal upper plenum or chamber 66 and a plurality of spaced apart vertical hollow cylinders 68 which extend downwardly from and communicate with the upper plenum 66. These hollow cylinders 68 are arranged in a matrix arrangement (rows and columns).

Figure 13:
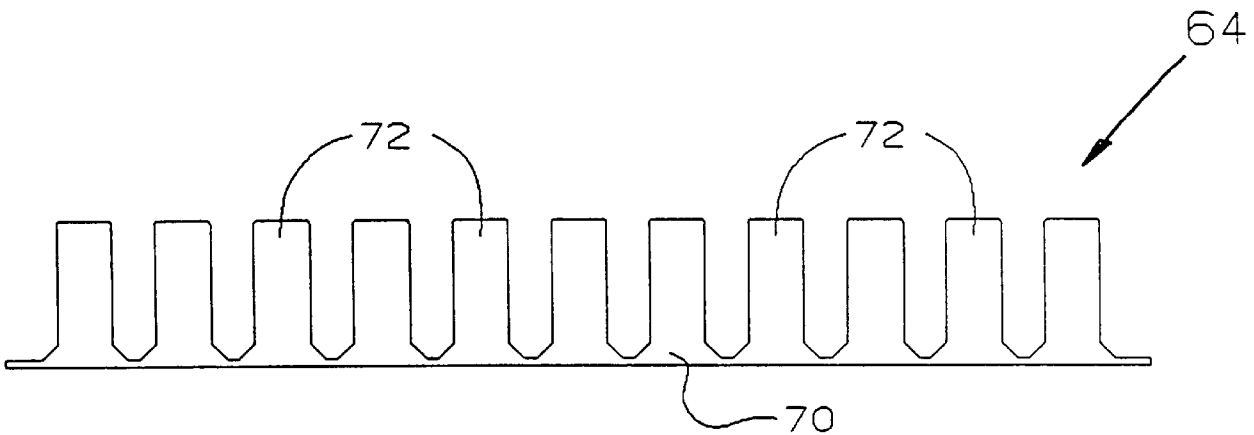
FIG. 13 is a side elevational view of an lower support structure of the box spring assembly of the present invention air spring bedding system.

Referring to FIGS. 11 and 13, the lower airtight and fluid-tight support structure 64 includes a horizontal lower plenum or chamber 70 and a plurality of spaced apart vertical hollow cylinders 72 which extend upwardly from and communicate with the lower plenum 70. These hollow cylinders 72 are also arranged in a matrix arrangement (rows and columns) but are offset from the hollow cylinders 68 of the upper support structure 62.

Referring to FIGS. 10, 11, 12, and 13, the plurality of hollow cylinders 68 of the upper support structure 62 are respectively inserted in-between the plurality of hollow cylinders 72 of the lower support structure 64 such that the plurality of hollow cylinders 68 and 72 of the upper and lower support structures 62 and 64 located adjacent to one another (see FIG. 11).

To fill the upper and lower airtight and fluid-tight support structures 62 and 64 of box spring assembly 14, air, or the like, is adapted to be supplied to the upper and lower support structures 62 and 64 by tubes (not shown), which are secured at one end in communication with the interior of the upper and lower support structures 62 and 64, and which has a conventional valve, which operates in known manner to control the flow of gas into or out of the upper and lower support structures 62 and 64. When the upper plenum 66 of the upper support structure 62 is compressed, the air flows from the upper plenum 66 to the plurality of hollow cylinders 68, while air flows from the plurality of hollow cylinders 72 to the lower plenum 70 of the lower support structure 64.

Referring to FIG. 1, the mattress matrix assembly 12 is positioned on top of the box spring assembly 14, thereby forming the present invention present air spring bedding system 10. The air spring bedding system 10 conforms to conventional forms of manufacture, or any other conventional way known to one skilled in the art. The elements of the present invention air spring bedding system 10 can be made from several materials. The manufacturing process which could accommodate the construction of the present invention bedding system may be injection, thermoform, etc. or other molding process. By way of example, the first and second air support structures 20 and 22 of the mattress matrix assembly 12, and the upper and lower support structures 62 and 64 of the box spring assembly 14 can be made from urethane material, vinyl material or any other suitable material.

It will be appreciated that the mattress matrix assembly 12 may be manufactured as a topper which is known in the bed industry. Using the teachings of the present invention, the topper may be manufactured according to the presefit invention.

Figure 14:
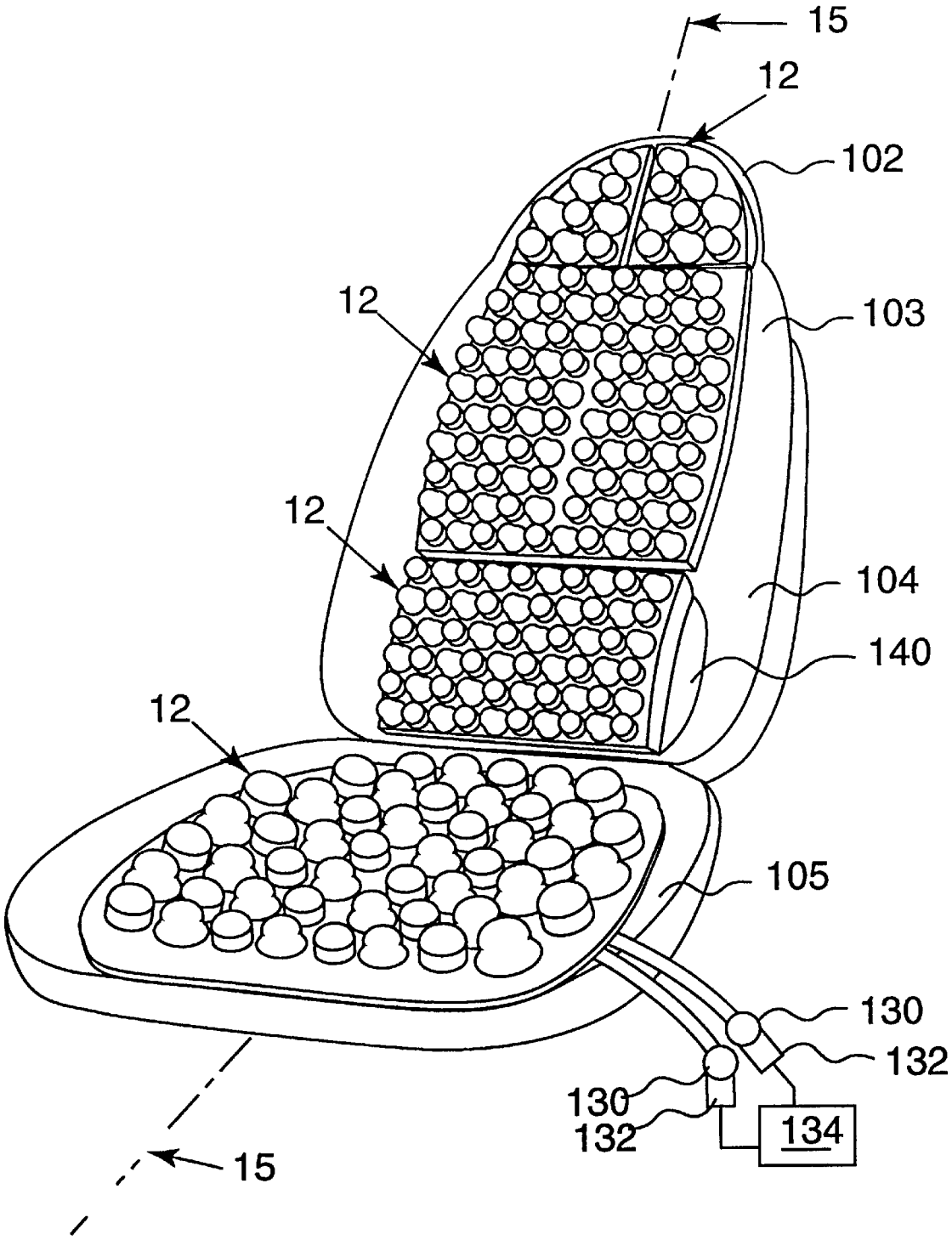
FIG. 14 is an illustration of a seat topper apparatus having a head support section, a thoracic support section, a lumbar support section, and a buttock and thigh support section, where the present invention massager cushioning device is embedded within each support section of the seat topper apparatus.
Figure 15:
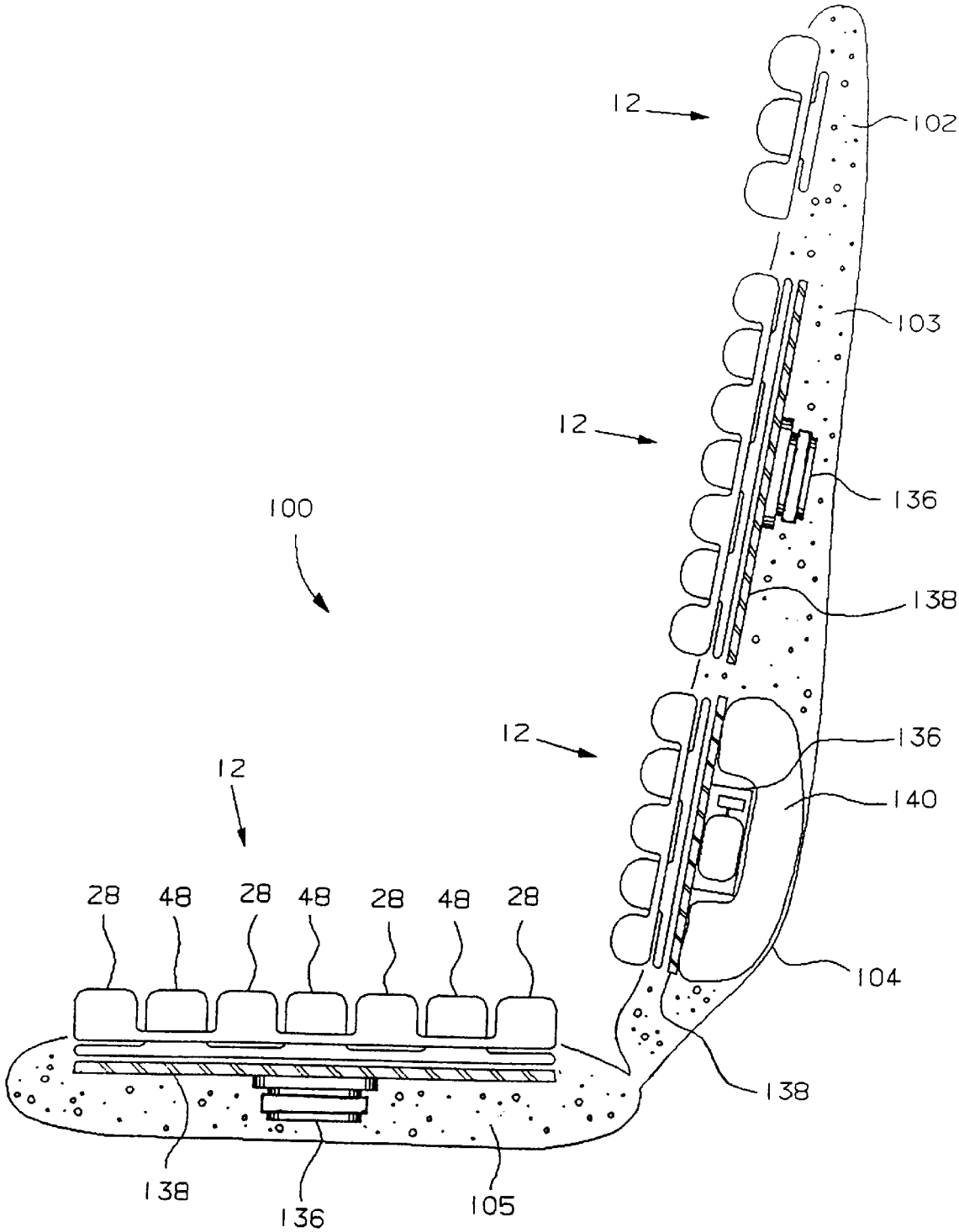
FIG. 15 is a cross-sectional view taken along line 15—15 of FIG. 14.

Referring to FIGS. 14 and 15, alternatively the present invention is an air massager cushioning device 12 used in conjunction with a seat topper apparatus 100, where the seat topper apparatus 100 includes at least a head support section 102, a thoracic support section 103, a lumbar support section 104, and a buttock and thigh support section 105. Each support section has the present invention air massager cushioning device 12 embedded thereto.

The present invention air massager cushioning device 12 not only support a weight of an individual who sits or rests on the air massager cushioning device 12 with minimal surface tension but also provides a massaging effect on the body part of the individual positioned on the air massager cushioning device. In this embodiment, the air massager cushioning device 12 assembles and functions similarly to the previously described embodiment above except that the device 12 is smaller in size to accommodate the support sections of the seat topper apparatus 100. FIGS. 2 though 9 will be used to describe the alternative embodiment of the present invention massager cushioning device 12. In addition, all of the parts of this embodiment which are the same as the previous embodiment has the same reference numbers as shown in FIGS. 2 through 9. The new parts are numbered with new reference numbers starting with hundredths.

The seat topper apparatus 100 may be manufactured with a cover (not shown) for covering the entire surface thereto. Referring to FIGS. 2, 6, 14, and 15, the massager cushioning device 12 includes a first air or fluid support structure 20 and a second air or fluid support structure 22, wherein both structures are airtight and fluid-tight to prevent leakage.

Referring to FIGS. 2, 3, 4, 5, 14, and 15, the first air support structure 20 is constructed by a flexible top layer 24 and a flexible bottom layer 26 permanently affixed to the top layer 24 by ultrasonic welding, radio frequency (RF) and heat welding or other suitable means to form a plurality of spaced apart hollow vertical adjustable air glands or expandable and contractible members 28. The top and bottom layers 24 and 26 form a base portion, where the hollow air glands 28 extend upwardly therefrom. By way of example, the thickness "$T_1$" of the two layers 24 and 26 when combined is approximately 0.25 inch. The hollow air glands 28 are arranged in an alternating offset arrangement from one another (see FIG. 2). A plurality of circular shaped apertures 30 are provided with the first air support structure 20 and are substantially identical in size and shape. These apertures 30 are also arranged in an alternating offset arrangement from one another and respectively located between the plurality of hollow air glands 28. The apertures 30 may be stamped out from the two layers 24 and 26, cut out or may be removed by any suitable means known to one skilled in the art.

Referring to FIGS. 3 and 4, the plurality of hollow air glands 28 are substantially identical, and to the extent they are, only one will be described in detail below. Each hollow air gland 28 has a wide closed distal end 32, a narrow middle 34, and a wide open proximal end 36. Each hollow air gland 28 may also have a configuration of a cylindrical shaped container as shown in FIG. 14. The wide proximal end 36 is integrally formed with the top layer 24 of the first air support structure 20 such that the hollow air gland 28 is expandable and contractible when a downward pressure is applied. By way of example, the overall height "$H_1$" of the hollow air gland 28 is approximately 1.66 inches, while the height "$h_1$" which is the distance between the top of the wide closed distal end 32 to the narrow middle 34 is approximately 1.10 inches. The hollow air gland 28 has two different diameters, the outer diameter "$OD_1$" which is the wide distal and proximal ends 32 and 36, and the inner diameter "$ID_1$" which is the narrow middle part 34. By way of example, the "$OD_1$" is approximately in a range of 3.50–3.70 inches, while the "$ID_1$" is approximately 2.00 inches. In addition, the hollow air gland 28 is made with several curved surfaces $R_1$, $R_2$ and $R_3$. By way of example, $R_1$ and $R_2$ are approximately 0.25 inch, while $R_3$ is approximately 0.13 inch. By way of example, the hollow air gland 28 has an angle "$A_1$", where the angle "$A_1$" is approximately a 45° angle. By way of example, two adjacent hollow air glands 28 which are in the same row or column are spaced apart from one another approximately 6.00 inches from center to center (see FIG. 2). By way of example, two adjacent hollow air glands 28 which are not in the same row or column are spaced apart from one another approximately 3.00 inches from center to center (see FIG. 2).

Referring to FIGS. 2 and 4, there is shown a first group of a plurality of connecting tubes or fluid ducts 38 which are substantially identical, and to the extent they are, only one will be described in detail. Each connecting tube 38 is integrally formed with the top layer 24 of the first air support structure 20, where the connecting tubes 38 are respectively interconnected to the plurality of air glands 28 for transferring air or fluid to flow between the plurality of spaced apart hollow air glands 28.

The first air support structure 20 is also provided with a main inlet port 40 which is connected to an air supply line 42 which in turn connects to specified air glands 28 for supplying air under pressure to the other hollow air glands 28. The first air support structure 20 may be further customized to suit individuals by utilizing zoned distribution, where the first air support structure 20 may include at least two different zone sections therein, wherein each zone section can be pressurized at different times. To fill the first air support structure 20, air, or the like, is adapted to be supplied to the plurality of hollow air glands 28 by the main inlet port 40 which in turn supplies it to the air supply line 42, which in turn supplies it to the plurality of air glands 28. The main inlet port 40 may have a conventional valve (not shown), which operates in a known manner to control the flow of gas into or out of the plurality of air glands 28 of the first air support structure 20. In the preparation of the first air support structure 20 for use, the valve is open, so that any air under pressure is supplied through the main inlet port 40 to the air supply line 42 which in turn supplies the specified air glands 28. The connecting tubes 38 are then supplying the air under pressure to all of the other air glands 28. The hollow air glands 28 are inflated to a desired stiffness. When the first air support structure 20 has been filled with the desired amount of air, the main inlet port 40 is closed off by a suitable cap (not shown).

Referring to FIGS. 6, 7, 8, 14, and 15, the second air support structure 22 is constructed by a flexible top layer 44 and a flexible bottom layer 46 permanently affixed to the top layer 44 by ultrasonic welding, radio frequency (RF) and heat welding or other suitablemineans to form a plurality of spaced apart hollow vertical adjustable air glands or expandable and contractible members 48. The two layers 44 and 46 form a base portion, where the hollow air glands 48 extend upwardly therefrom. By way of example, the thickness "$T_2$" of the two layers 44 and 46 when combined is approximately 0.25 inch. The plurality of hollow air glands 48 are arranged in an alternating offset arrangement from one another (see FIG. 6).

Referring to FIGS. 7 and 8, the plurality of hollow air glands 48 are substantially identical, and to the extent they are, only one will be described in detail below. Each hollow air gland 48 has a wide closed distal end 52, a narrow middle 54, and a wide open proximal end 56. Each hollow air gland 48 may also have a configuration of a cylindrical shaped container as shown in FIG. 14. The wide open proximal end 56 is integrally formed with the top layer 44 of the air support structure 22 such that the hollow air gland 48 is compressible and expandable when a downward pressure is applied. By way of example, the overall height "$H_2$" of the hollow air gland 48 is approximately 2.03 inches, while the height "$h_2$" which is the distance from the top of the wide closed distal end 52 to the narrow middle 44 is approximately 1.23 inches. The hollow air gland 48 has two different diameters, the outer diameter "$OD_2$" which is the wide distal and proximal ends 52 and 56, and the inner diameter "$ID_2$" which is the narrow middle part 54. By way of example, the "$OD_2$" is approximately in a range of 3.50–3.70 inches, while the inner diameter "$ID_2$" is approximately 2.00 inches. In addition, the hollow air gland 48 is made with several curved surfaces $R_4$, $R_5$, $R_6$, and $R_7$. By way example, $R_4$ and $R_5$ are approximately 0.25 inch, $R_6$, is approximately 0.13 inch and $R_7$ is approximately 0.06 inch. By way of example, the hollow air spring 48 has an angle $A_2$ which is a 45° angle. By way of example, two adjacent hollow air glands 48 which are in the same row or column are spaced apart from one another approximately 6.00 inches from center to center (see FIG. 6). By way of example, two adjacent hollow air glands 48 which are not in the same row or column are spaced apart from one another approximately 3.00 inches from center to center (see FIG. 6).

Referring to FIGS. 6 and 8, there is shown a second group of a plurality of connecting tubes or fluid ducts 58 which are substantially identical, and to the extent they are, only one will be described in detail. Each connecting tube 58 is integrally formed with the top layer 44 of the second air support structure 22, where the connecting tubes 58 are respectively interconnected to the hollow air glands 48 for transferring air to flow between the plurality of hollow air glands 48.

The second air support structure 22 is also provided with a main inlet port 60 which is connected to an air supply line 62 which in turn connects to specified air glands 48 for supplying air under pressure to the other hollow air glands 48. The second air support structure 22 may be further customized to suit individuals by utilizing zoned distribution, where the second air support structure 22 may include at least two different zone sections therein, wherein each zone section can be pressurized at different times. To fill the second air support structure 22, air, or the like, is adapted to be supplied to the plurality of air glands 48 by the main inlet port 60 which in turn supplies it to the air supply line 62, which in turn supplies it to the plurality of air glands 48. The main inlet port 60 may have a conventional valve (not shown), which operates in a known manner to control the flow of gas into or out of the plurality of air glands 48 of the second air support'structure 22. In the preparation of the second air support structure 22 for use, the valve is open, so that any air under pressure is supplied through the main inlet port 60 to the air supply line 62 which in turn supplies the specified air glands 48. The connecting tubes 58 are then supplying the air under pressure to all of the other air glands 48 of the second air support structure 22. The air glands 48 are inflated to a desired stiffness. When the second air support structure 40 has been filled with the desired amount of air, the main inlet port 60 is closed off by a suitable cap (not shown).

Referring to FIGS. 2, 5, 9, 14, and 15, the plurality of apertures 30 are sized to fit a respective one of the plurality of air glands 48 of the second air support structure 22. The second air support structure 22 is assembled below the first air support structure 20 such that a respective one of the plurality of air glands 48 of the second air support structure 22 are aligned with and correspond to a respective one of the plurality of apertures 30 of the first air support structure 20. The air glands 48 of the second air support structure 22 are respectively inserted upwardly into the plurality of apertures 30 of the first air support structure 20, such that the top layer 44 of the second air support structure 22 abuts against the bottom layer 26 of the first air support structure 20, and thereby forms a matrix surface arrangement of plurality of air glands (rows and columns). The air glands 28 and 48 of the first and second air support structures 20 and 22 are relatively in close proximity of one another to prevent lateral movements of the air glands of the first and second air support structures 20 and 22 (see FIG. 9).

When an individual is positioned on the massager cushioning device 12, pressure is exerted on compressed air glands 28 and 48 of the first and second air support structures 20 and 22. Where the force is heaviest, such as the buttock of the individual, air under pressure is transferred from the compressed air glands to lesser compressed air glands. The difference in pressure between the air glands of the first and second air support structures 20 and 22 creates portions of the massager cushioning device 12 that are pliable with minimal surface tension between supportive portions. The stress (pressure over area, P/A) produced is reduced because the pliable portions can conform to the complex curves of the human form and thus increase the area (A) supported. Stress concentrations are reduced due to the increase in area supported, overall reduction in supportive pressures and minimized surface tension.

Comfort is created by the ability of the massager cushioning device 12 to adjust the relative pressure over a range to suit the various shapes and masses of resting bodies. Also inherent in the massager cushioning device's basic design is the ability to dynamically adapt to a variety of changing resting positions by the proper sizing of the same interconnection of air glands required for pressurization a zone or the entire structure.

The massager cushioning device 12 further has the capability of rapidly inflating and deflating the plurality of hollow air glands 28 and 48 of the first and second air support structures 20 and 22 at different times to create a massaging effect for massaging the body part of the individual positioned on the plurality of hollow air glands 28 and 48 of the first and second air support structures 20 and 22. The pressurizing means may include inflation means 130, such as a pump for each of the first and second air support structure, motor means 132 for operating each of the inflation means and control means 134 for selectively operating the motor means.

Referring to FIG. 15, there is shown a magnetic vibratory means 136 such as a sonic transducer or other vibratory means. The magnetic vibratory means 136 are conventional in the art, and the description thereof will not be described in general terms. A semi-rigid transmission plate 138 is positioned underneath on the first and second air support structures 20 and 22. The magnetic vibratory means 136 is then attached to the transmission plate 138 for generating vibrations to and through the transmission plate 138 which in turn creates resonance vibrations to the first and second air support structures 20 and 22 and the body part of the individual for creating a massaging effect. A support means 140 is also provided with the magnetic vibratory means 136 for providing support thereto.

Figure 16:
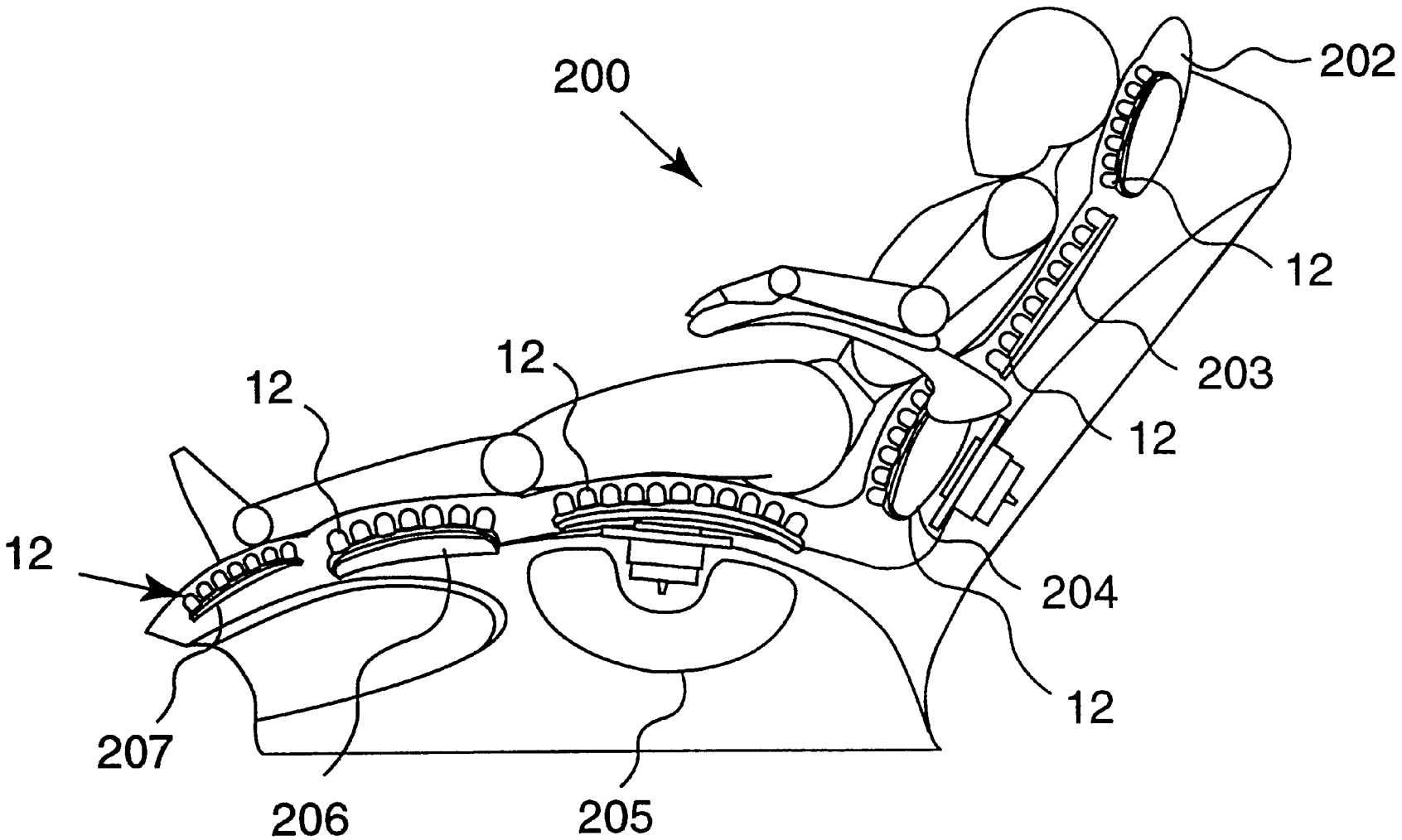
FIG. 16 is an illustration of a lounge chair having a head support, a thoracic support section, a lumbar support section, a buttock and thigh support section, a calf support section, and a foot support section, where the present invention massager cushioning device is embedded within each support section of the lounge chair.

Referring to FIG. 16, there is shown at 200 in alternative application of a lounge chair which includes at least a head support section 202, a thoracic support section 203, a lumbar support section 204, a buttock and thigh support section 205, a calf support section 206, and a foot support section 207. The present invention massager cushioning device 12 is embedded within each support section of the lounge chair 200.

Since the present invention massager cushioning device 12 assembles and functions the same in the preceding embodiment described above except that the seat topper apparatus 100 is substituted for the lounge chair 200, and the description thereof will not be repeated.

Figure 17:
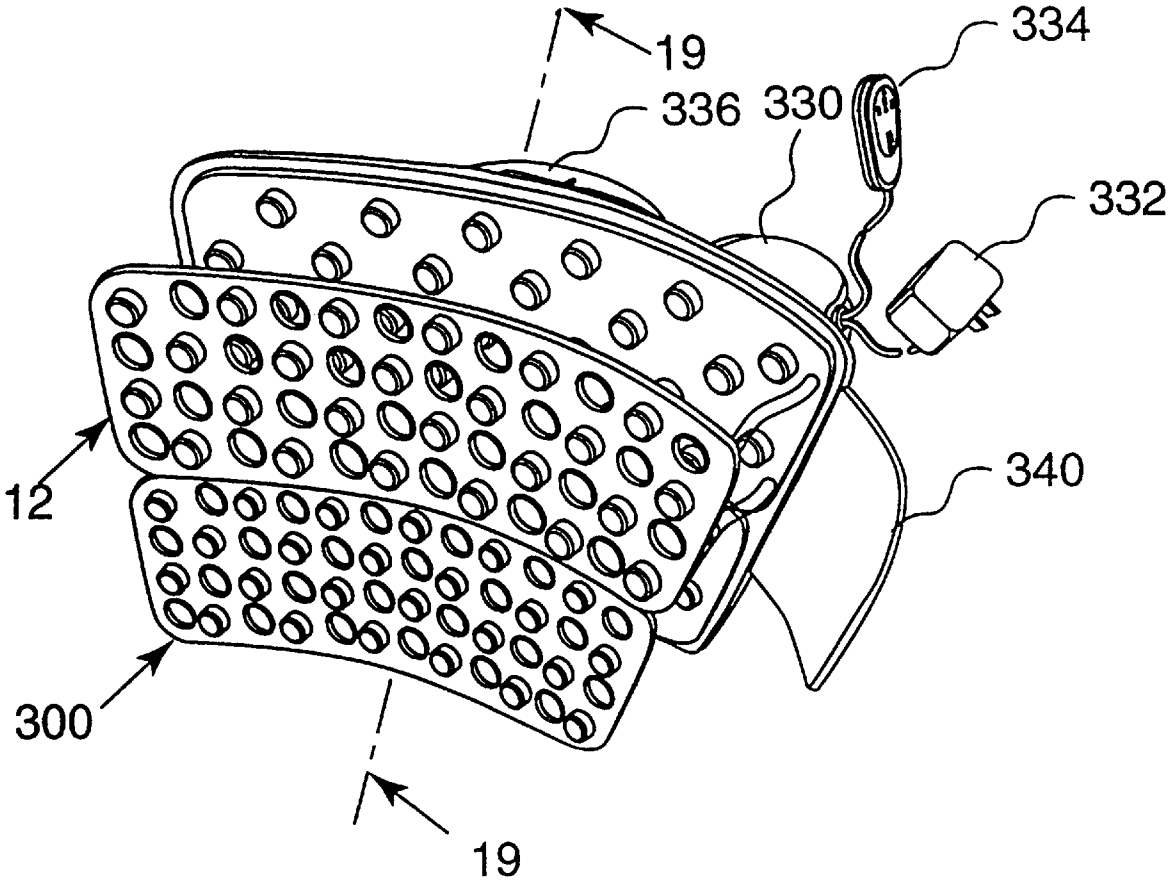
FIG. 17 is an illustration of a cuff apparatus utilizing the present invention massager cushioning device.
Figure 18:
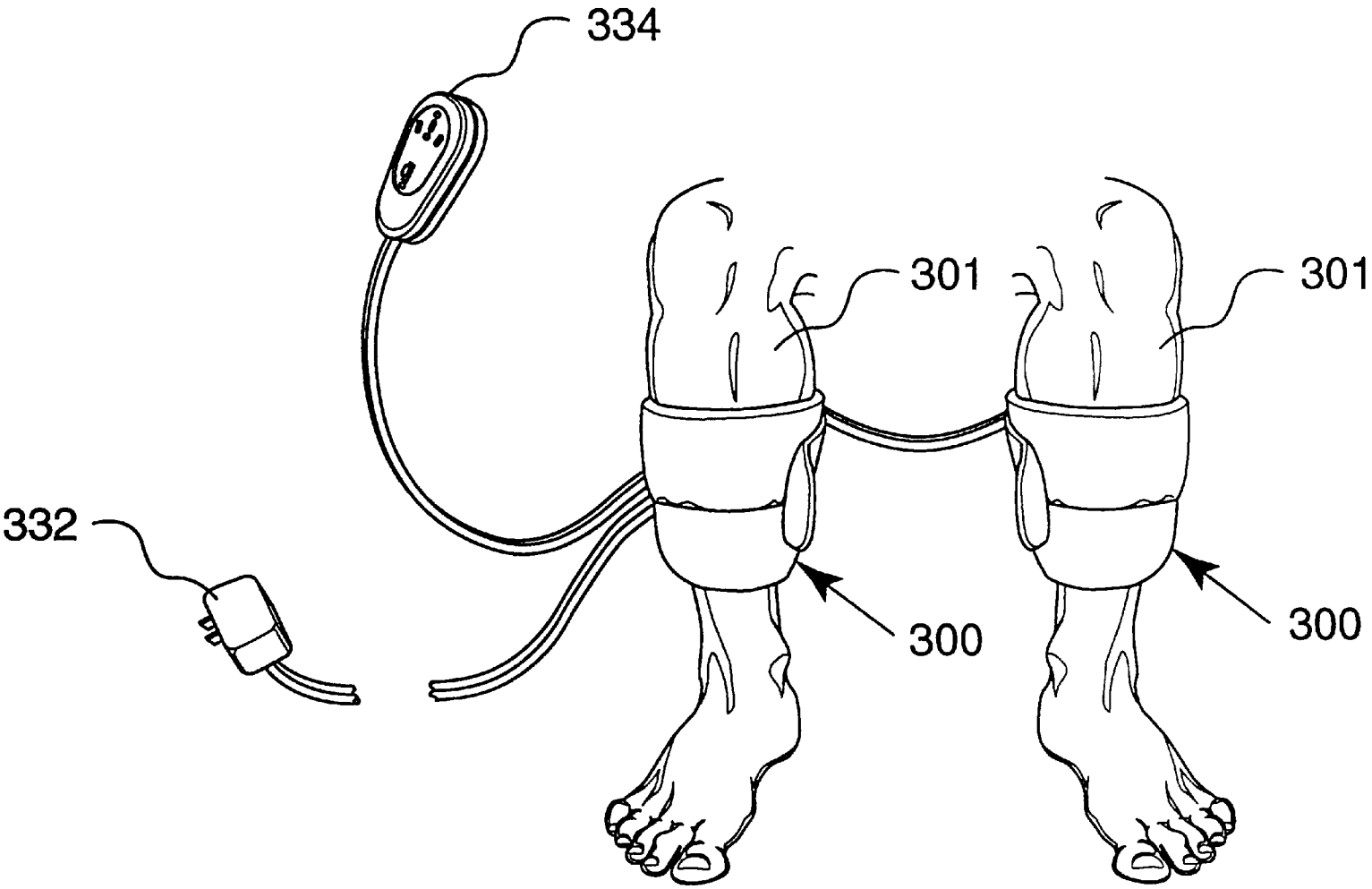
FIG. 18 is an illustration of the cuff apparatus attached to body parts of an individual.

Referring to FIGS. 17 and 18, there is shown at 300 a cuff apparatus for wrapping around body parts 301 of an individual and providing a massaging effect on the body part 301 of the individual. In this embodiment, the cuff apparatus 300 includes an air massager cushioning device 12 which assembles and functions similarly to the previously described embodiment above except that the device 12 is smaller in size to accommodate the cuff apparatus 300. FIGS. 2 though 9 will be used to describe the cuff apparatus 300. In addition, all of the parts of this embodiment are the same as the previous embodiment and have the same reference numbers as shown in FIGS. 2 through 9. The new parts are numbered with new reference numbers starting with three-hundred.

Referring to FIGS. 2, 6, 17, and 19, the cuff apparatus 300 may be manufactured with a front cover (not shown) for covering the front surface thereto. The massager cushioning device 12 includes a first air or fluid support structure 20 and a second air or fluid support structure 22, wherein both structures are airtight and fluid-tight to prevent leakage.

Referring to FIGS. 2, 3, 4, 5, 17, and 19, the first air support structure 20 is constructed by a flexible top layer 24 and a flexible bottom layer 26 permanently affixed to the top layer 24 by ultrasonic welding, radio frequency (RF) and heat welding or other suitable means to form a plurality of spaced apart hollow vertical adjustable air glands or expandable and contractible members 28. The top and bottom layers 24 and 26 form a base portion, where the hollow air glands 28 extend upwardly therefrom. By way of example, the thickness "$T_1$" of the two layers 24 and 26 when combined is approximately 0.25 inch. The hollow air glands 28 are arranged in an alternating offset arrangement from one another (see FIG. 2). A plurality of circular shaped apertures 30 are provided with the first air support structure 20 and are substantially identical in size and shape. These apertures 30 are also arranged in an alternating offset arrangement from one another and respectively located between the plurality of hollow air glands 28. The apertures 30 may be stamped out from the two layers 24 and 26, cut out or may be removed by any suitable means known to one skilled in the art.

Referring to FIGS. 3 and 4, the plurality of hollow air glands 28 are substantially identical, and to the extent they are, only one will be described in detail below. Each hollow air gland 28 has a wide closed distal end 32, a narrow middle 34, and a wide open proximal end 36. Each hollow air gland 28 may also have a configuration of a cylindrical shaped container as shown in FIG. 17. The wide proximal end 36 is integrally formed with the top layer 24 of the first air support structure 20 such that the hollow air gland 28 is expandable and contractible when a downward pressure is applied. By way of example, the overall height "$H_1$" of the hollow air gland 28 is approximately 1.66 inches, while the height "$h_1$" which is the distance between the top of the wide closed distal end 32 to the narrow middle 34 is approximately 1.10 inches. The hollow air gland 28 has two different diameters, the outer diameter "$OD_1$" which is the wide distal and proximal ends 32 and 36, and the inner diameter "$ID_1$" which is the narrow middle part 34. By way of example, the "$OD_1$" is approximately in a range of 3.50–3.70 inches, while the "$ID_1$" is approximately 2.00 inches. In addition, the hollow air gland 28 is made with several curved surfaces $R_1$, $R_2$ and $R_3$. By way of example, $R_1$ and $R_2$ are approximately 0.25 inch, while $R_3$ is approximately 0.13 inch. By way of example, the hollow air gland 28 has an angle "$A_1$", where the angle "$A_1$" is approximately a 45° angle. By way of example, two adjacent hollow air glands 28 which are in the same row or column are spaced apart from one another approximately 6.00 inches from center to center (see FIG. 2). By way of example, two adjacent hollow air glands 28 which are not in the same row or column are spaced apart from one another approximately 3.00 inches from center to center (see FIG. 2).

Referring to FIGS. 2 and 4, there is shown a first group of a plurality of connecting tubes or fluid ducts 38 which are substantially identical, and to the extent they are, only one will be described in detail. Each connecting tube 38 is integrally formed with the top layer 24 of the first air support structure 20, where the connecting tubes 38 are respectively interconnected to the plurality of air glands 28 for transferring air or fluid to flow between the plurality of spaced apart hollow air glands 28.

The first air support structure 20 is also provided with a main inlet port 40 which is connected to an air supply line 42 which in turn connects to specified air glands 28 for supplying air under pressure to the other hollow air glands 28. The first air support structure 20 may be further customized to suit individuals by utilizing zoned distribution, where the first air support structure 20 may include at least two different zone sections therein, wherein each zone section can be pressurized at different times. To fill the first air support structure 20, air, or the like, is adapted to be supplied to the plurality of hollow air glands 28 by the main inlet port 40 which in turn supplies it to the air supply line 42, which in turn supplies it to the plurality of air glands 28. The main inlet port 40 may have a conventional valve (not shown), which operates in a known manner to control the flow of gas into or out of the plurality of air glands 28 of the first air support structure 20. In the preparation of the first air support structure 20 for use, the valve is open, so that any air under pressure is supplied through the main inlet port 40 to the air supply line 42 which in turn supplies the specified air glands 28. The connecting tubes 38 are then supplying the air under pressure to all of the other air glands 28. The hollow air glands 28 are inflated to a desired stiffness. When the first air support structure 20 has been filled with the desired amount of air, the main inlet port 40 is closed off by a suitable cap (not shown).

Referring to FIGS. 6, 7, 8, 17, and 19, the second air support structure 22 is constructed by a flexible top layer 44 and a flexible bottom layer 46 permanently affixed to the top layer 44 by ultrasonic welding, radio frequency (RF) and heat welding or other suitable means to form a plurality of spaced apart hollow vertical adjustable air glands or expandable and contractible members 48. The two layers 44 and 46 form a base portion, where the hollow air glands 48 extend upwardly therefrom. By way of example, the thickness "$T_2$" of the two layers 44 and 46 when combined is approximately 0.25 inch. The plurality of hollow air glands 48 are arranged in an alternating offset arrangement from one another (see FIG. 6).

Referring to FIGS. 7 and 8, the plurality of hollow air glands 48 are substantially identical, and to the extent they are, only one will be described in detail below. Each hollow air gland 48 has a wide closed distal end 52, a narrow middle 54, and a wide open proximal end 56. Each hollow air gland 48 may also have a configuration of a cylindrical shaped container as shown in FIG. 14. The wide open proximal end 56 is integrally formed with the top layer 44 of the air support structure 22 such that the hollow air gland 48 is compressible and expandable when a downward pressure is applied. By way of example, the overall height "$H_2$" of the hollow air gland 48 is approximately 2.03 inches, while the height "$h_2$" which is the distance from the top of the wide closed distal end 52 to the narrow middle 44 is approximately 1.23 inches. The hollow air gland 48 has two different diameters, the outer diameter "$OD_2$" which is the wide distal and proximal ends 52 and 56, and the inner diameter "$ID_2$" which is the narrow middle part 54. By way of example, the "$OD_2$" is approximately in a range of 3.50–3.70 inches, while the inner diameter "$ID_2$" is approximately 2.00 inches. In addition, the hollow air gland 48 is made with several curved surfaces $R_4$, $R_5$, $R_6$, and $R_7$. By way example, $R_4$ and $R_5$ are approximately 0.25 inch, $R_6$, is approximately 0.13 inch and $R_7$ is approximately 0.06 inch. By way of example, the hollow air spring 48 has an angle $A_2$ which is a 45° angle. By way of example, two adjacent hollow air glands 48 which are in the same row or column are spaced apart from one another approximately 6.00 inches from center to center (see FIG. 6). By way of example, two adjacent hollow air glands 48 which are not in the same row or column are spaced apart from one another approximately 3.00 inches from center to center (see FIG. 6).

Referring to FIGS. 6 and 8, there is shown a second group of a plurality of connecting tubes or fluid ducts 58 which are substantially identical, and to the extent they are, only one will be described in detail. Each connecting tube 58 is integrally formed with the top layer 44 of the second air support structure 22, where the connecting tubes 58 are respectively interconnected to the hollow air glands 48 for transferring air to flow between the plurality of hollow air glands 48.

The second air support structure 22 is also provided with a main inlet port 60 which is connected to an air supply line 62 which in turn connects to specified air glands 48 for supplying air under pressure to the other hollow air glands 48. The second air support structure 22 may be further customized to suit individuals by utilizing zoned distribution, where the second air support structure 22 may include at least two different zone sections therein, wherein each zone section can be pressurized at different times. To fill the second air support structure 22, air, or the like, is adapted to be supplied to the plurality of air glands 48 by the main inlet port 60 which in turn supplies it to the air supply line 62, which in turn supplies it to the plurality of air glands 48. The main inlet port 60 may have a conventional valve (not shown), which operates in a known manner to control the flow of gas into or out of the plurality of air glands 48 of the second air support structure 22. In the preparation of the second air support structure 22 for use, the valve is open, so that any air under pressure is supplied through the main inlet port 60 to the air supply line 62 which in turn supplies the specified air glands 48. The connecting tubes 58 are then supplying the air under pressure to all of the other air glands 48 of the second air support structure 22. The air glands 48 are inflated to a desired stiffness. When the second air support structure 40 has been filled with the desired amount of air, the main inlet port 60 is closed off by a suitable cap (not shown).

Referring to FIGS. 2, 5, 9, 17, and 19, the plurality of apertures 30 are sized to fit a respective one of the plurality of air glands 48 of the second air support structure 22. The second air support structure 22 is assembled below the first air support structure 20 such that a respective one of the plurality of air glands 48 of the second air support structure 22 are aligned with and correspond to a respective one of the plurality of apertures 30 of the first air support structure 20. The air glands 48 of the second air support structure 22 are respectively inserted upwardly into the plurality of apertures 30 of the first air support structure 20, such that the top layer 44 of the second air support structure 22 abuts against the bottom layer 26 of the first air support structure 20, and thereby forms a matrix surface arrangement of plurality of air glands (rows and columns). The air glands 28 and 48 of the first and second air support structures 20 and 22 are relatively in close proximity of one another to prevent lateral movements of the air glands of the first and second air support structures 20 and 22 (see FIG. 9).

Referring to FIGS. 17 and 18, the massager cushioning device 12 has the capability of rapidly inflating and deflating the plurality of hollow air glands 28 and 48 of the first and second air support structures 20 and 22 at different times to create a massaging effect for massaging the body part of the individual positioned on the plurality of hollow air glands 28 and 48 of the first and second air support structures 20 and 22. Fastener means 340 is provided with the cuff apparatus for securing the cuff apparatus to the body part 301 of the individual. The pressurizing means may include inflation means 330, such as a pump for each of the first and second air support structure, motor means 332 for operating each of the inflation means and control means 334 for selectively operating the motor means.

Figure 19:
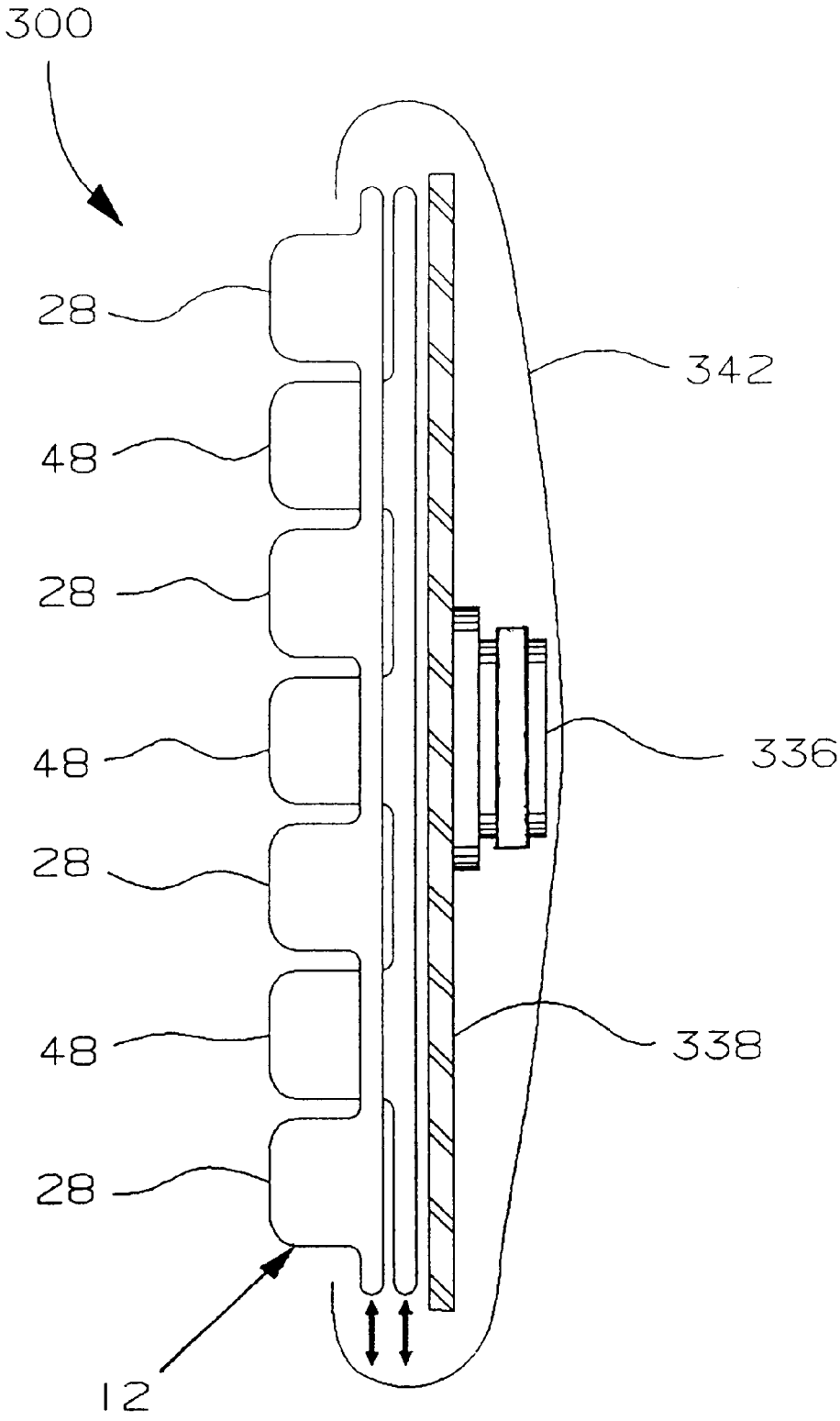
FIG. 19 is a cross-sectional view taken along line 19—19 of FIG. 17.

Referring to FIGS. 17, 18 and 19, there is shown a magnetic vibratory means 336 such as a sonic transducer or other vibratory means. The magnetic vibratory means 336 is conventional in the art, and the description thereof will only be described in general terms. A flexible transmission plate 338 is positioned undertieath on the first and second air support structures 20 and 22, and has the capability of bending to conform with and wrap around the body part of the individual. The magnetic vibratory means 336 is then attached to the transmission plate 338 for generating vibrations to and through the transmission plate 338 which in turn creates resonance vibrations to the first and second air support structures 20 and 22 and the body part 301 of the individual for creating a massaging effect. A rear cover 342 is provided with the cuff apparatus 300 for covering the magnetic vibratory means 336 and the transmission plate 338.

The manufacturing process which could accommodate the construction of the massager cushioning device may be pressure forming, vacuum forming, injection, thermoform, etc. or other molding process. By way of example, the first and second air support structures can be made of urethane material, vinyl material or any other suitable material.

Figure 20:
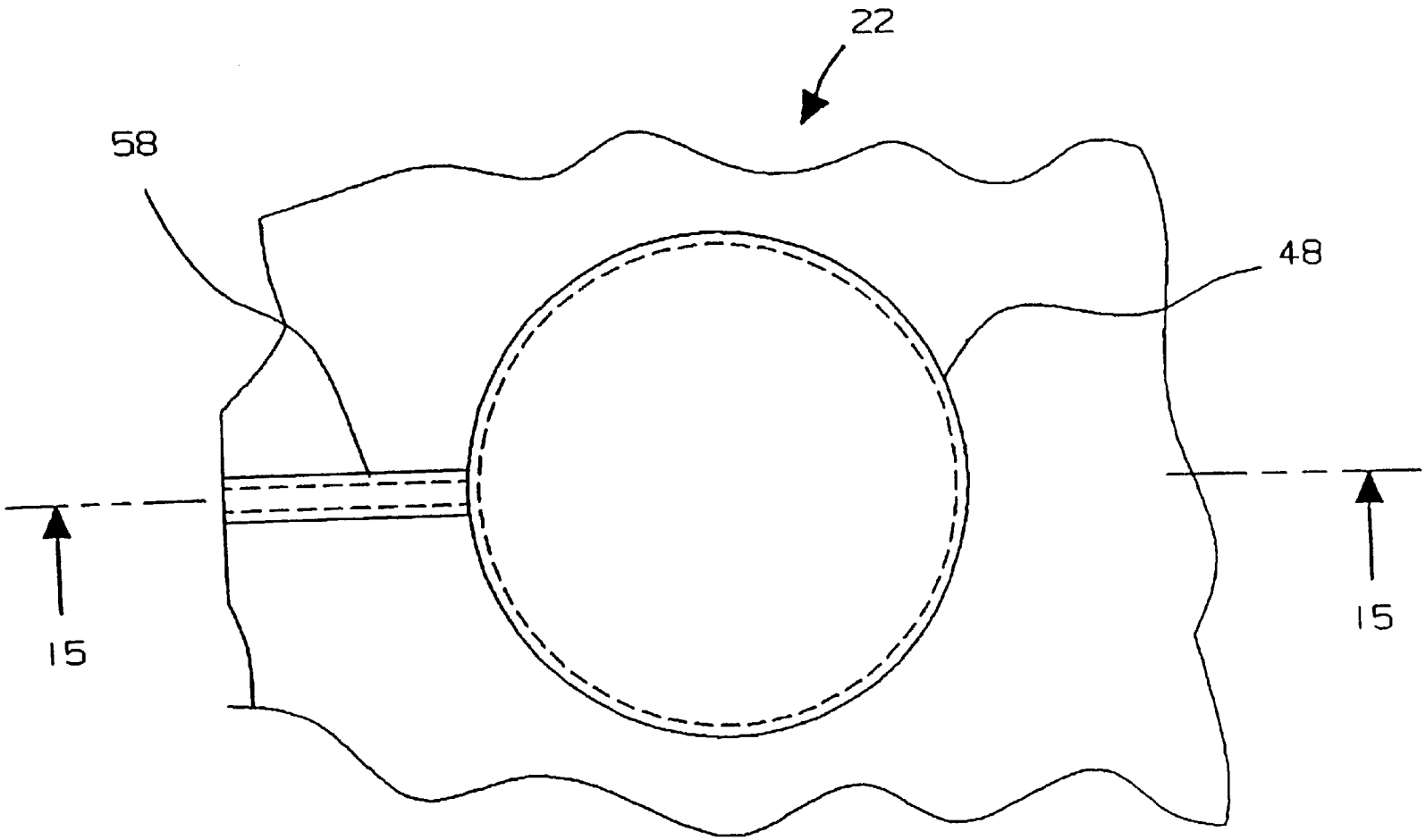
FIG. 20 is a partial top plan view of an air structure formed according to the present invention.
Figure 21:
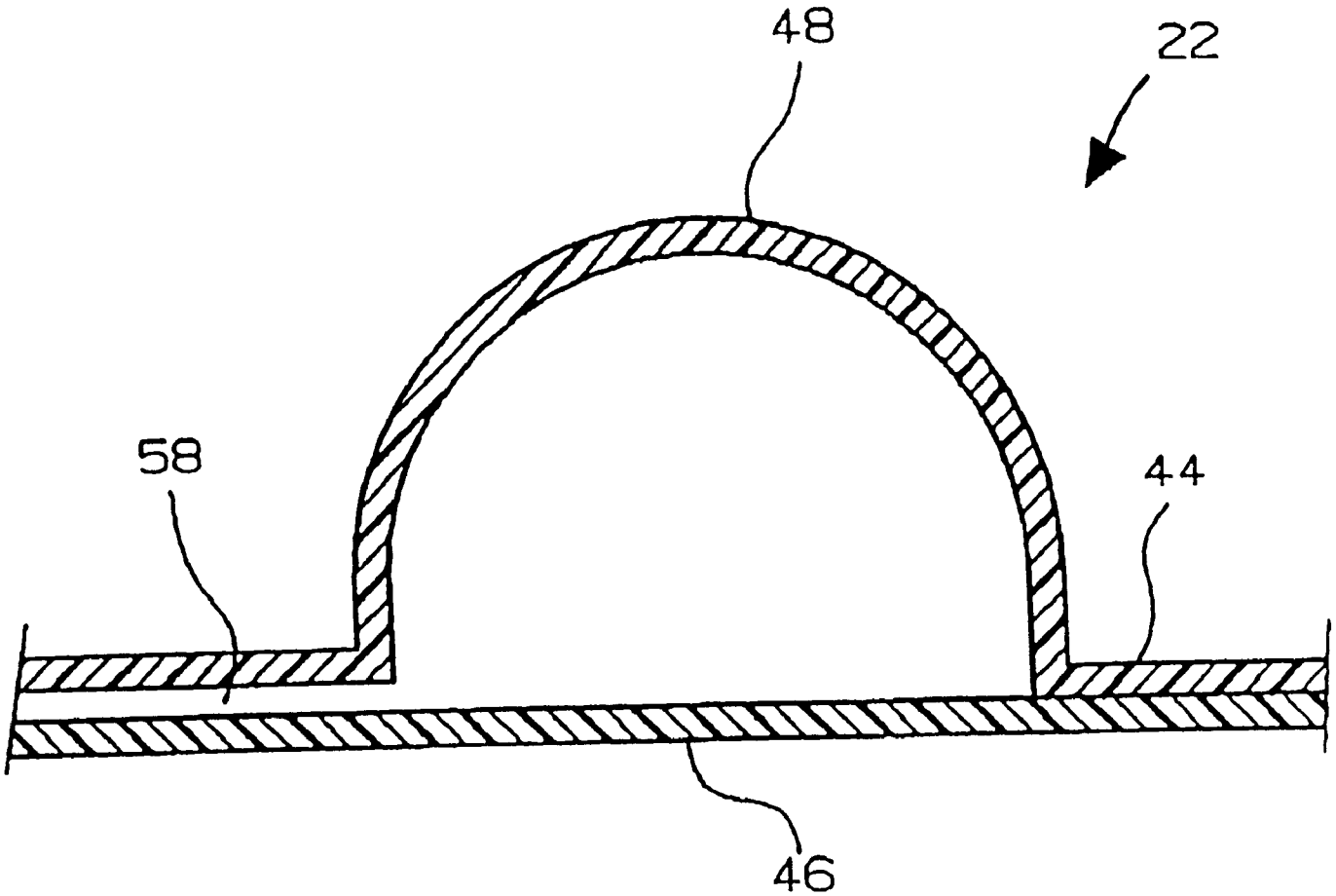
FIG. 21 is a cross-sectional view taken along line 21—21 of FIG. 20.

Referring to FIGS. 20 and 21, there are respectively shown a partial top plan view and a partial cross-sectional view of an air structure 22 form by the present invention method. The air structure 22 comprises a plurality of air glands 48 and a plurality of air channels or ducts 58 which are respectively and integrally connected to the plurality of air glands (only one air gland and air channel are shown in FIGS. 20 and 21, also see FIG. 6).

Figure 22:
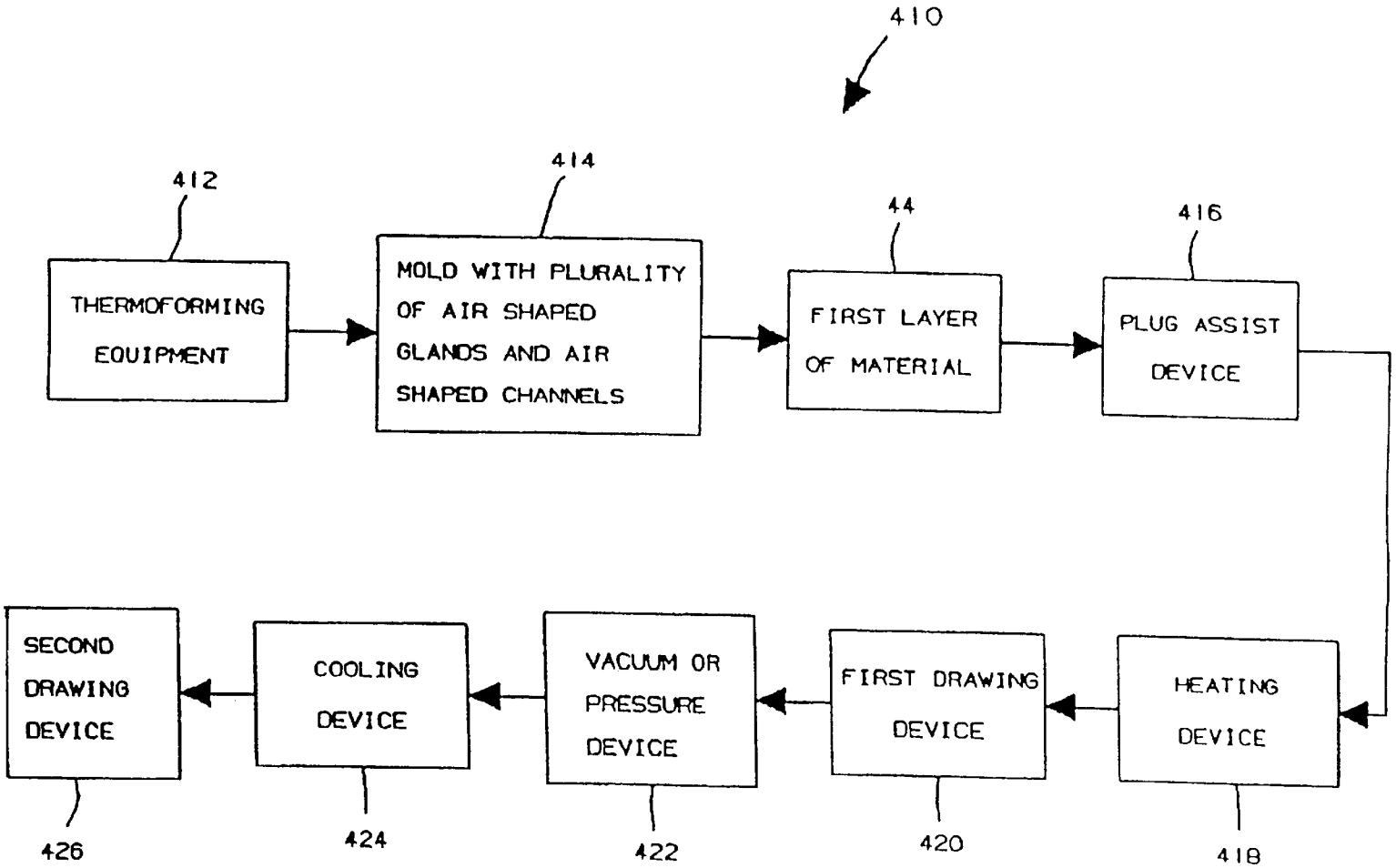
FIG. 22 is a block diagram illustrating the steps of the present invention method of forming an air structure.

Referring to FIG. 22, there is shown a block diagram 410 of the present invention method showing the steps in which the air structure 22 (also see FIG. 6) is formed from a generally flat flexible first layer of material 44 and a generally flat flexible second layer of material 46.

The forming method 410 utilizes a thermoforming equipment 412 to form the air structure 22. A shaped mold 414 is provided and is retained within the thermoforming equipment 412. The mold 414 is primarily a convex (male) shaped tool or a concave (female) shaped tool that enables its shape to be transferred to a heated sheet of material with or without a plug assist device or mechanical helper 416. The plug assist device 416 is used for pushing through the material to pre-shape the material. The plug assist device 416 is used because substantial material thickness can be lost due to thinning during the thermoforming process. The plug assist device 416 is used to promote uniformity of distribution by carrying extra material toward the area of the mold that would otherwise be thinned. The plug assist device 416 is commonly a shaped male device that pushes extra material down into the shaped mold 414.

The shaped mold 414 includes a plurality of air shaped glands and a plurality of air shaped channels or ducts. The first layer 44 of material is positioned over the mold 414. A heating device 418 actively heats the first layer 44 of material. A drawing device 420 draws the first layer 44 of material against the mold 414. A vacuum or pressure means 422 is positioned against the mold 414 to further draw the first layer 44 of material tightly into the mold 414, so that the first layer 44 of material forms into the plurality of air shaped glands and air shaped channels of the mold 414. The formed first layer 44 is then cooled by a cooling device 424 and then removed from the thermoforming equipment 412, where the first layer 44 has the shaped air glands and channels therein.

Figure 23:
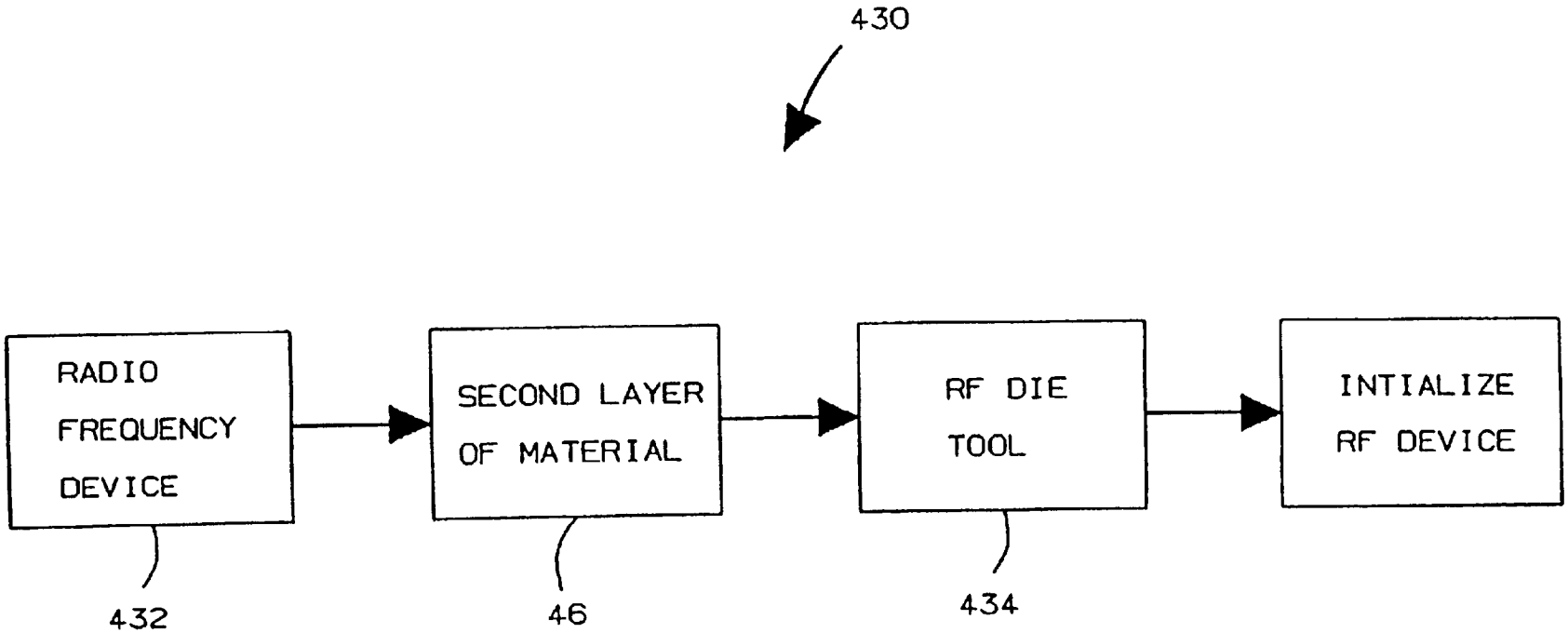
FIG. 23 is a block diagram illustrating the steps of the present invention method of sealing an air structure.

Referring to FIG. 23, there is shown a block diagram of the present invention method showing the steps in which the first layer of material 44 and the second layer of material 46 are sealed together to form the air tight structure 22.

The sealing method 430 utilizes a radio frequency (RF) device 432 to seal the first layer 44 of material onto the second layer 46 of material. The second layer 46 of material is positioned against the formed first layer 44 of material. Both are positioned on the RF device 432 to be sealed together. An RF die tool 434 is provided with the RF device 432. The die tool 434 is applied against the first layer 44 of material and the second layer 46 of material to achieve a uniform contact. The die tool 434 is a shaped brass, aluminum or brass and aluminum that directs the RF energy operating at or approximately 27 MHz and between 1–100 Kilowatts in order to excite the molecules of the first layer 44 of material and the second layer 46 of material enabling a weld or seal between them. The RF device 432 is initialized, and thereby activates the die tool 434 to make a weld therebetween.

Figure 24:
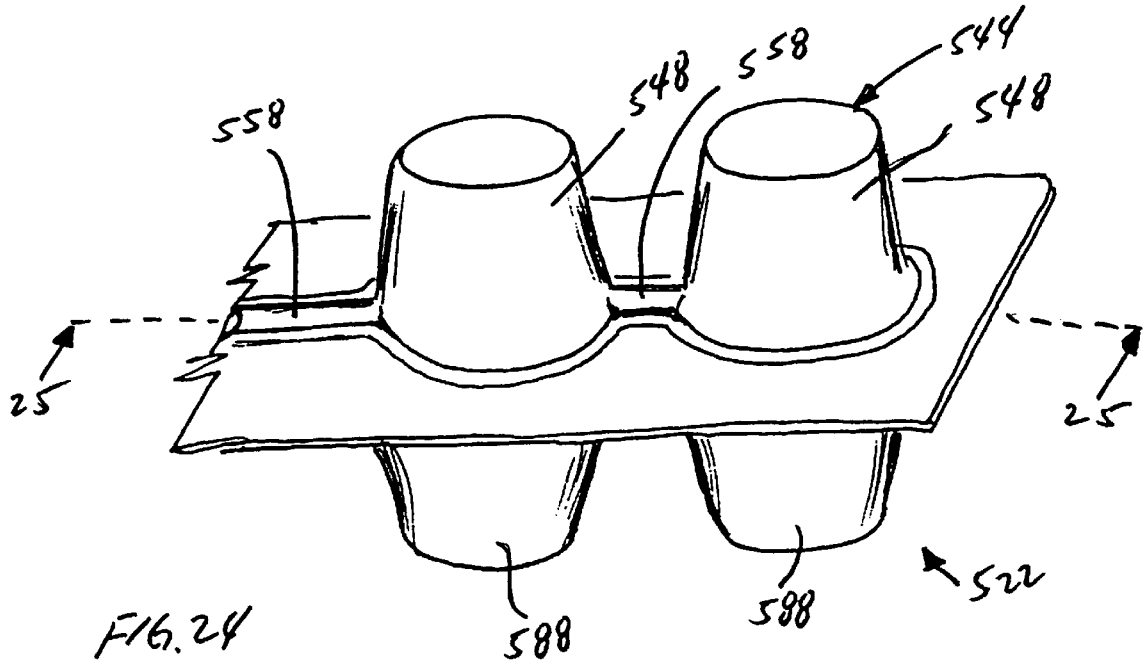
FIG. 24 is a partial perspective view of a further embodiment of an air structure formed in accordance with the present invention.
Figure 25:
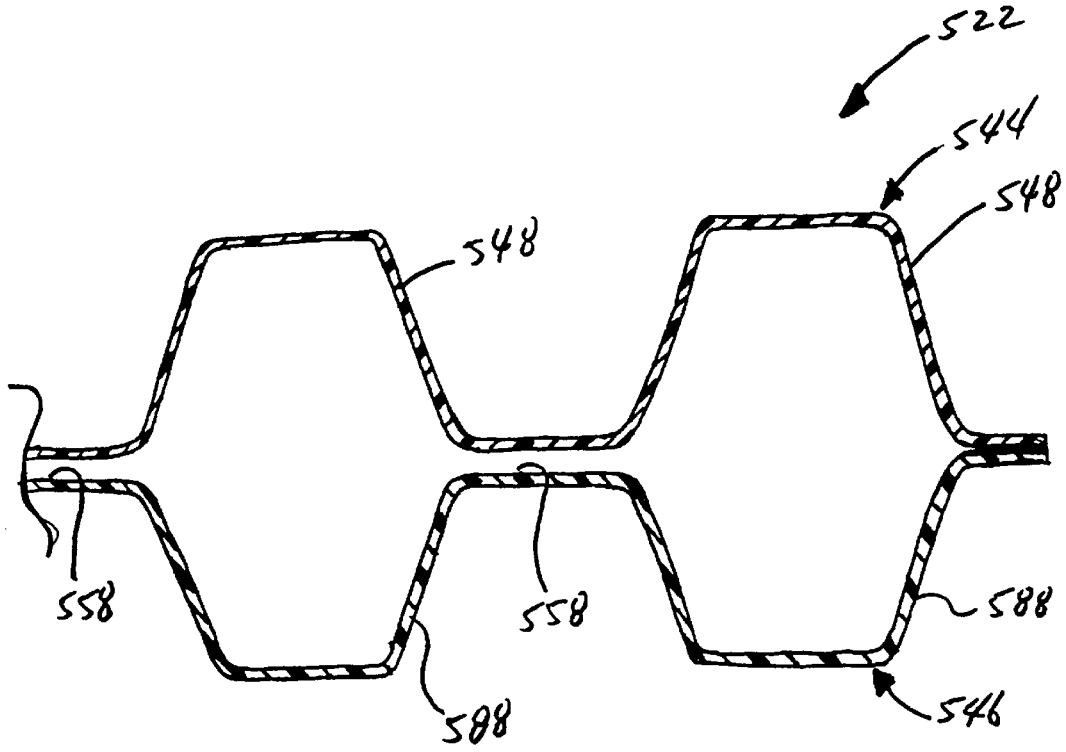
FIG. 25 is a cross-sectional view taken along line 25—25 of FIG. 24.

Referring to FIGS. 24 and 25, there are respectively shown a partial perspective view and a partial cross-sectional view of a fluid or air structure 522 formed by the present invention method. The fluid structure 522 comprises a plurality of spaced apart upper fluid nodes 548, a plurality of spaced apart lower fluid nodes 588 which respectively oppose the upper fluid nodes 548, and a plurality of fluid channels or ducts 558 which are respectively and integrally connected to the plurality of upper and lower fluid nodes 548 and 588 (only two upper and lower fluid nodes and fluid channels are shown). These fluid nodes 548 and 588 are generally frustum shape as shown.

Figure 26:
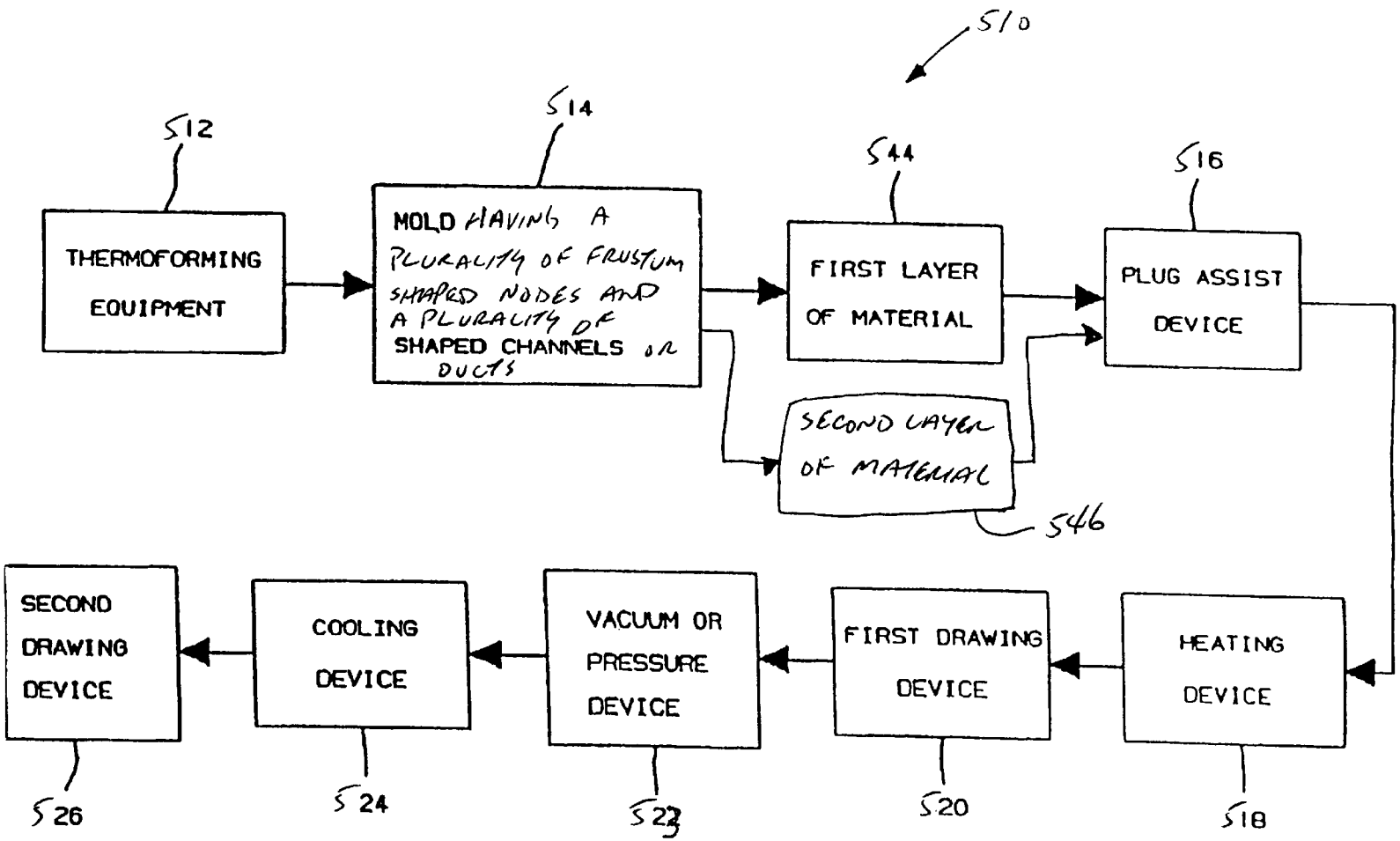
FIG. 26 is a block diagram illustrating the method which comprises the steps of forming an air structure in accordance with the present invention.

Referring to FIG. 26, there is shown a block diagram 510 of the present invention method showing the steps in which the fluid structure 522 (a general shape of the fluid structure is shown in FIG. 6) is formed from a generally flat flexible first layer of material 544 and a generally flat flexible second layer of material 546.

Referring to FIGS. 24, 25 and 26, the method 510 utilizes a thermoforming equipment 512 to form the fluid structure 522. There is provided a shaped mold 514 and is retained within the thermoforming equipment 512. The mold 514 may be a convek (male) shaped tool or a concave (female) shaped tool that enables its shape to be transferred to a heated sheet of material with or without a plug assist device or mechanical helper 516. The plug assist device 516 is used for pushing through the material to pre-shape the material. The plug assist device 516 is used because substantial material thickness can be lost due to thinning during the thermoforming process. The plug assist device 516 is used to promote uniformity of distribution by carrying extra material toward the area of the mold that would otherwise be thinned. The plug assist device 516 is commonly a shaped male device that pushes extra material down into the shaped mold 514.

The shaped mold 514 includes a plurality of spaced apart frustum shaped nodes and a plurality of shaped channels or ducts. Depending on the shaped mold 514, the plurality of spaced apart frustum shaped nodes and the plurality of shaped channels are protruding upwardly from the surface of the mold 514 or the plurality of spaced apart frstum shaped nodes and the plurality of shaped channels are protruding inwardly within the mold 514. The first layer of material 544 is positioned over the mold 514. A heating device 518 actively heats the first layer of material 544. A drawing device 520 draws the first layer of material 544 against the mold 514. A vacuum or pressure means 523 is positioned against the mold 514 to further draw the first layer 544 of material tightly into the mold 514, so that the first layer of material 544 forms into the plurality of fluid frustum shaped nodes 548 and fluid channels 558 of the mold 514. The formed first layer 544 is then cooled by a cooling device 524 and then removed from the thermoforming equipment 512, where the first layer 544 has the fluid frustum shaped nodes and channels.

The steps of forming the second layer of material 546 of the fluid structure 522 is exactly the same as forming the first layer of material 544 discussed above, and the description will not be repeated.

Alternatively, the fluid structure 522 may be formed by only one layer of material where the material may be cut in half. The two halves are then welded or sealed together to form the opposing upper and lower fluid nodes.

Figure 27:
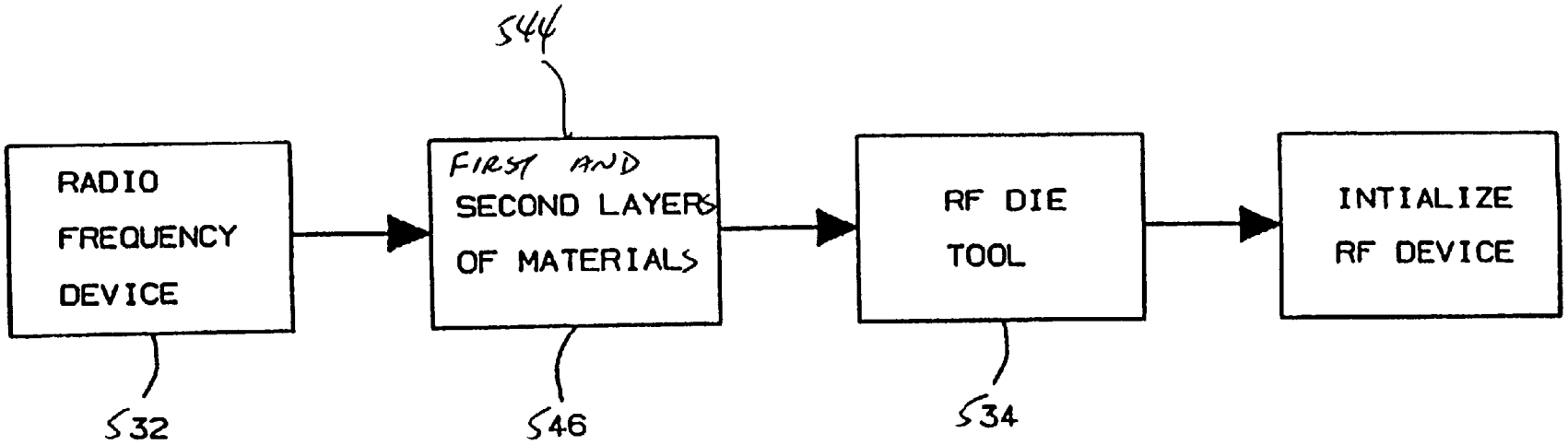
FIG. 27 is a block diagram illustrating the method which further comprises the steps of sealing an air structure in accordance with present invention.

Referring to FIG. 27, there is shown a block diagram of the present invention method showing the steps in which the first layer of material 544 and the second layer of material 546 are sealed or welded together to form the fluid tight structure 522. The method utilizes a radio frequency (RF) device 532 to seal or weld the first and second layers 544 and 546 together. The formed second layer of material 546 is positioned against the formed first layer of material 544 such that their frustum shaped air nodes oppose each other. Both are positioned on the RF device 532 to be sealed together. An RF die tool 534 is provided with the RF device 532. The die tool 534 is applied against the first layer of material 544 and the second layer of material 546 to achieve a uniform contact. The die tool 534 is a shaped brass, aluminum, or brass and aluminum that directs the RF energy operating at or approximately 27 MHz and between 1–100 Kilowatts in order to excite the molecules of the first layer of material 544 and the second layer of material 546 enabling a weld or seal between them. The RF device 532 is initialized, and thereby activates the die tool 534 to make a weld therebetween.

Figure 28:
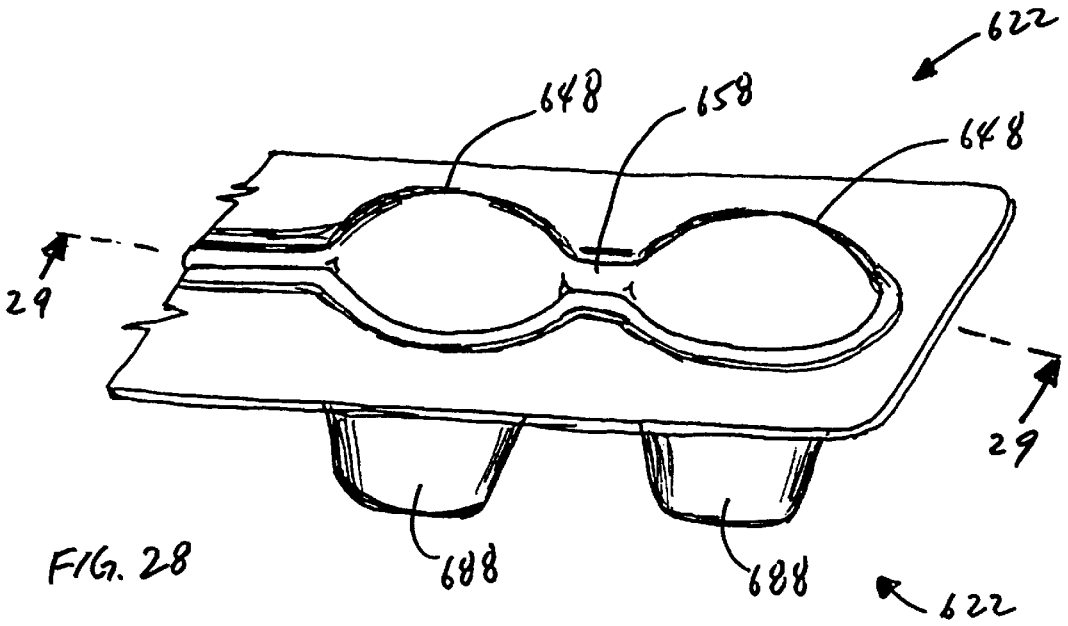
FIG. 28 is a partial perspective view of another further embodiment of an air structure formed in accordance with the present invention.
Figure 29:
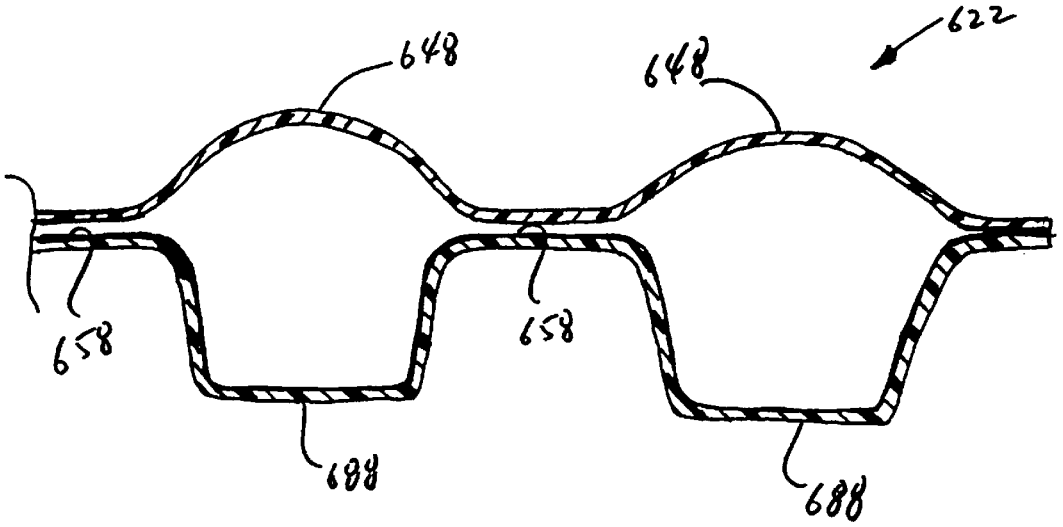
FIG. 29 is a cross-sectional view taken along line 29—29 of FIG. 28.

Referring to FIGS. 28 and 29, there are respectively shown a partial perspective view and a partial cross-sectional view of a further alternative embodiment a fluid or air structure 622 formed by the present invention method. This alternative embodiment of the present invention is very similar to the embodiment just discussed in FIGS. 24 and 25, and the only difference is the nature and configuration of the air nodes 648 and 688. All of the parts of this embodiment are numbered correspondingly with 600 added to each number.

The fluid structure 622 comprises a plurality of spaced apart upper fluid nodes 648, a plurality of spaced apart lower fluid nodes 688 which respectively oppose the upper fluid nodes 648, and a plurality of fluid channels or ducts 658 which are respectively and integrally connected to the plurality of upper and lower fluid nodes 648 and 688 (only two upper and lower fluid nodes and fluid channels are shown). In this embodiment, the upper fluid nodes 648 are generally arch shape while the lower air nodes 688 are generally frustum shape.

It will be appreciated that the fluid nodes is not limited to the shapes shown. It is emphasized that while the shapes shown is preferred, it is also within the spirit and scope of the present invention to form a multiplicity of different shaped fluid nodes not shown.

By way of example, the fluid support structures can be made of urethane material, vinyl material or any other suitable material. By way of example, the fluid support structures can be made from a blend or mixture of urethane and vinyl.

Figure 30:
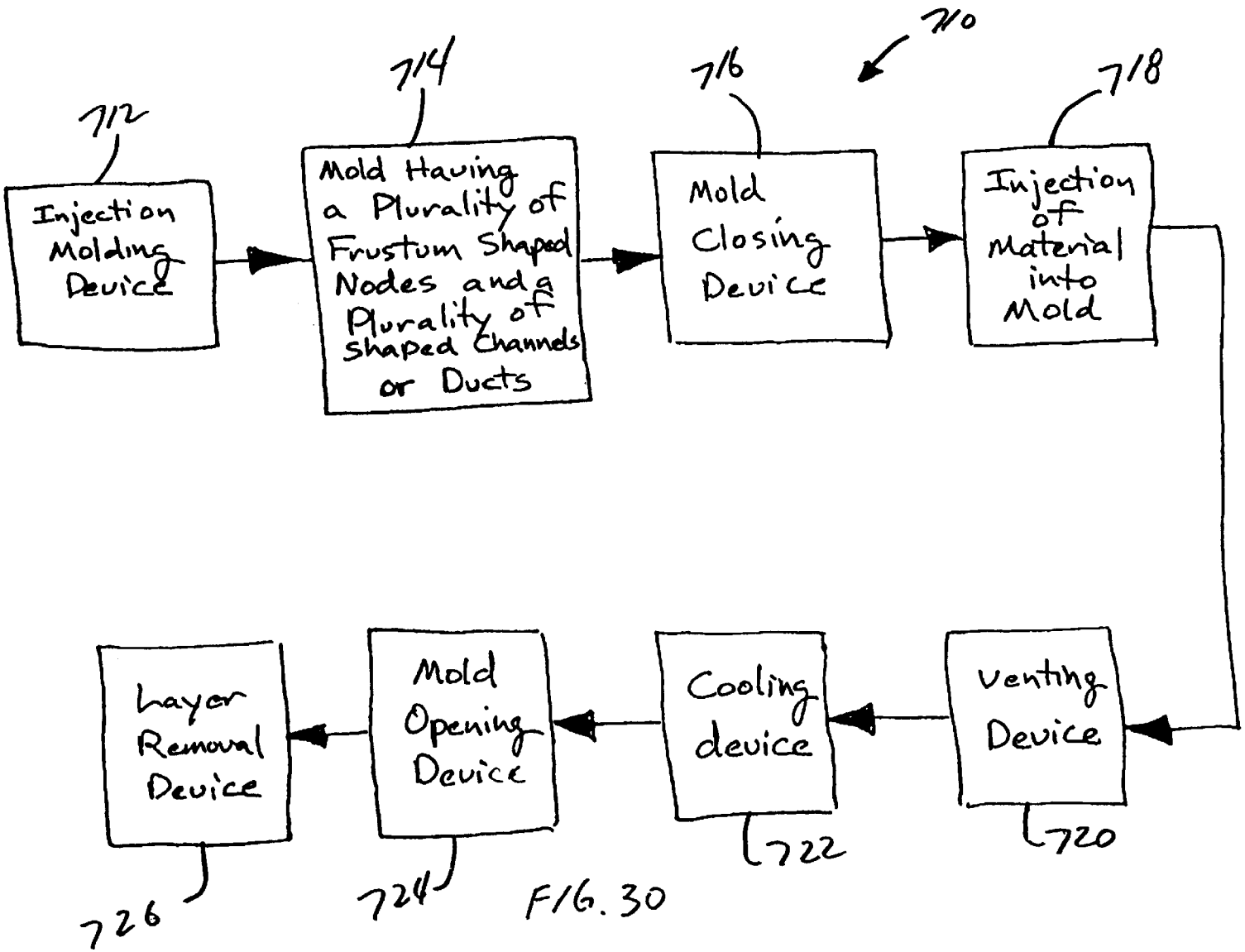
FIG. 30 is a block diagram illustrating an alternative method which comprises the steps of forming an air structure in accordance with the present invention.

Referring to FIG. 30, there is shown a block diagram 710 of an alternative method of the present invention showing the steps in which the fluid structure (a general shape of the fluid structure is shown in FIG. 6) is formed. The method 710 utilizes an injection molding device 712 to form the layers of the fluid structure. There is provided a shaped mold 714 and is retained within the injection molding device 712. The mold 714 may be a convex (male) shaped tool or a concave (female) shaped tool that enables its shape to be transferred to a heated sheet of material.

The shaped mold 714 includes a plurality of spaced apart frustum shaped nodes and a plurality of shaped channels or ducts. Depending on the shaped mold 714, the plurality of spaced apart frustum shaped nodes and the plurality of shaped channels are protruding upwardly from the surface of the mold 714 or the plurality of spaced apart frustum shaped nodes and the plurality of shaped channels are protruding inwardly within the mold 714. A mold closing device 716 is closed on top of the mold 714. To form the first layer of material, the molten material 718 is injected into the mold 714, so that the molten material 718 forms into the plurality of fluid frustum shaped nodes and fluid channels of the mold 714. A venting device 720 is used for venting the heat from the mold 714. A cooling device 722 is used for cooling the molten material formed from the mold. The mold is opened 724, where the layer of material is removed from the mold by a layer removal device 726.

The steps of forming the second layer of material of the fluid structure is exactly the same as forming the first layer of material just discussed above, and the description will not be repeated.

Alternatively, the fluid structure may be formed by only one layer of material where the material may be cut in half. The two halves are then welded or sealed together to form the opposing upper and lower fluid nodes. The present invention method further comprises the steps of welding or sealing the layers of materials together, and the steps are exactly the same as shown in FIG. 27, and the description will not be repeated.

By way of example, the fluid support structures can be made of urethane material, vinyl material or any other suitable material. By way of example, the fluid support structures can be made from a blend or mixture of urethane and vinyl.

Figure 31:
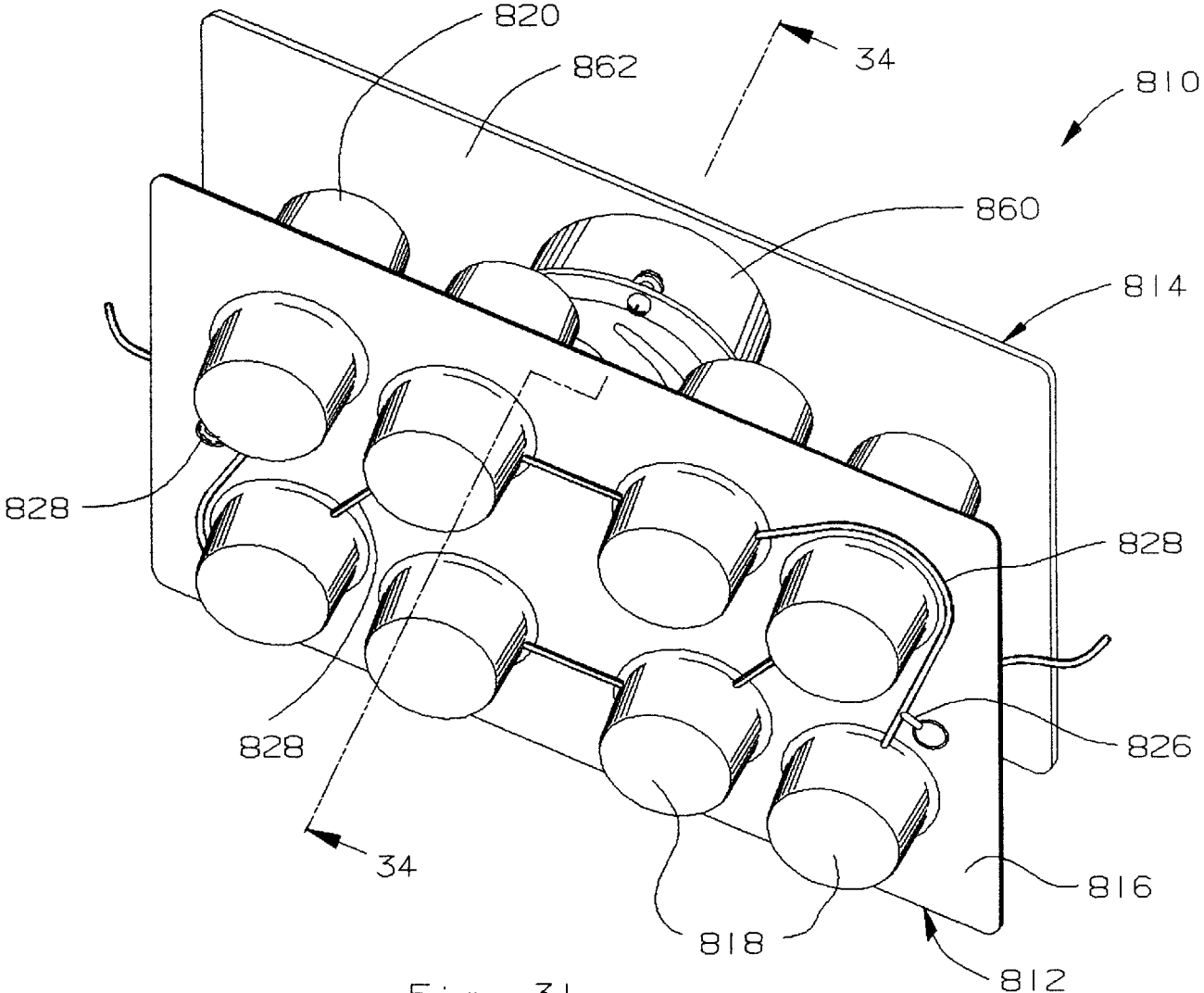
FIG. 31 is a perspective view of a preferred embodiment of a first arrangement of an air and sonic massaging apparatus in accordance with the present invention, showing eight upper and lower expandable and contractible air nodes.
Figure 34:
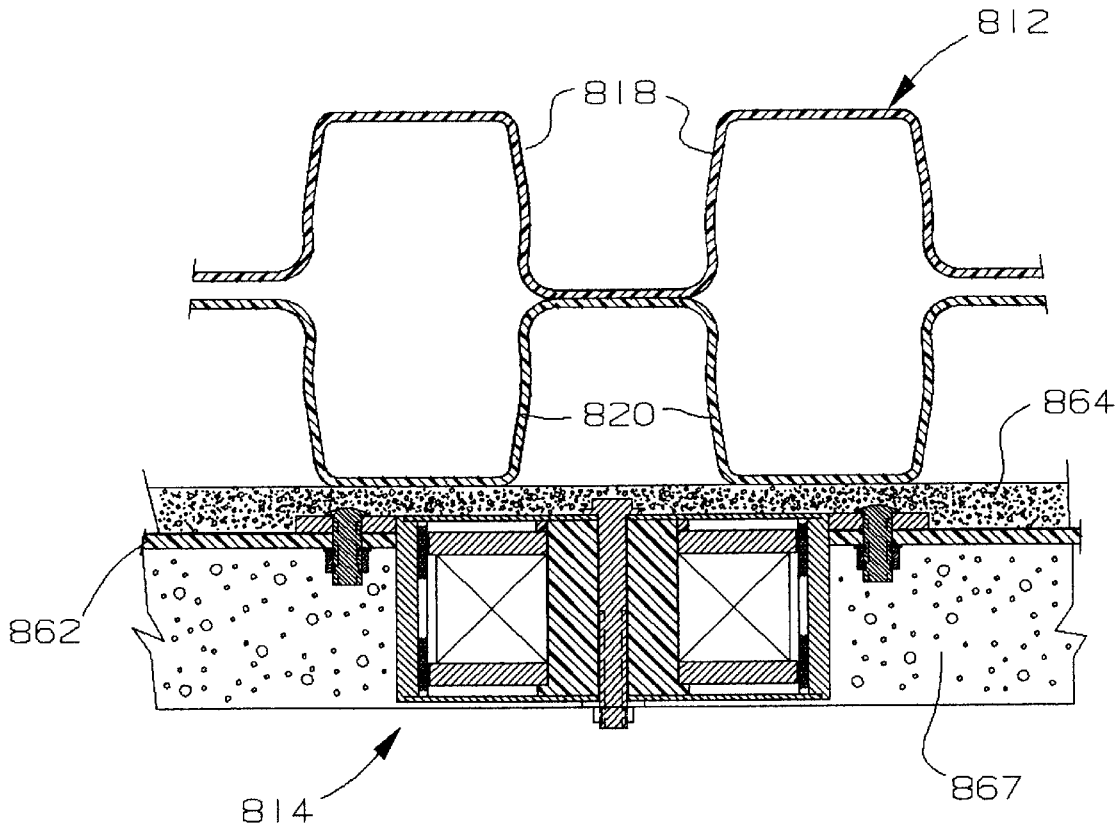
FIG. 34 is a cross-sectional view taken along line 34—34 of FIG. 31.
Figure 35:
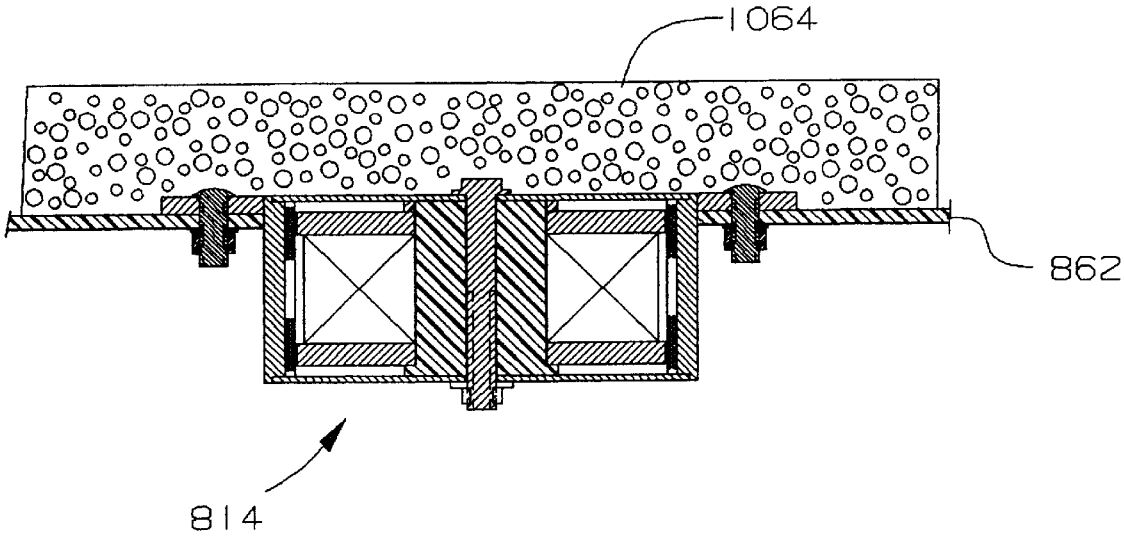
FIG. 35 is a cross-sectional view taken along line 35—35 of FIG. 33.
Figure 36:
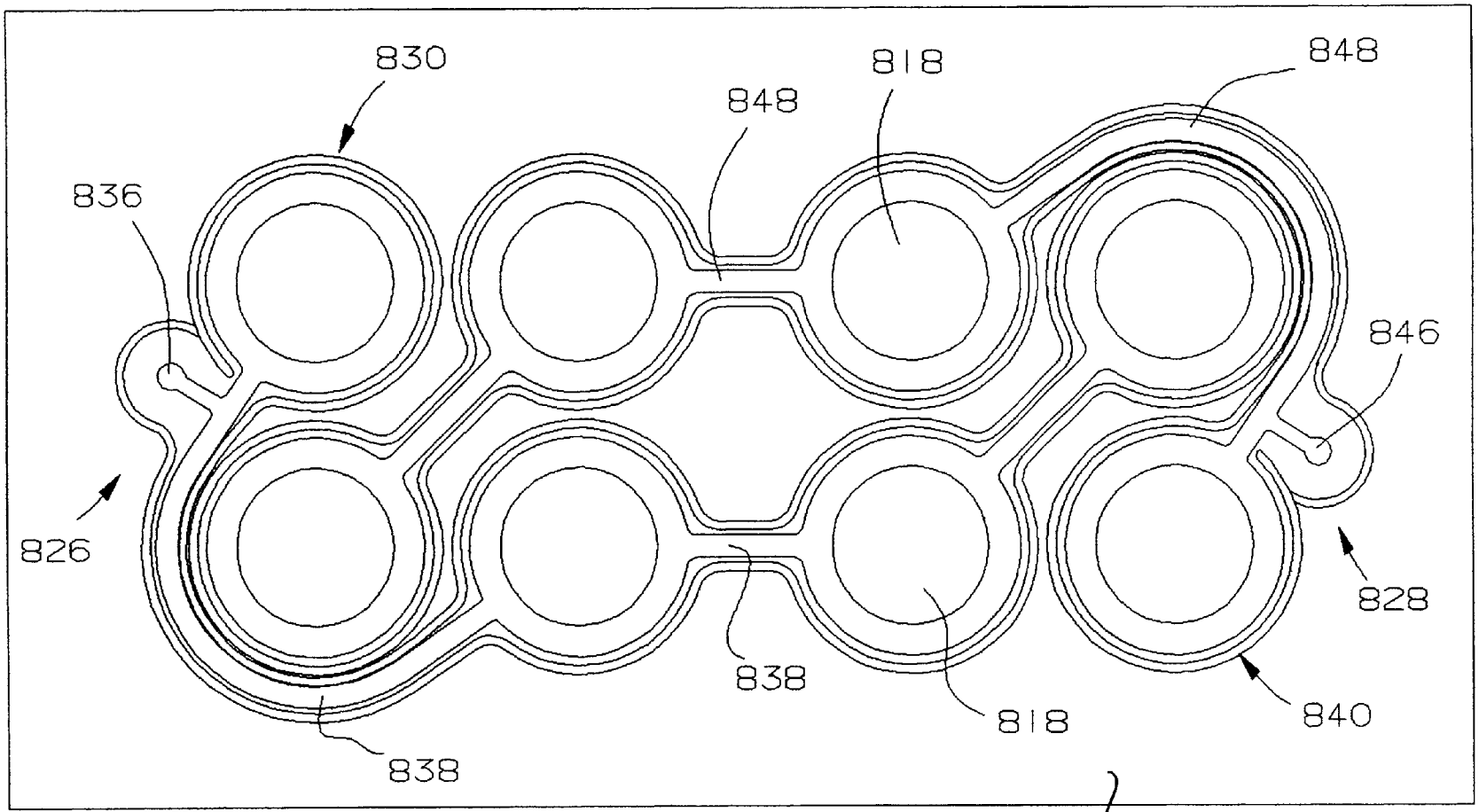
FIG. 36 is a top plan view of the air and sonic massaging apparatus in accordance with the present invention shown in FIG. 31.
Figure 47:
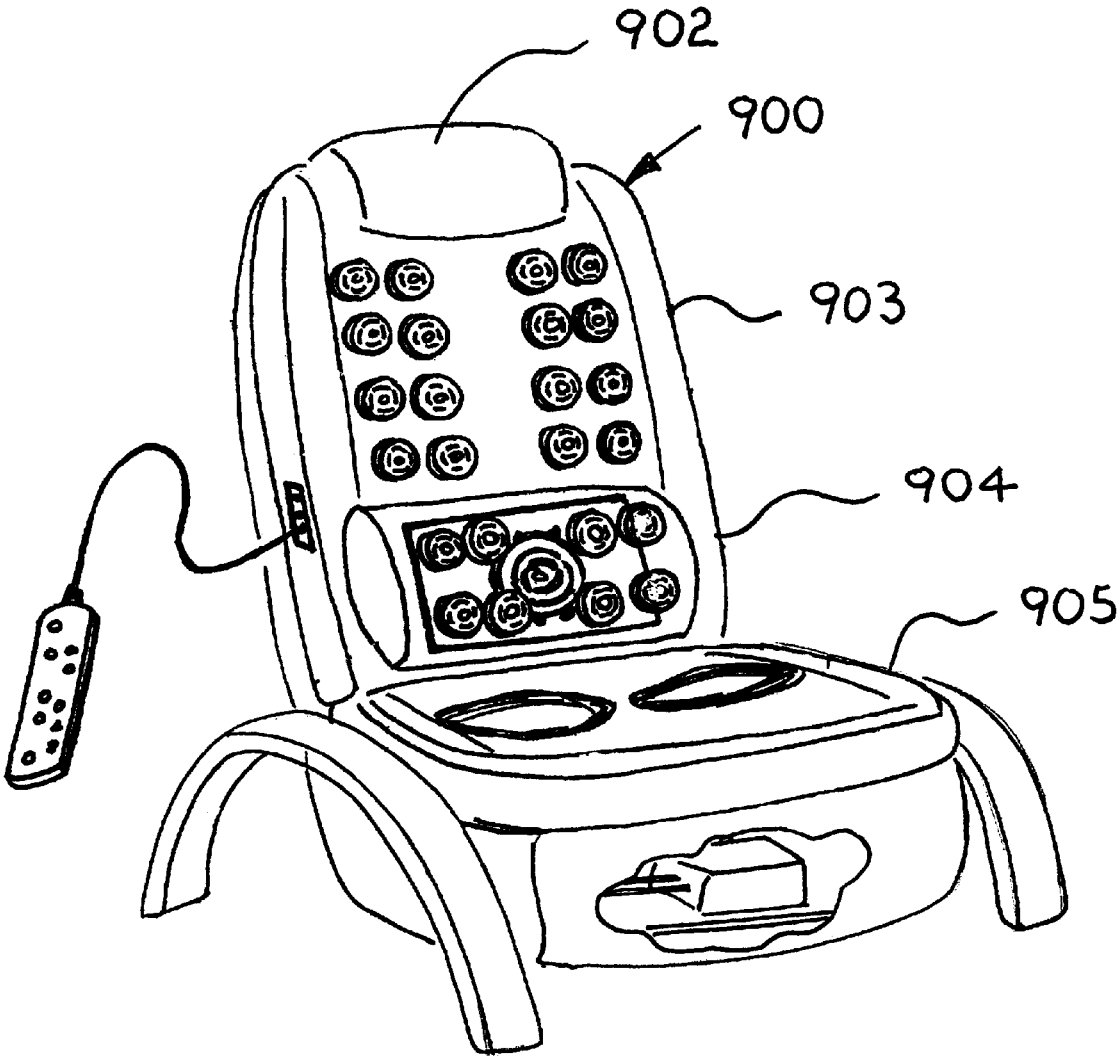
FIG. 47 is an illustration of a chair application having a head support section, a thoracic support section, a lumbar support section, and a buttock and thigh support section, where the first arrangement of the present invention air and sonic massaging apparatus is embedded within each support section of the chair apparatus.

Referring to FIGS. 31, 34 and 36, alternatively, there is shown a preferred embodiment of a first arrangement of the present invention air and sonic massaging apparatus 810 which can be embedded into a seat topper application 800 (see FIG. 44), a lounge chair application 900 (see FIG. 47) or other suitable applications. The air and sonic massaging apparatus 810 not only support a weight of an individual who sits or rests on the apparatus 810 with minimal surface tension but also provides a massaging effect on the body part of the individual positioned on the apparatus as well as provides an entertainment and relaxation device.

Figure 32:
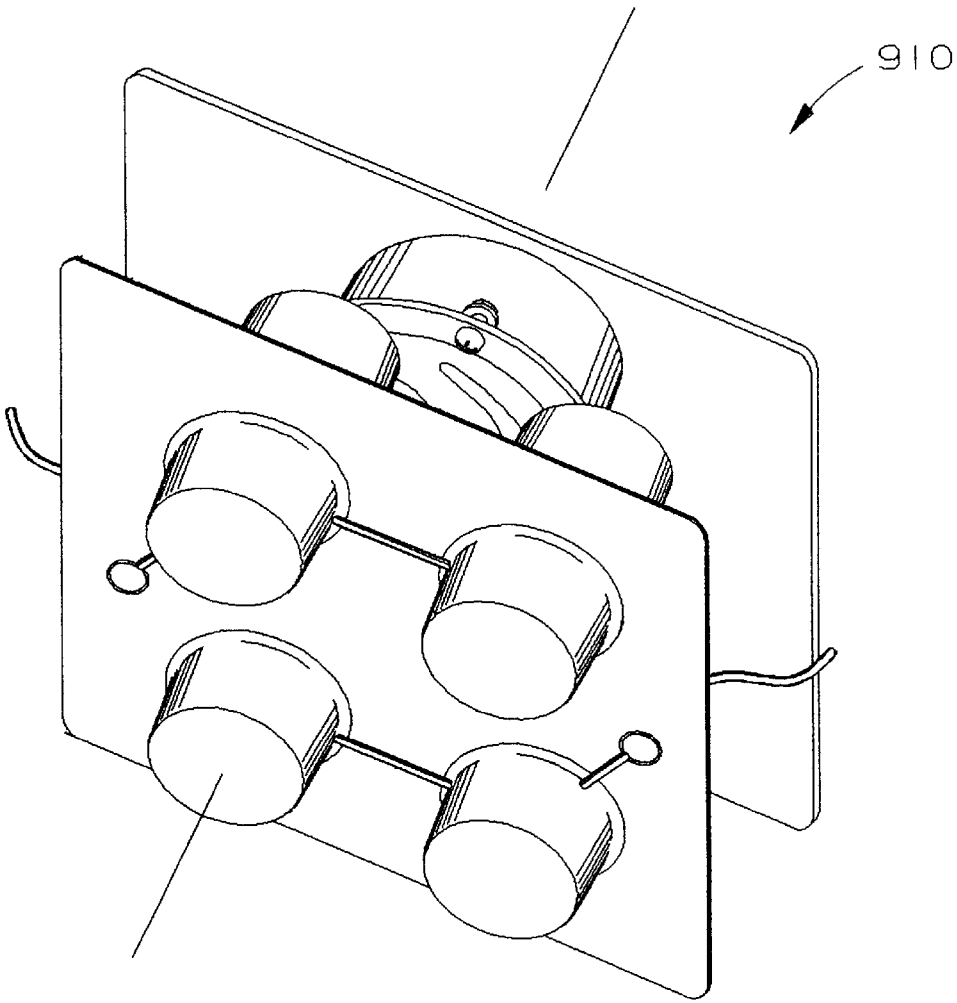
FIG. 32 is a perspective view of a second arrangement of the present invention air and sonic massaging apparatus shown in FIG. 31, showing at least four upper and lower expandable and contractible air nodes.
Figure 33:
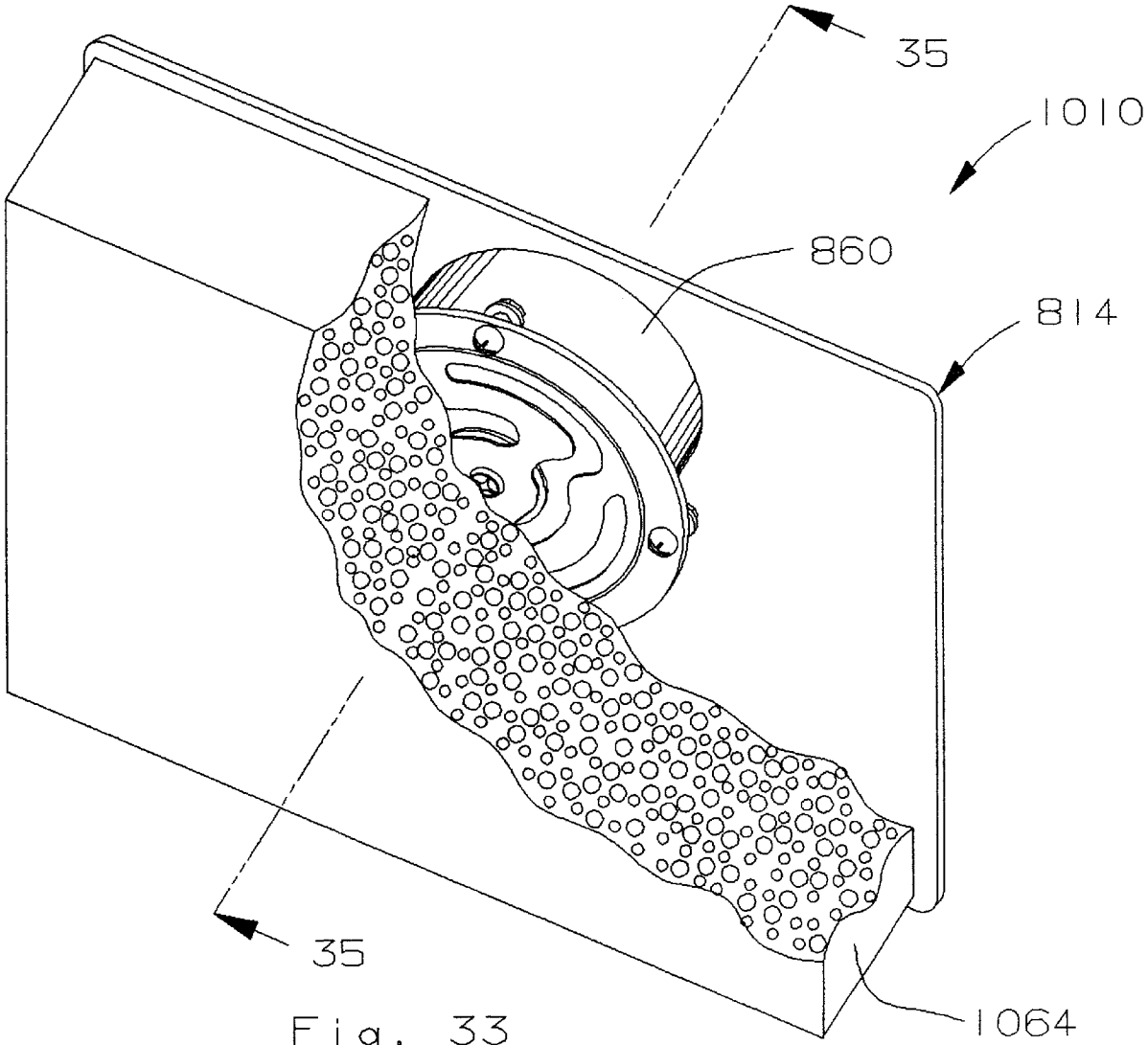
FIG. 33 is a partial cut-out perspective view of an alternative embodiment of present invention foam and sonic massaging apparatus.

It will be appreciated that the first arrangement of the present invention air and sonic massaging apparatus 810 is not limited to the eight upper and lower air nodes as illustrated in FIG. 31. It is emphasized that while the eight upper and lower air nodes are preferred, it is also within the spirit and scope of the present invention to utilize at least four upper and lower air nodes as illustrated in FIG. 32 or any number of upper and lower air nodes not shown.

For clarity purposes in these figures, cabling, tubing, and wiring are not illustrated, but are conventional in the art and would be easily accomplished by persons skilled in the art.

Figure 44:
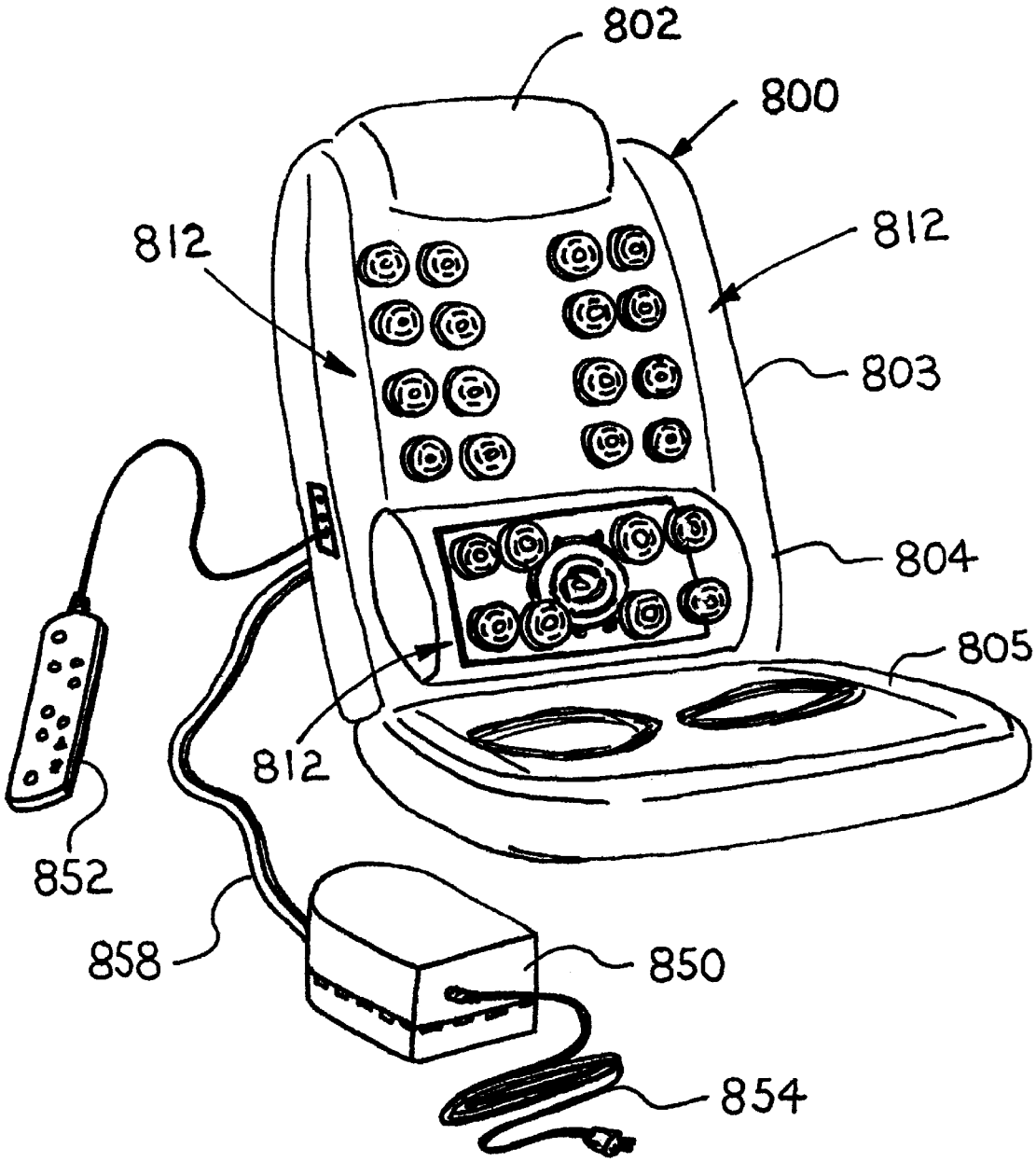
FIG. 44 is an illustration of a seat topper application having a head support section, a thoracic support section, a lumbar support section, and a buttock and thigh support section, where the first arrangement of the present invention air and sonic massaging apparatus is embedded within each support section of the seat topper application.

Referring to FIGS. 31, 34, 36 and 44, the air and sonic massaging apparatus 810 can be embedded into the seat topper application 800 which includes at least a head section 802, a thoracic section 803, a lumbar section 804, and a buttock and thigh section 805 (see FIG. 44). The air and sonic massaging apparatus 810 can also be embedded in the lounge chair application 900 which includes at least a head section 902, a thoracic section 903, a lumbar section 904, and a buttock and thigh section 905 (see FIG. 47). In both of these applications, each section may include the present invention air and sonic massaging apparatus 810 as shown into the seat topper 800. The seat topper application 800 is provided with a main pneumatic supply unit 850 and a handheld system controller unit 852. The pneumatic supply unit 850 is connected to the air and sonic massaging apparatuses 810 by an elongated pneumatic supply tube 858 for supplying compressed air thereto. The pneumatic supply unit 850 has a power cord 854 which can be plugged into an electrical wall outlet (not shown) to power the unit. The system controller unit 852 may be electrically connected to a solenoid manifold (not shown) which in turn is connected to a plurality of the air and sonic massaging apparatuses 810

Figure 45:
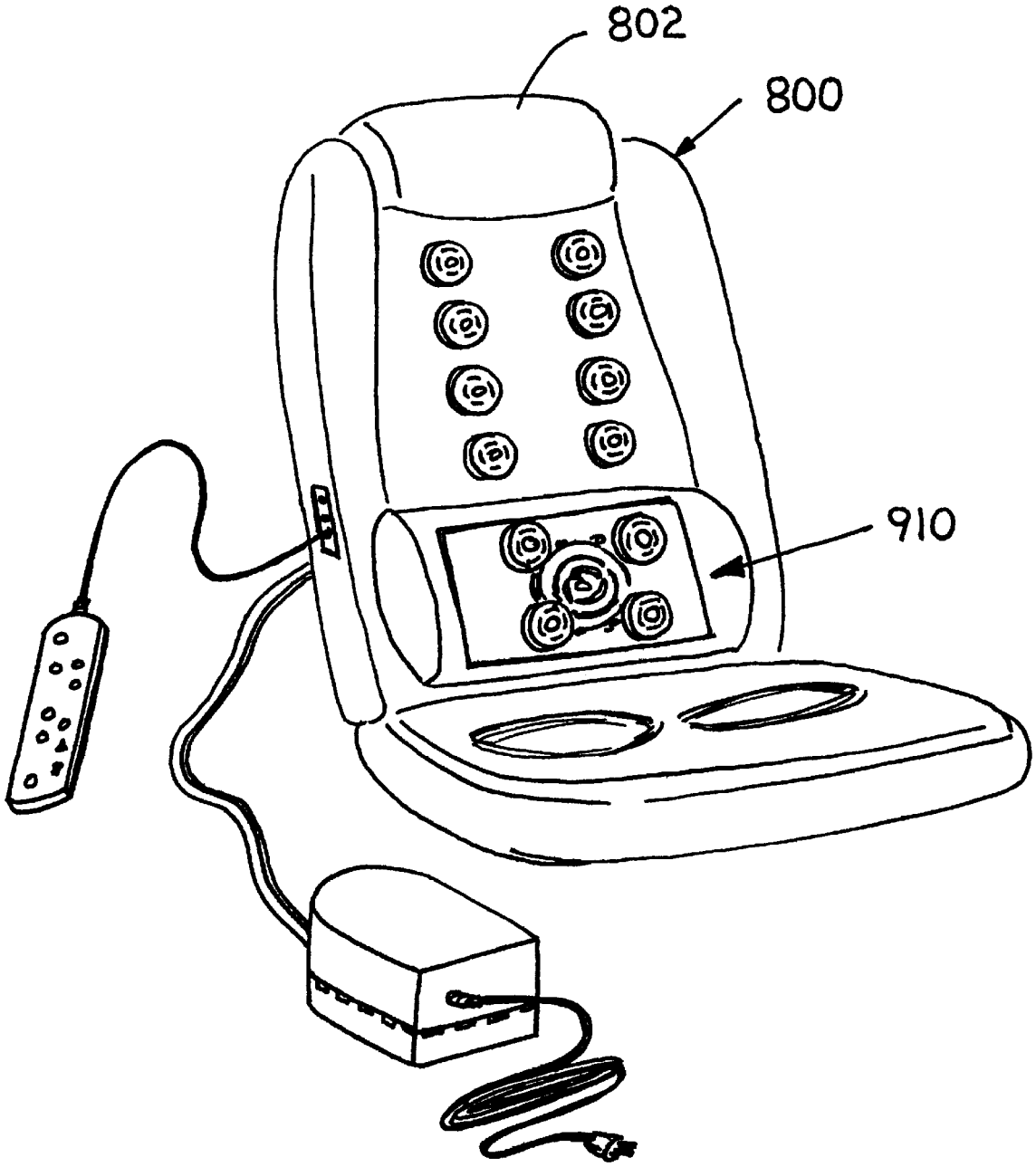
FIG. 45 is an illustration of a seat topper application having a head support section, a thoracic support section, a lumbar support section, and a buttock and thigh support section, where the second arrangement of the present invention air and sonic massaging apparatus is embedded within each support section of the seat topper application.
Figure 46:
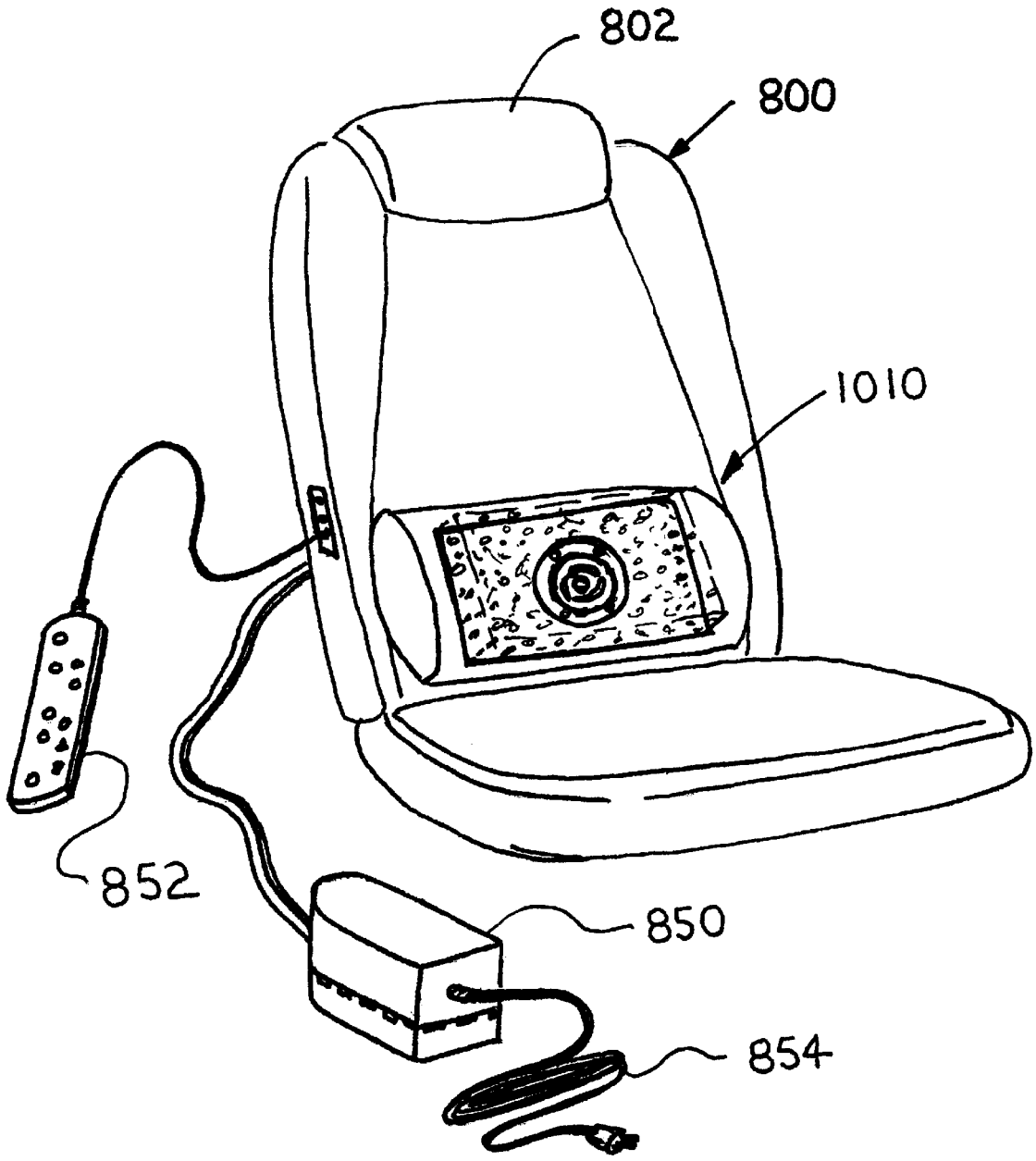
FIG. 46 is an illustration of a seat topper application having a head support section, a thoracic support section, a lumbar support section, and a buttock and thigh support section, where the alternative embodiment shown in FIG. 33 is embedded within the lumbar support section of the seat topper application.

(see FIG. 45). The system controller unit 852 controls the audio, sonic and air of the air and sonic massaging apparatus.

Since the parts of the seat topper application 800 are identical to the lounge chair application 900, the description of the lounge chair 900 will not be described, and identical parts are correspondingly numbered in a 900 series reference number rather than a 800 series reference number used in the seat topper application.

Referring to FIGS. 31, 34, 36, 38, 39 and 44, the air and sonic massaging apparatus 810O includes a flexible air or fluid support device or structure 812 and a sonic device 814. The air support device 812 is constructed from an airtight or fluid-tight structure to prevent air or fluid leakage. The air device 812 has a generally flat base portion 816, two rows of a plurality of spaced part hollow upper expandable and contractible air or fluid nodes 818 (only four air nodes are shown in each row) which extend upwardly from the base portion 816, and two rows of a plurality of spaced part hollow lower expandable and contractible air or fluid nodes 820 (only four air nodes are shown in each row) which extend downwardly from the base portion 816 and respectively oppose the plurality of upper air nodes 818. These upper and lower expandable and contractible air nodes 818 and 820 are formed in a matrix arrangement.

It will be appreciated that the air support device 812 is not limited to the two rows and four columns of the upper and lower air nodes 818 and 820 as shown. It is emphasized that while the two rows and four columns of the upper and lower air nodes are illustrated, it is also within the spirit and scope of the present invention to utilize a plurality of rows and columns of the upper and lower air nodes or at least four upper and lower air nodes as shown in FIG. 32. It will be also appreciated that the air support device 812 may be constructed with only upper air nodes or lower air nodes.

The plurality of upper air nodes 818 are substantially identical, and to the extent they are, only one will be described in detail below. Each upper air node 818 has an open proximal end 822, a closed distal end 824 and a uniform outer diameter. The open proximal end 822 is integrally formed with the base portion 816 such that the upper air nodes 818 are expandable and contractible when a downward pressure is applied or removed. The plurality of lower air nodes 820 are substantially identical, and to the extent they are, only one will be described in detail below. Each lower air node 820 has an open proximal end 832, a closed distal end 834 and a uniform outer diameter. The open proximal end 832 is integrally formed with the base portion 816 such that the lower air nodes 820 are expandable and contractible when a downward pressure is applied or removed.

Figure 38:
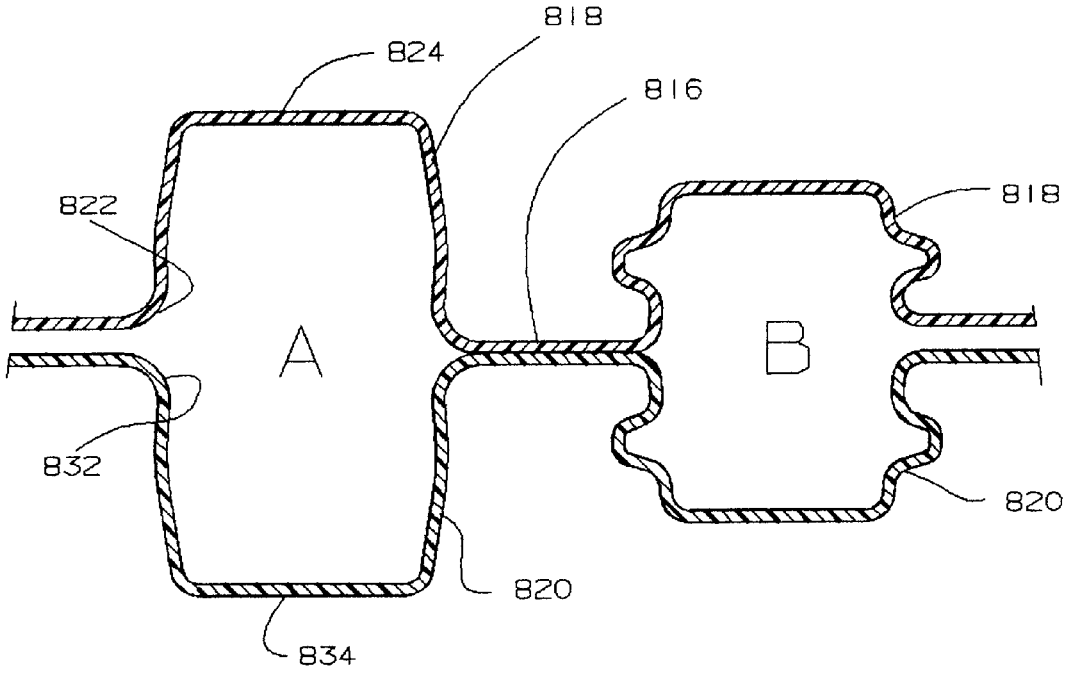
FIG. 38 is a partial illustration of a cross-sectional view of the air and sonic massaging apparatus in accordance with the present invention, showing the "B" circuit of the plurality of air nodes being compressed while the "A" circuit of the plurality of air nodes being pressurized.
Figure 39:
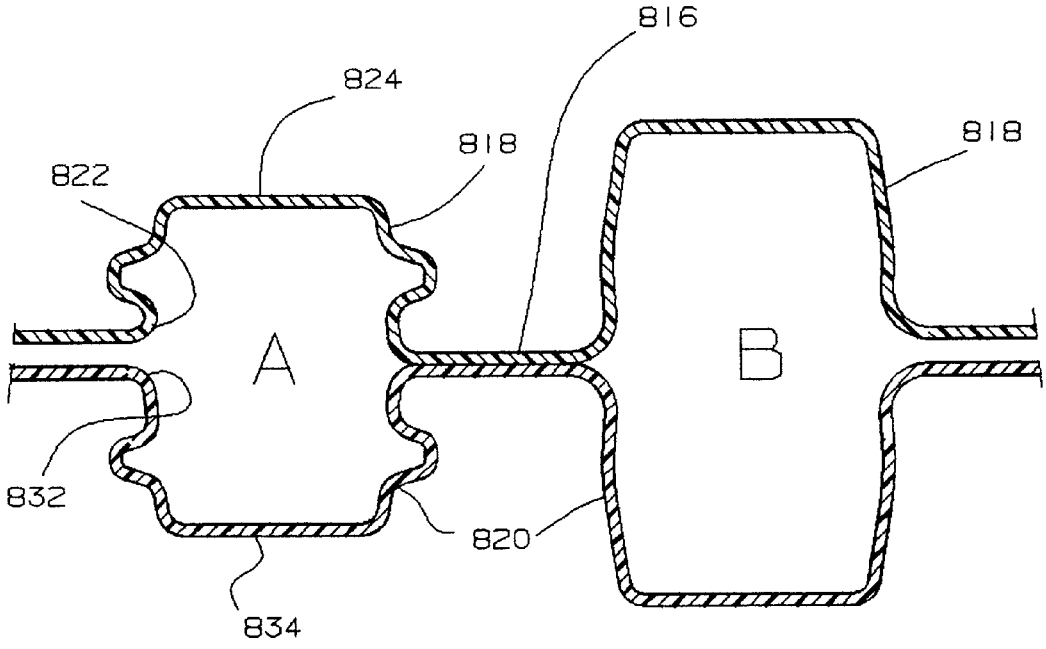
FIG. 39 is a partial illustration of a cross-sectional view of the air and sonic massaging apparatus in accordance with the present invention, showing the "B" circuit of the plurality of air nodes being pressurized while the "A" circuit of the plurality of air nodes being compressed.

Referring to FIGS. 36, 38 and 39, there is provided a first air or fluid flow circuit 826 and a second air or fluid flow circuit 828 for respectively pressurizing a first section or part 830 (see FIGS. 38 and 40, and shown as "A" circuit) and a second section or part 840 (see FIG. 38 and 40, and shown as "B" circuit) of the air device 812. The first part 830 of the air device 812 may include two outer air nodes of the first row and two inner adjacent air nodes of the second row. The first air flow circuit 826 has an inlet port 836 for allowing compressed air to enter into the air device 812 and a plurality of connecting first air or fluid channels or tubes 838. The inlet port 836 is connected to the pneumatic supply unit 850 (see FIG. 44) for supplying compressed air to the first part 830 (shown as "A") of the air device 812. The first air channels 838 are substantially identical, and to the extent they are, only one will be described in detail. Each first air channel 838 is interconnected to at least two adjacent upper air nodes 818 for transferring air flow therebetween, wherein the air channels 838 are integrally formed on the base portion 816.

The second part 840 of the air device 812 may include two inner adjacent air nodes of the first row and two outer air nodes of the second row. The second air flow circuit 828 also has an inlet port 846 for allowing compressed air to enter into the air device 812 and a plurality of connecting second air or fluid channels or tubes 848. The inlet port 846 is also connected to the pneumatic supply unit 850 for supplying compressed air to the second part 840 (shown as "B") of the air device 812. The second air channels 848 are substantially identical, and to the extent they are, only one will be described in detail. Each second air channel 848 is interconnected to at least two adjacent upper air nodes 818 for transferring air flow therebetween, wherein the second air channels 848 are integrally formed on the base portion 816.

The air device 812 may be further customized to suit individuals by utilizing a plurality of zone distributions, wherein each zone distribution can be pressurized at different time intervals. The inlet ports 836 and 846 are connected to the solenoid manifold 856 which operates in a known manner to control the flow of compressed air into or out of the plurality of upper and lower air nodes 818 and 820. In operation, the pneumatic supply unit 850 can supply compressed air at different time intervals to the first air flow circuit 826 and the second air flow circuit 828 or it can supply compressed air to both at the same time. The connecting channels 838 and 848 are then supplying the compressed air to all of the other upper and lower air nodes. The hollow upper and lower air nodes 818 and 820 are inflated to a desired stiffness. When the air device 812 has been filled with the desired amount of compressed air, the inlet ports 836 and 848 are closed off by a suitable cap (not shown) or other suitable means.

Figure 40:
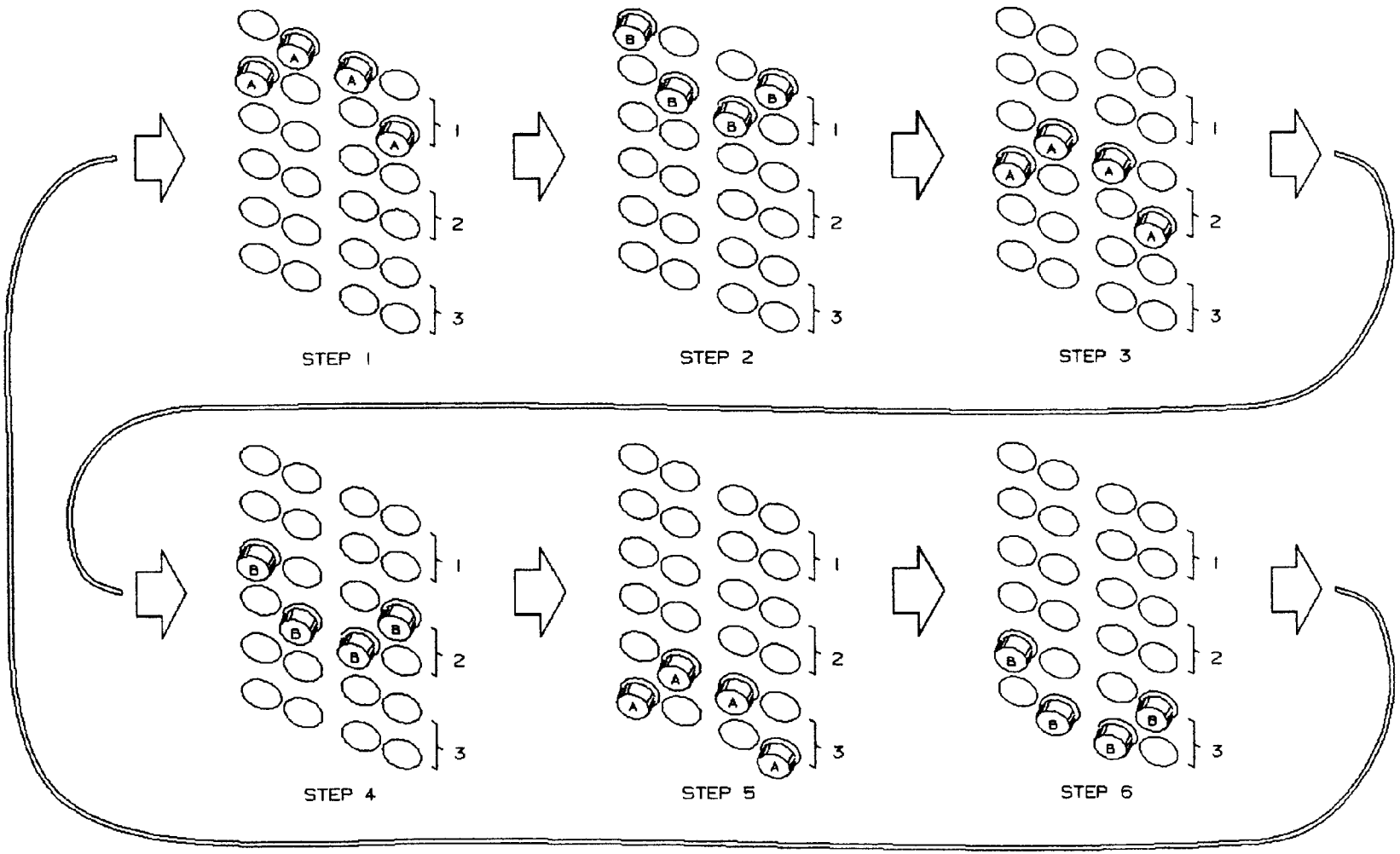
FIG. 40 is a simplified circuit diagram in accordance with the present invention, showing a plurality of patterns in which the plurality of air nodes are inflated and deflated.
Figure 41:
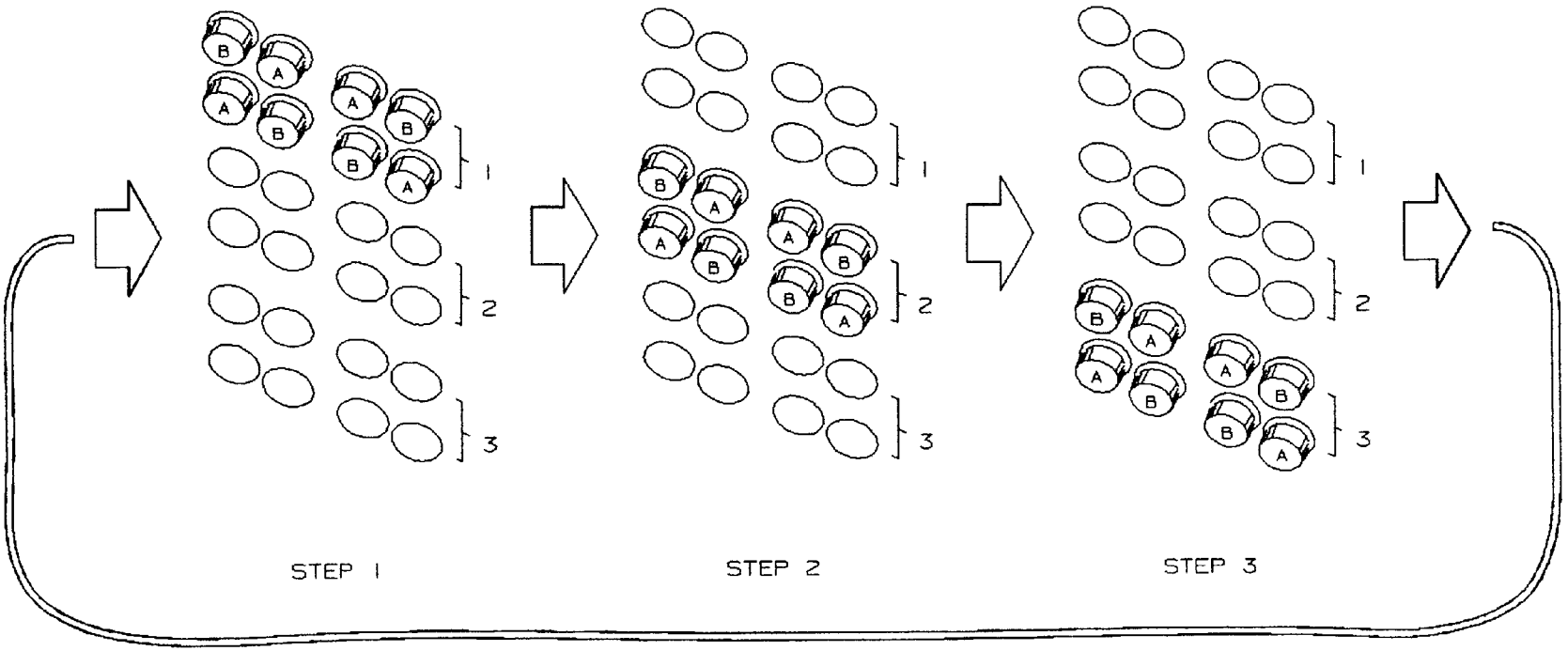
FIG. 41 is a simplified circuit diagram in accordance with the present invention, showing a plurality of patterns in which the plurality of air nodes are inflated and deflated.
Figure 42:
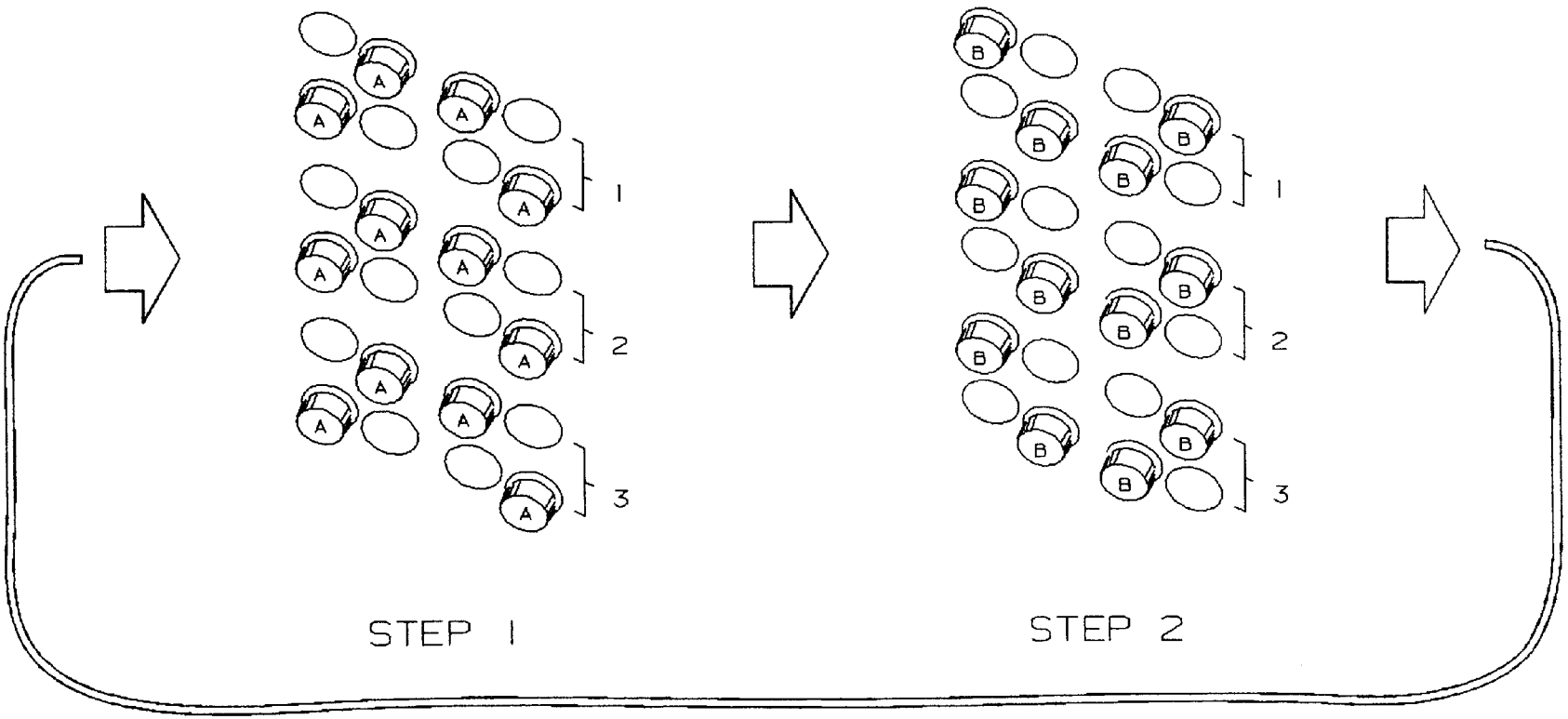
FIG. 42 is a simplified circuit diagram in accordance with the present invention, showing a plurality of patterns in which the plurality of air nodes are inflated and deflated.

Referring to FIGS. 40, 41 and 42, there are shown a plurality of different configurations of the air device 812, where "A" circuit and "B" circuit of the air device 812 can be pressurized at different time intervals or at the same time as shown. Referring to FIG. 40, in step 1, only the "A" circuit is pressurized for the first air device. In step 2, only the "B" circuit is pressurized for the first air device. In step 3, only the "A" circuit is pressurized for the second air device. In step 4, only the "B" circuit is pressurized for the second air device. In step 5, only the "A" circuit is pressurized for the third air device. In step 6, only the "B" circuit is pressurized for the third air device. This configuration is conformed with FIG. 44 of the seat topper application. Referring to FIG. 41, in step 1, the "A" and "B" circuits are pressurized at the same time for the first air device. In step 2, the "A" and "B" circuits are pressurized for the second air device. In step 3, the "A" and "B" circuits are pressurized for the third air device. This configuration is conformed with FIG. 44 of the seat topper application. Referring to FIG. 42, in step 1, the "A" circuits are simultaneously pressurized for each air device. In step 2, the "B" circuits are simultaneously pressurized for each air device. This configuration is conformed with FIG. 44 of the seat topper application.

Referring to FIGS. 36 and 38, when an individual is positioned on the air device 812, the first part 830 of the air device 812 is expanded while the second part 840 is contracted at the same time interval. Referring to FIGS. 36 and 39, when the individual is positioned on the air device 812, the first part 830 of the air device 812 is contracted while the second part 840 is expanded at the same time interval.

Comfort is created by the ability of the air device 812 to adjust to the relative pressure over a range to suit the various shapes and masses of resting bodies.

The air and sonic massaging apparatus 810 has the system controller unit 852 which has the capability of pressurizing and hold, and depressurizing and hold the plurality of upper and lower air nodes at different time intervals to create an improved massaging effect for massaging the body part of the individual positioned on the apparatus 810 as well as providing an entertainment and relaxation device. The system controller unit 852 can be used for selectively operating the pneumatic supply unit 850 at different time intervals.

Figure 43:
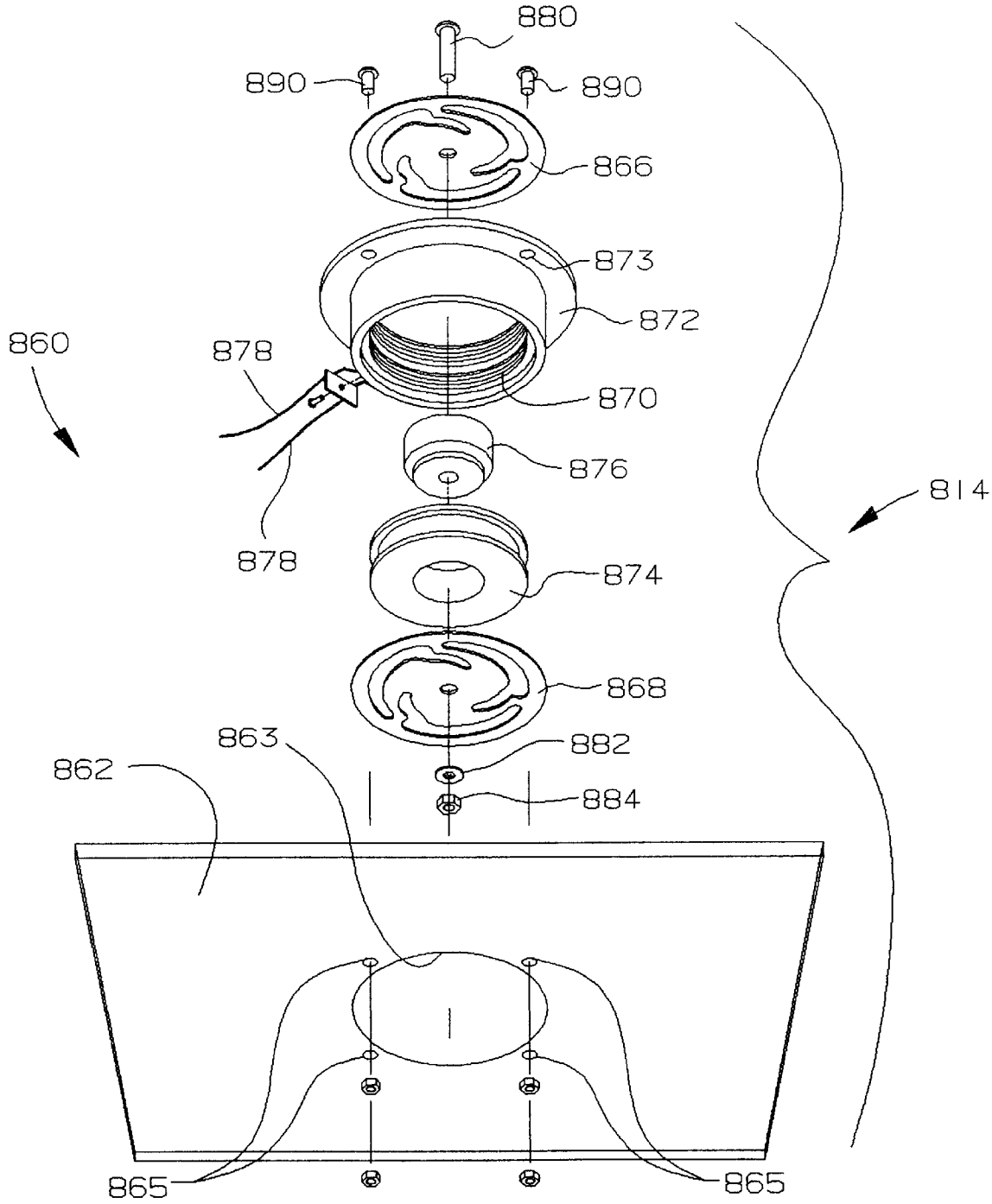
FIG. 43 is an exploded perspective view of the sonic device in accordance with the present invention.

Referring to FIGS. 31, 34 and 43, there is shown the sonic device 814 which includes a sonic transducer 860 and a generally semi-rigid flat transmission plate 862 which disperses wave front over large area from the localize transducer 860. The flat transmission plate 862 has a central circular opening 863 and a plurality of spaced apart mounting apertures 865 surrounding the central opening 863. The flat transmission plate 862 is sized to support and positioned underneath the air device 812 such that the plurality of lower expandable and contractible air nodes 820 abut against the upper surface of the plate 862. There is further provided foam material 864 between the distal ends 834 of the lower air nodes 820 and the transmission plate 862 for providing a cushion therebetween. There is also provided foam material 867 underneath the transmission plate 862 and surrounds a dual wound magnetic coil 870.

The sonic transducer 864 includes generally circular shaped upper and lower suspensions 866 and 868, a dual wound magnetic coil 870, a ferrous mounting coil body 872 which surrounds the magnetic coil 870, a large mass permanent magnet 874, and upper and lower nonmetallic spacers 876 (only one is shown). The upper and lower suspensions 866 and 868 sandwich the large mass permanent magnet 874 and the upper and lower nonmetallic spacers 876 therebetween. A mechanical fastener assembly which includes a threaded bolt 880, a washer 882 and a nut 884, retain the upper suspension 866, the lower suspension 868, the nonmetallic spacers 876, and the permanent magnet 874 in place. The large mass permanent magnet 874 is supported by iron guide rings. The ferrous mounting coil body 872 is mounted to the flat transmission plate 862 by inserting the dual wound coil 870 through the central opening 863 such that mounting apertures 873 are aligned with the mounting apertures 865 on the transmission plate 862. Mounting screws 890 are then inserted through the mounting apertures 873 and 865 to secure the ferrous mounting coil body 872 thereto. The dual wound magnetic coil 870 has electrical wires 878 for connecting to an amplifier embedded into the pneumatic supply unit 850.

Figure 43A:
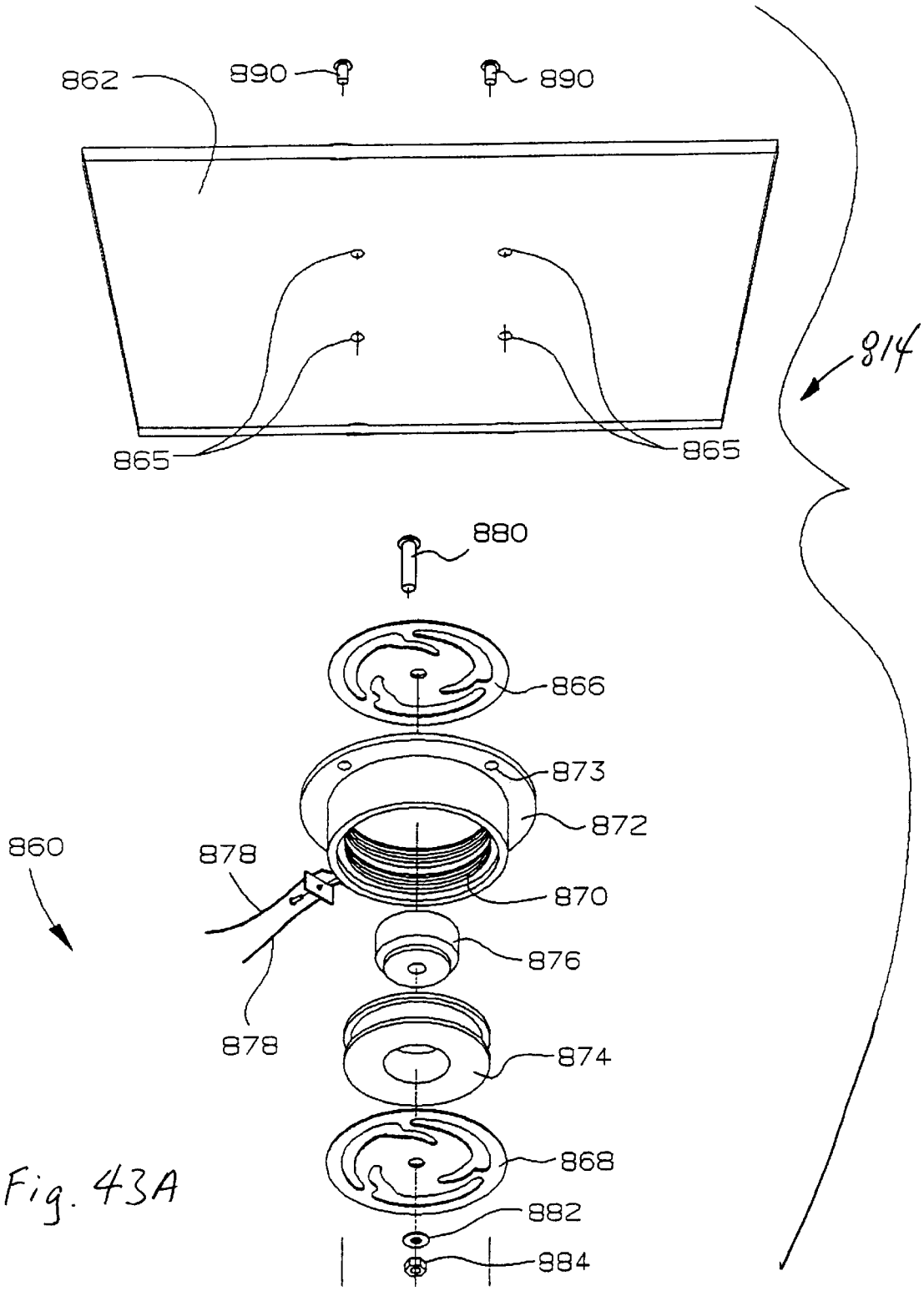
FIG. 43A is an exploded perspective view of an alternative arrangement of the sonic device shown in FIG. 43.

It will be appreciated that the transmission plate 862 may be manufactured with or without the central opening 863 (see FIG. 43A). It is emphasized that while the opening in the transmission plate 862 is preferred, it is also within the spirit and scope of the present invention to have a depressed section on the transmission plate 862 so that the magnet 874 can move up and down therein. In addition, a spacer, standoffs or other suitable spacing devices can be used with the transmission plate 862 for providing a space thereto for the magnet 874 to move therein.

The sonic device 814 is positioned underneath the air device 812 for providing an improved massaging effect with opposing lower air nodes beneath the upper air nodes in order to provide the user with greater displacement when the patterned inflation and deflation of the device occurs. Additionally, by keeping the base portion 816 of the air device 812 centrally located, the node displacement is away from the center on both sides of the layers and is structurally sounder. This construction of the air and sonic massaging device inhibits turning forces and sideway motions, and keeps the motion more linear and at a higher consistent force.

The air and sonic massaging apparatus 810 can be utilized with its electronic preprogrammed pattern programs or pattern programs down loaded via the Internet or by user selected variation and/or biological sensor factors.

Figure 50:
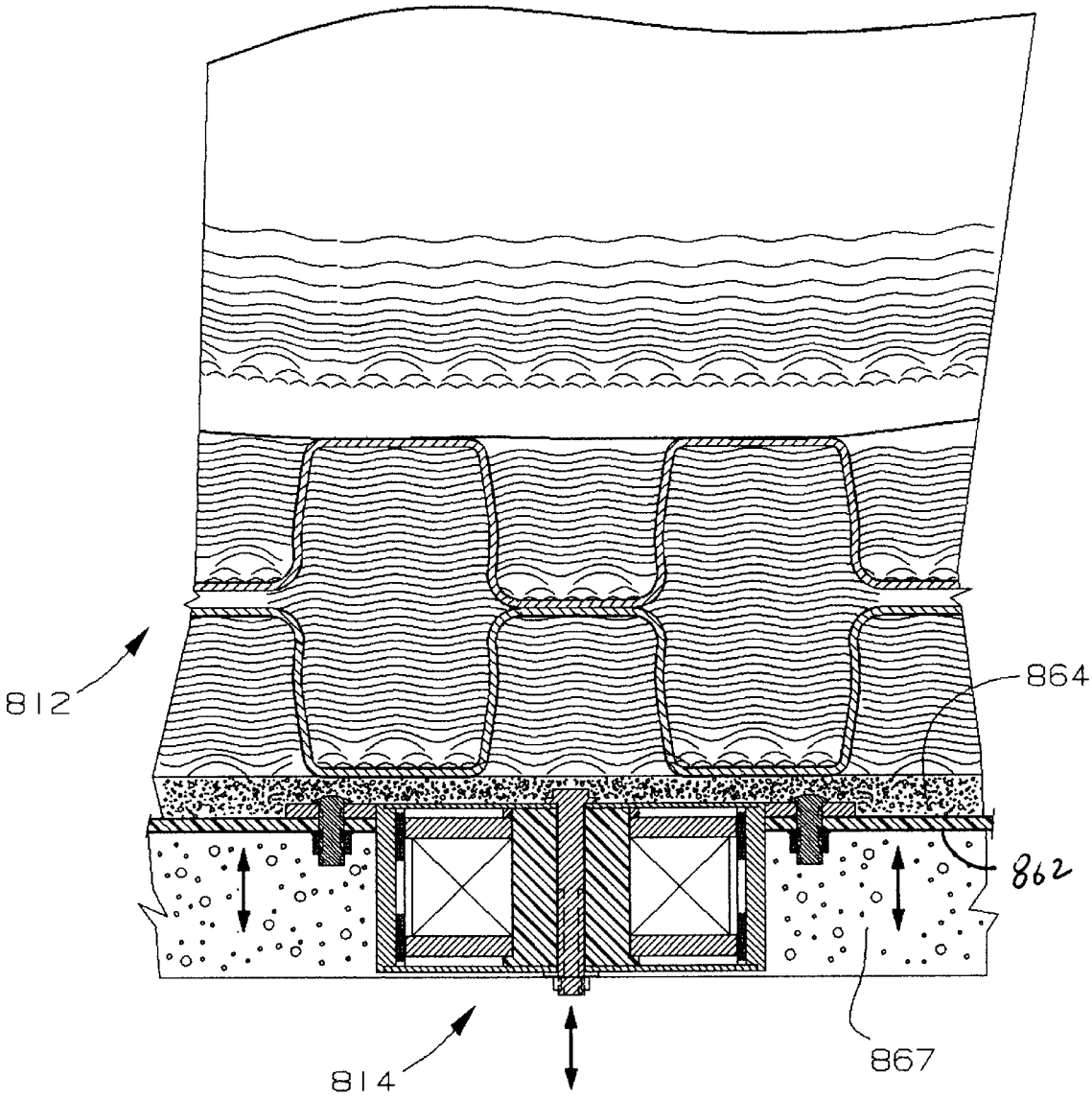
FIG. 50 is a cross-sectional view of the preferred embodiment of the air and sonic massaging apparatus in accordance with the present invention shown in FIGS. 31 and 32, illustrating the movement of the first and second arrangements of the air and sonic massaging apparatus.
Figure 51:
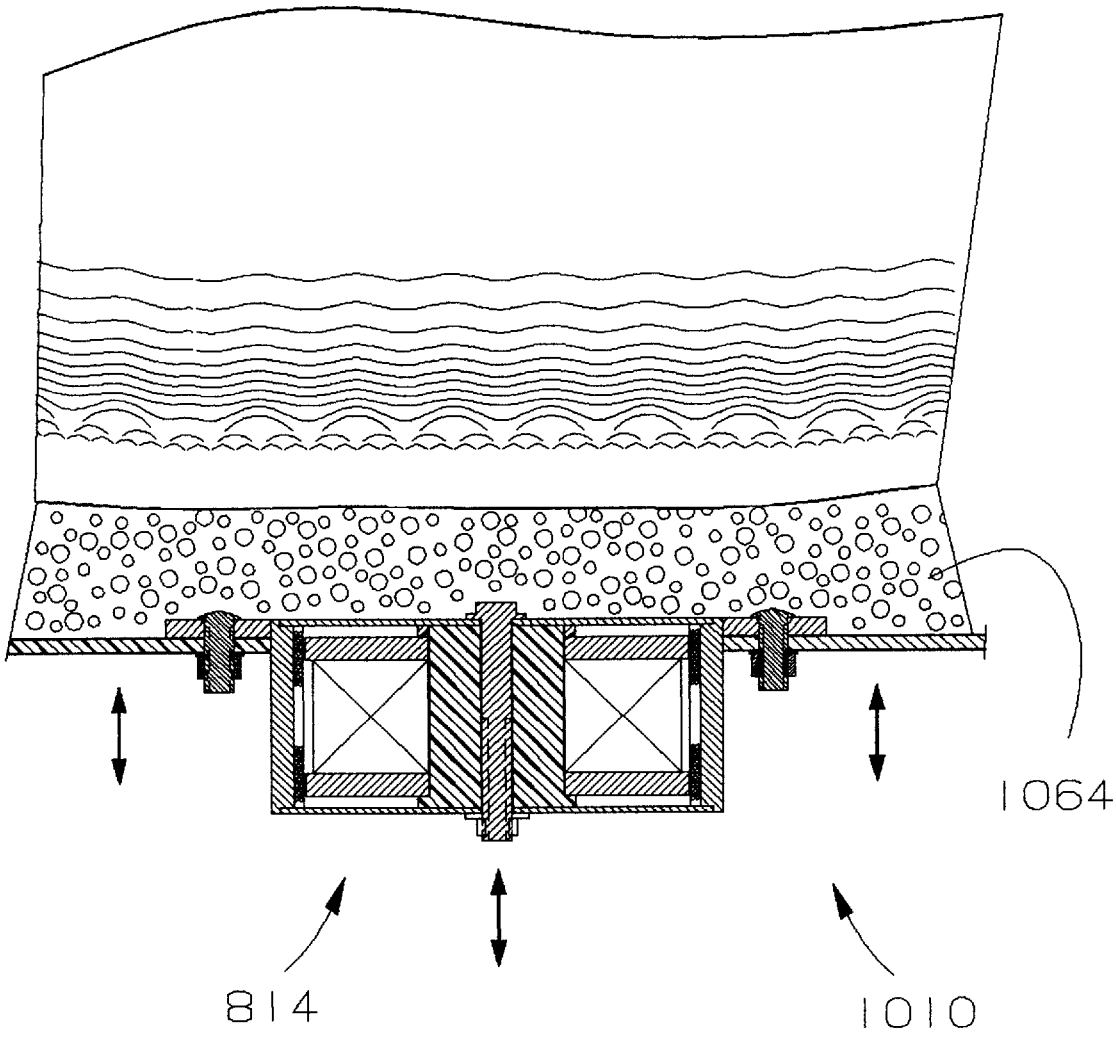
FIG. 51 is a cross-sectional view of the alternative embodiment of the present invention shown in FIG. 33, illustrating the movement of the foam and sonic massaging apparatus.

The sonic device 814 creates acoustic waves generated by the rigid transmission plate 862 through movement by the translation of significant solid mass. This construction will provide high magnitudes of acoustic energy to the directly coupled air support device 812 or directly coupled to the user's air cavity (see FIG. 50). It also ignores the normal standard in sound generation to provide large and significant air modulations by cone or panel displacement wherein the coil is the moving member. The sonic device 814 is improved by centrally locating the improved sonic transducer 860 within the central opening 863 of the flat rigid transmission plate 862. This construction enhances deflection of the rigid plate 862 by eliminating the central portion and providing easer movement of the rigid transmission plate 862. The sonic device 814 can be further enhanced by winding the coil twice in separate directions in order to create both significant flex and reduced heat generation due to reduction of resistance. The sonic device 814 with the foam material 867 strategically positioned behind the rigid wave generating plate 862 and the thin layer of foam material 864 so that it will enhance the user comfort without significantly diminishing the sonic effect. It should also be noted due to the positioning of the sonic device 814 in relation to the user and also that of the air device 812 when used in combination, that Huygens' principle regarding plane waves applies and is enhanced. Wave fronts are recreated by the leading edge of wavelets creating the next successive wave front in a constant perpendicular direction from the transducer generator as it transverse into the user. The benefits of this are substantially less wave energy cancellation, stronger intensity, and enhanced user interest in that the internal vibration is less distorted and more distinctly complex.

Figure 37:
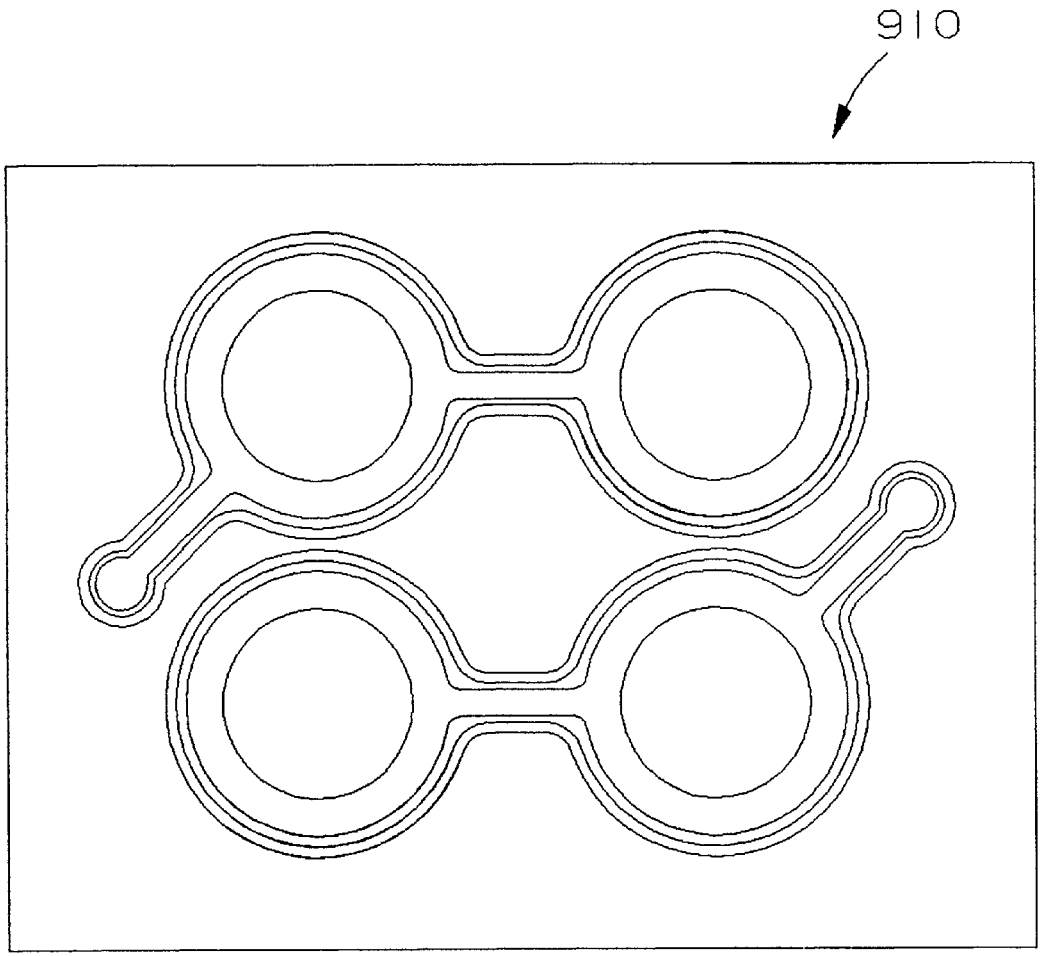
FIG. 37 is a top plan view of the air and sonic massaging apparatus in accordance with the present invention shown in FIG. 32.
Figure 48:
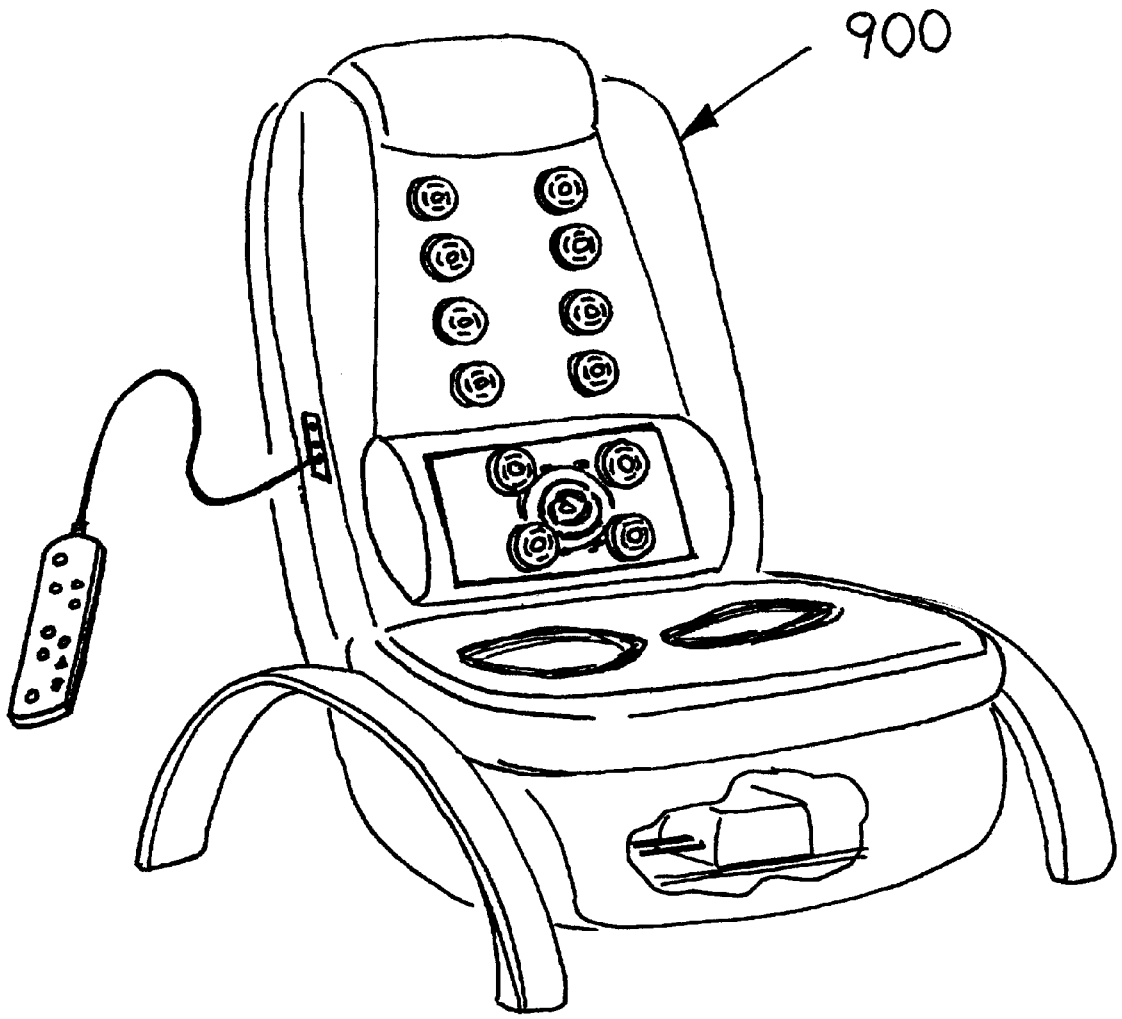
FIG. 48 is an illustration of a chair application having a head support section, a thoracic support section, a lumbar support section, and a buttock and thigh support section, where the second arrangement of the present invention air and sonic massaging apparatus is embedded within each support section of the chair application.

Referring to FIGS. 32 and 37, alternatively, there is shown a preferred embodiment of a second arrangement of the present invention air and sonic massaging apparatus 910 which can be embedded into a seat topper application 800 (see FIG. 45), a lounge chair application 900 (see FIG. 48) or other suitable applications. The air and sonic massaging apparatus 910 provides a massaging effect on the body part of the individual positioned on the apparatus as well as provides an entertainment and relaxation device.

The second arrangement of the present invention is identical to the first arrangement of the present invention just discussed above and the only difference is the configuration of the flexible air or fluid structure 812, and the description thereof will not be repeated.

Figure 49:
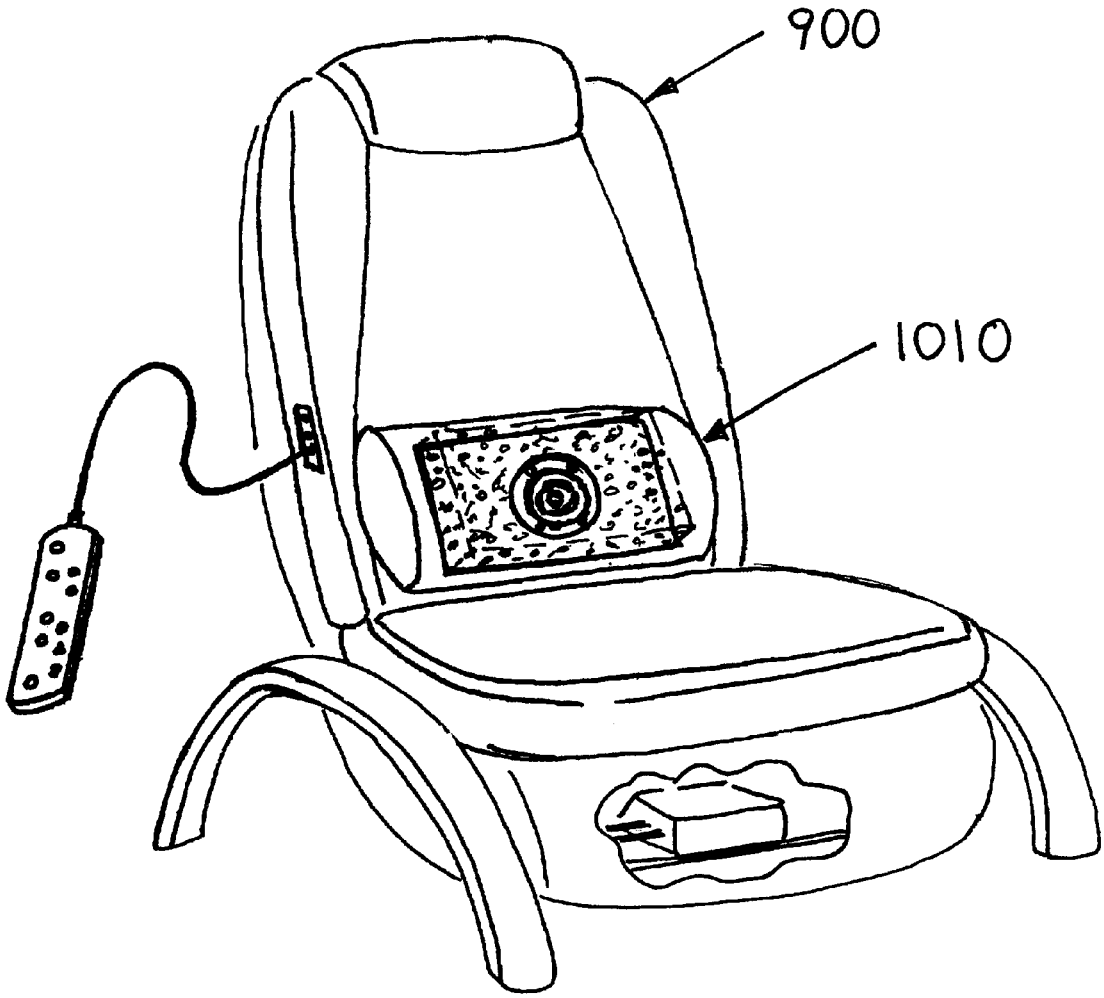
FIG. 49 is an illustration of a chair application having a head support section, a thoracic support section, a lumbar support section, and a buttock and thigh support section, where the alternative embodiment shown in FIG. 33 is embedded within the lumbar support section of the chair application.

Referring to FIGS. 33, 35, 46 and 51, there is shown an alternative embodiment of the present invention sonic massaging apparatus 1010 without the air support device 812 shown in FIG. 31. In this embodiment, a foam material 1064 replaces the air support device. The foam material 1064 is combined with the sonic device 814 which is used for providing a standing wave generation to massage the user. The foam and sonic massaging apparatus 1010 can be embedded into a seat topper application 800 (see FIG. 46), a lounge chair application 900 (see FIG. 49) or other suitable applications. The foam and sonic massaging apparatus 1010 provides a massaging effect on the body part of the individual positioned on the apparatus as well as provides an entertainment and relaxation device. Both the seat topper application 800 and the lounge chair application 900 include a pneumatic supply unit 850, a power cord 854 and a controller unit 852. In this application, the user's body cavity area above the user's diaphragm is used for providing improved vibrations to the user (see FIG. 51).

The sonic device 814 in this alternative embodiment is the same in the first arrangement of the present invention, and the description thereof will not be repeated.

The manufacturing process which could accommodate the construction of the air device may be pressure forming, vacuum forming, injection, thermoform, etc. or other molding process. By way of example, the air device can be made of urethane material, vinyl material, a blend of urethane and vinyl materials or any other suitable material known in the art.

Defined in detail, the present invention is a massaging and entertainment apparatus, comprising: (a) a flexible airtight structure having a generally flat base portion, a plurality of spaced apart hollow upper expandable and contractible air nodes extending upwardly from the base portion and a plurality of spaced apart hollow lower expandable and contractible air nodes extending downwardly from the base portion and respectively opposing the plurality of upper air nodes; (b) a first air flow circuit for pressurizing a first section of the plurality of upper and lower air nodes, the first air flow circuit having an inlet port for allowing compressed air to enter into the airtight structure and a plurality of first air channels integrally connected on the base portion, each first air channel interconnecting at least two of the plurality of upper air nodes of the first section for transferring compressed air therebetween; (c) a second air flow circuit for pressurizing a second section of the plurality of upper and lower air-nodes, the second air flow circuit having an inlet port for allowing compressed air to enter into the airtight structure and a plurality of second air channels integrally connected on the base portion, each second air channel interconnecting at least two of the plurality of air nodes of the second section for transferring compressed air therebetween; (d) a generally flat rigid plate sized to support and positioned underneath the plurality of lower air nodes and having an opening therethrough; (e) a sonic transducer attached to the rigid plate and located at the opening for generating plane waves around the opening of the rigid plate which in turn creates plane waves to the upper and lower air nodes and the body part of an individual positioned on the airtight structure; (f) means for pressurizing and depressurizing the plurality of upper and lower air nodes to a desired stiffness; and (g) controller means for controlling the pressurizing and depressurizing of the plurality of upper and lower air nodes of the first and second sections at different time intervals to create a massaging effect for massaging the body part of the individual positioned on the airtight structure and for activating and deactivating the sonic transducer; (h) whereby the airtight structure has the ability to adjust to the relative pressure over a range to suit the various shapes and masses of resting bodies and also provide the massaging effect against the body part of the individual.

Defined broadly, the present invention is a massaging and entertainment apparatus, comprising: (a) a flexible structure having a base portion, at least four spaced apart upper expandable and contractible nodes extending upwardly from the base portion and at least four spaced apart lower expandable and contractible nodes extending downwardly from the base portion and respectively opposing the plurality of upper nodes; (b) a first fluid flow circuit for pressurizing two of said at least four upper and lower nodes, the first fluid flow circuit having an inlet port for allowing fluid means to enter into the structure and a first fluid channel integrally connected on the base portion and interconnecting two of the at least four upper nodes for transferring fluid means therebetween; (c) a second fluid flow circuit for pressurizing the other two of said at least four upper and lower nodes, the second fluid flow circuit having an inlet port for allowing fluid means to enter into the structure and a second fluid channel integrally connected on the base portion and interconnecting two of the at least four upper nodes for transferring fluid means therebetween; (d) a plate sized to support and positioned underneath the at least four lower nodes; (e) a sonic transducer attached to the plate for generating plane waves through the plate which in turn creates plane waves to the at least four upper and lower nodes and the body part of an individual positioned on the structure; (f) means for pressurizing and depressurizing the at least four upper and lower nodes to a desired stiffness; and (g) means for controlling the pressurizing and depressurizing of the at least four upper and lower nodes at different time intervals to create a massaging effect for massaging the body part of the individual positioned on the structure and for activating and deactivating the sonic transducer; (h) whereby the structure has the ability to adjust to the relative pressure over a range to suit the various shapes and masses of resting bodies and also provide the massaging effect against the body part of the individual.

Defined more broadly, the present invention is a massaging and entertainment apparatus, comprising: (a) a fluid structure having a base portion, at least two upper expandable and contractible fluid nodes extending upwardly from the base portion and at least two lower expandable and contractible fluid nodes extending downwardly from the base portion and respectively opposing the at least two upper fluid nodes; (b) a plate positioned underneath the at least two lower fluid nodes; (c) transducer means attached to the plate for generating plane waves which in turn creates high magnitude plane waves to the at least two upper and lower fluid nodes and the body part of an individual positioned on the structure, (d) means for pressurizing and depressurizing the at least two upper and lower fluid nodes at different time intervals to create a massaging effect for massaging the body part of the individual positioned on the structure; and (e) means for controlling the pressurizing and depressurizing of the at least two upper and lower fluid nodes and for activating and deactivating the transducer means; (f) whereby the structure has the ability to adjust to the relative pressure over a range to suit the various shapes and masses of resting bodies and also provide the massaging effect against the body part of the individual.

Defined alternatively in detail, the present invention is a massaging and entertainment apparatus, comprising: (a) a flexible airtight structure having a generally flat base portion, a plurality of spaced apart hollow upper expandable and contractible air nodes extending upwardly from the base portion and a plurality of spaced apart hollow lower expandable and contractible air nodes extending downwardly from the base portion and respectively opposing the plurality of upper air nodes; (b) a first air flow circuit for pressurizing a first section of the plurality of upper and lower air nodes, the first air flow circuit having an inlet port for allowing compressed air to enter into the airtight structure and a plurality of first air channels integrally connected on the base portion, each first air channel interconnecting at least two of the plurality of upper air nodes of the first section for transferring compressed air therebetween; (c) a second air flow circuit for pressurizing a second section of the plurality of upper and lower air nodes, the second air flow circuit having an inlet port for allowing compressed air to enter into the airtight structure and a plurality of second air channels integrally connected on the base portion, each second air channel interconnecting at least two of the plurality of air nodes of the second section for transferring compressed air therebetween; (d) means for pressurizing and depressurizing the plurality of upper and lower air nodes to a desired stiffness; and (e) controller means for controlling the pressurizing and depressurizing of the plurality of upper and lower air nodes of the first and second sections at different time intervals to create a massaging effect for massaging the body part of the individual positioned on the airtight structure; (f) whereby the airtight structure has the ability to adjust to the relative pressure over a range to suit the various shapes and masses of resting bodies and also provide the massaging effect against the body part of the individual.

Defined alternatively broadly, the present invention is a massaging and entertainment apparatus, comprising: (a) a flexible structure having a base portion, at least four spaced apart upper expandable and contractible nodes extending upwardly from the base portion and at least four spaced apart lower expandable and contractible fluid nodes extending downwardly from the base portion and respectively opposing the at least four upper nodes; (b) a first fluid flow circuit for pressurizing two of said at least four upper and lower nodes, the first fluid flow circuit having an inlet port for allowing fluid means to enter into the structure and a first fluid channel integrally connected on the base portion and interconnecting two of the at least four upper nodes for transferring fluid means therebetween; (c) a second fluid flow circuit for pressurizing the other two of the at least four upper and lower nodes, the second fluid flow circuit having an inlet port for allowing fluid means to enter into the structure and a second fluid channel integrally connected on the base portion and interconnecting the other two of the at least four upper nodes for transferring fluid means therebetween; (d) means for pressurizing and depressurizing the at least four upper and lower nodes to a desired stiffness; and (e) means for controlling the pressurizing and depressurizing of the at least four upper and lower nodes at different time intervals to create a massaging effect for massaging the body part of the individual positioned on the structure; (f) whereby the structure has the ability to adjust to the relative pressure over a range to suit the various shapes and masses of resting bodies and also provide the massaging effect against the body part of the individual.

Defined alternatively more broadly, the present invention is a massaging and entertainment apparatus, comprising: (a) a fluid structure having a base portion, at least two upper expandable and contractible fluid nodes extending upwardly from the base portion and at least two lower expandable and contractible fluid nodes extending downwardly from the base portion and respectively opposing the at least two upper fluid nodes; (b) means for pressurizing and depressurizing the at least two upper and lower fluid nodes at different time intervals to create a massaging effect for massaging the body part of the individual positioned on the structure; and (c) means for controlling the pressurizing and depressurizing of the at least two upper and lower fluid nodes; (d) whereby the structure has the ability to adjust to the relative pressure over a range to suit the various shapes and masses of resting bodies and also provide the massaging effect against the body part of the individual.

Further defined in detail, the present invention is a sonic device, comprising: (a) a generally flat rigid transmission plate having an opening therethrough; (b) a sonic transducer including a large mass permanent magnet, a pair of nonmetallic spacers located on opposite sides of the permanent magnet and a pair of circular shaped suspensions located on opposite sides of the permanent magnet and abutting against the pair of spacers, a dual wound magnetic coil positioned around and surrounds the permanent magnet and a ferrous mounting coil body attached to the dual wound magnetic coil; (c) fastener, means for retaining the permanent magnet, the pair of spacers and the pair of suspensions together; (d) the ferrous mounting coil body mounted to the flat rigid plate by inserting the dual wound coil through the opening, where the sonic transducer generates plane waves around the opening of the rigid plate which in turn creates plane waves to the body part of an individual positioned on the rigid plate; and (e) controller means for activating and deactivating the sonic transducer; (f) whereby the sonic device creates acoustic waves generated by the rigid transmission plate through movement by the translation of the permanent magnet and provides high magnitudes of acoustic energy directly coupled to the user's body cavity.

Further defined broadly, the present invention is a sonic device, comprising: (a) a transmission plate; (b) a sonic transducer including a permanent magnet, at least two spacers located on opposite sides of the permanent magnet and at least two suspensions located on opposite sides of the permanent magnet and abutting against the at least two spacers, a dual wound magnetic coil positioned around and surrounds the permanent magnet and a mounting coil body attached to the dual wound magnetic coil; (c) means for retaining the permanent magnet, the at least two spacers and the at least two suspensions together; and (d) the mounting coil body mounted to the plate, where the sonic transducer generates plane waves through the plate which in turn creates plane waves to the body part of an individual positioned on the plate; (e) whereby the sonic device creates acoustic waves generated by the rigid transmission plate through movement by the translation of the permanent magnet and provides high magnitudes of acoustic energy directly coupled to the user's body cavity.

Further defined more broadly, the present invention is a sonic device, comprising: (a) transmission means; (b) transducer means including a magnet, and at least two suspensions located on opposite sides of the magnet, a dual wound magnetic coil positioned around and surrounds the magnet and a mounting coil body attached to the dual wound magnetic coil; (c) means for retaining the magnet and the at least two suspensions together; and (d) the mounting coil body mounted to the transmission means, where the transducer means generates plane waves through the transmission means which in turn creates plane waves to the body part of an individual positioned on the transmission means; (e) whereby the sonic device creates acoustic waves generated by the transmission means through movement by the translation of the magnet and provides high magnitudes of acoustic energy directly coupled to the user's body cavity.

Again further defined in detail, the present invention is a massaging and entertainment apparatus, comprising: (a) a flexible structure made of foam material; (b) a generally flat rigid plate sized to support and positioned underneath the flexible structure and having an opening therethrough; (c) a sonic transducer attached to the rigid plate and located at the opening for generating plane waves around the opening of the rigid plate which in turn creates plane waves to the flexible structure and the body part of an individual positioned on the flexible structure; and (d) controller means for activating and deactivating the sonic transducer means to create a massaging effect for massaging the body part of the individual positioned on the flexible structure; (e) whereby the flexible structure has the ability to adjust to the relative pressure over a range to suit the various shapes and masses of resting bodies and also provide the massaging effect against the body part of the individual.

Again further defined broadly, the present invention is a massaging and entertainment apparatus, comprising: (a) a flexible structure; (b) a plate sized to support and positioned underneath the flexible structure; (c) a sonic transducer attached to the plate and located at the opening for generating plane waves through the plate which in turn creates plane waves to the flexible structure and the body part of an individual positioned on the structure; and (d) means for activating and deactivating the sonic transducer to create a massaging effect for massaging the body part of the individual positioned on the flexible structure; (e) whereby the flexible structure has the ability to adjust to the relative pressure over a range to suit the various shapes and masses of resting bodies and also provide the massaging effect against the body part of the individual.

Again further defined more broadly, the present invention is a massaging and entertainment apparatus, comprising: (a) a support structure; (b) plate means positioned underneath the support structure; (c) transducer means attached to the plate means for generating plane waves which in turn creates high magnitude plane waves to the support structure and the body part of an individual positioned on the structure; and (d) means for activating and deactivating the transducer means to create a massaging effect for massaging.the body part of the individual positioned on the support structure; (e) whereby the structure has the ability to adjust to the relative pressure over a range to suit the various shapes and masses of resting bodies and also provide the massaging effect against the body part of the individual.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A massaging and entertainment apparatus, comprising:

a. a flexible airtight structure having a generally flat base portion, a plurality of spaced apart hollow upper expandable and contractible air nodes extending upwardly from the base portion and a plurality of spaced apart hollow lower expandable and contractible air nodes extending downwardly from the base portion and respectively opposing the plurality of upper air nodes;

b. a first air flow circuit for pressurizing a first section of said plurality of upper and lower air nodes, the first air flow circuit having an inlet port for allowing compressed air to enter into said airtight structure and a plurality of first air channels integrally connected on said base portion, each first air channel interconnecting at least two of said plurality of upper air nodes of the first section for transferring compressed air therebetween;

c. a second air flow circuit for pressurizing a second section of said plurality of upper and lower air nodes, the second air flow circuit having an inlet port for allowing compressed air to enter into said airtight structure and a plurality of second air channels integrally connected on said base portion, each second air channel interconnecting at least two of said plurality of air nodes of the second section for transferring compressed air therebetween;

d. a generally flat rigid plate sized to support and positioned underneath said plurality of lower air nodes and having an opening therethrough;

e. a sonic transducer attached to said rigid plate and located at said opening for generating plane waves around said opening of said rigid plate which in turn creates plane waves to said upper and lower air nodes and the body part of an individual positioned on said airtight structure;

f. means for pressurizing and depressurizing said plurality of upper and lower air nodes to a desired stiffniess; and g. controller means for controlling the pressurizing and depressurizing of said plurality of upper and lower air nodes of said first and second sections at different time intervals to create a massaging effect for massaging the body part of the individual positioned on said airtight structure and for activating and deactivating said sonic transducer;

h. whereby said airtight structure has the ability to adjust to the relative pressure over a range to suit the various shapes and masses of resting bodies and also provide the massaging effect against the body part of the individual.

2. The massaging and entertainment apparatus in accordance with claim 1, wherein said airtight structure is made of urethane material.

3. The massaging and entertainment apparatus in accordance with claim 1, wherein said airtight structure is made of vinyl material.

4. The massaging and entertainment apparatus in accordance with claim 1, wherein said airtight structure is made from a blend or mixture of urethane and vinyl.

5. The massaging and entertainment apparatus in accordance with claim 1, wherein said means for pressurizing and depressurizing said plurality of upper and lower air nodes includes pneumatic means.

6. The massaging and entertainment apparatus in accordance with claim 5, wherein said pneumatic means includes a pump.

7. The massaging and entertainment apparatus in accordance with claim 1, wherein said controller means includes a handheld system controller.

8. A massaging and entertainment apparatus, comprising:

a. a flexible structure having a base portion, at least four spaced apart upper expandable and contractible nodes extending upwardly from the base portion and at least four spaced apart lower expandable and contractible nodes extending downwardly from the base portion and respectively opposing the at least four upper nodes;

b. a first fluid flow circuit for pressurizing two of said at least four upper and lower nodes, the first fluid flow circuit having an inlet port for allowing fluid means to enter into said structure and a first fluid channel integrally connected on said base portion and interconnecting two of said at least four upper nodes for transferring fluid means therebetween;

c. a second fluid flow circuit for pressurizing the other two of said at least four upper and lower nodes, the second fluid flow circuit having an inlet port for allowing fluid means to enter into said structure and a second fluid channel integrally connected on said base portion and interconnecting the other two of said at least four upper nodes for transferring fluid means therebetween;

d. a plate sized to support and positioned underneath said at least four lower nodes;

e. a sonic transducer attached to said plate for generating plane waves through said plate which in turn creates plane waves to said plurality of upper and lower fluid nodes and the body part of an individual positioned on said structure;

f. means for pressurizing and depressurizing said at least four upper and lower nodes to a desired stiffiess; and g. means for controlling the pressurizing and depressurizing of said at least four upper and lower nodes at different time intervals to create a massaging effect for massaging the body part of the individual positioned on said structure and for activating and deactivating said sonic transducer;

h. whereby said structure has the ability to adjust to the relative pressure over a range to suit the various shapes and masses of resting bodies and also provide the massaging effect against the body part of the individual.

9. The massaging and entertainment apparatus in accordance with claim 8, wherein said structure is made of urethane material.

10. The massaging and entertainment apparatus in accordance with claim 8, wherein said structure is made of vinyl material.

11. The massaging and entertainment apparatus in accordance with claim 8, wherein said structure is made from a blend or mixture of urethane and vinyl.

12. The massaging and entertainment apparatus in accordance with claim 8, wherein said means for pressurizing and depressurizing said plurality of upper and lower fluid nodes includes pneumatic means.

13. The massaging and entertainment apparatus in accordance with claim 12, wherein said pneumatic means includes a pump.

14. The massaging and entertainment apparatus in accordance with claim 8, wherein said controlling means includes a handheld system controller.

15. The massaging and entertainment apparatus in accordance with claim 8, wherein said plate is rigid.

16. A massaging and entertainment apparatus, comprising:

a. a fluid structure having a base portion, at least two upper expandable and contractible fluid nodes extending upwardly from the base portion and at least two lower expandable and contractible fluid nodes extending downwardly from the base portion and respectively opposing the at least two upper fluid nodes;

b. a plate positioned underneath said at least two lower fluid nodes;

c. transducer means attached to said plate for generating plane waves which in turn creates high magnitude plane waves to said at least two upper and lower fluid nodes and the body part of an individual positioned on said structure;

d. means for pressurizing and depressurizing said at least two upper and lower fluid nodes at different time intervals to create a massaging effect for massaging the body part of the individual positioned on said structure; and e. means for controlling the pressurizing and depressurizing of said at least two upper and lower fluid nodes and for activating and deactivating said transducer means;

f. whereby said structure has the ability to adjust to the relative pressure over a range to suit the various shapes and masses of resting bodies and also provide the massaging effect against the body part of the individual.

17. The massaging and entertainment apparatus in accordance with claim 16, wherein said fluid structure is made of urethane material.

18. The massaging and entertainment apparatus in accordance with claim 16, wherein said fluid tight structure is made of vinyl material.

19. The massaging and entertainment apparatus in accordance with claim 16, wherein said fluid structure is made from a blend or mixture of urethane and vinyl.

20. The massaging and entertainment apparatus in accordance with claim 16, wherein said controlling means includes a handheld system controller.

21. The massaging and entertainment apparatus in accordance with claim 16, wherein said plate is rigid.

22. The massaging and entertainment apparatus in accordance with claim 16, wherein said transducer means is a sonic transducer.

23. The massaging and entertainment apparatus in accordance with claim 16, wherein said means for pressurizing and depressurizing said at least two upper and lower fluid nodes includes a pneumatic means.

24. A massaging and entertainment apparatus, comprising:

a. a flexible airtight structure having a generally flat base portion, a plurality of spaced apart hollow upper expandable and contractible air nodes extending upwardly from the base portion and a plurality of spaced apart hollow lower expandable and contractible air nodes extending downwardly from the base portion and respectively opposing the plurality of upper air nodes;

b. a first air flow circuit for pressurizing a first section of said plurality of upper and lower air nodes, the first air flow circuit having an inlet port for allowing compressed air to enter into said airtight structure and a plurality of first air channels integrally connected on said base portion, each first air channel interconnecting at least two of said plurality of upper air nodes of the first section for transferring compressed air therebetween;

c. a second air flow circuit for pressurizing a second section of said plurality of upper and lower air nodes, the second air flow circuit having an inlet port for allowing compressed air to enter into said airtight structure and a plurality of second air channels integrally connected on said base portion, each second air channel interconnecting at least two of said plurality of air nodes of the second section for transferring compressed air therebetween;

d. means for pressurizing and depressurizing said plurality of upper and lower air nodes to a desired stiffniess; and e. controller means for controlling the pressurizing and depressurizing of said plurality of upper and lower air nodes of said first and second sections at different time intervals to create a massaging effect for massaging the body part of the individual positioned on said airtight structure;

f. whereby said airtight structure has the ability to adjust to the relative pressure over a range to suit the various shapes and masses of resting bodies and also provide the massaging effect against the body part of the individual.

25. The massaging and entertainment apparatus in accordance with claim 24, wherein said airtight structure is made of urethane material.

26. The massaging and entertainment apparatus in accordance with claim 24, wherein said airtight structure is made of vinyl material.

27. The massaging and entertainment apparatus in accordance with claim 24, wherein said airtight structure is made from a blend or mixture of urethane and vinyl.

28. The massaging and entertainment apparatus in accordance with claim 24, wherein said a means for pressurizing and depressurizing said plurality of upper and lower air nodes includes pneumatic means.

29. The massaging and entertainment apparatus in accordance with claim 28, wherein said pneumatic means includes a pump.

30. The massaging and entertainment apparatus in accordance with claim 24, wherein said controller means includes a handheld system controller.

31. The massaging and entertainment apparatus in accordance with claim 24, further comprising a generally flat rigid plate sized to support and positioned underneath said plurality of lower air nodes and having a central opening therethrough.

32. The massaging and entertainment apparatus in accordance with claim 31, further comprising a sonic transducer attached to said rigid plate and located at said central opening for generating plane waves around said central opening of said rigid plate which in turn creates plane waves to said upper and lower air nodes and the body part of an individual positioned on said airtight structure.

33. A massaging and entertainment apparatus, comprising:

a. a flexible structure having a base portion, at least four spaced apart upper expandable and contractible nodes extending upwardly from the base portion and at least four spaced apart lower expandable and contractible nodes extending downwardly from the base portion and respectively opposing the at least four upper nodes;

b. a first fluid flow circuit for pressurizing two of the at least four upper and lower nodes, the first fluid flow circuit having an inlet port for allowing fluid means to enter into said structure and a first fluid channel integrally connected on said base portion and interconnecting two of said at least four upper nodes for transferring fluid means therebetween;

c. a second fluid flow circuit for pressurizing the other two of said at least four upper and lower nodes, the second fluid flow circuit having an inlet port for allowing fluid means to enter into said structure and a second fluid channel integrally connected on said base portion and interconnecting the other two of said at least four upper nodes for transferring fluid means therebetween;

d. means for pressurizing and depressurizing said at least four upper and lower nodes to a desired stiffness; and e. means for controlling the pressurizing and depressurizing of said at least four upper and lower nodes at different time intervals to create a massaging effect for massaging the body part of the individual positioned on said structure;

f. whereby said structure has the ability to adjust to the relative pressure over a range to suit the various shapes and masses of resting bodies and also provide the massaging effect against the body part of the individual.

34. The massaging and entertainment apparatus in accordance with claim 33, wherein said structure is made of urethane material.

35. The massaging and entertainment apparatus in accordance with claim 33, wherein said structure is made of vinyl material.

36. The massaging and entertainment apparatus in accordance with claim 33, wherein said structure is made from a blend or mixture of urethane and vinyl.

37. The massaging and entertainment apparatus in accordance with claim 33, wherein said means for pressurizing and depressurizing said at least four upper and lower nodes includes pneumatic means.

38. The massaging and entertainment apparatus in accordance with claim 37, wherein said pneumatic means includes a pump.

39. The massaging and entertainment apparatus in accordance with claim 33, wherein said controlling means includes a handheld system controller.

40. The massaging and entertainment apparatus in accordance with claim 33, further comprising a plate sized to support and positioned underneath said at least four lower nodes and having an opening therethrough.

41. The massaging and entertainment apparatus in accordance with claim 40, further comprising a sonic transducer attached to said plate and located at said opening for generating plane waves around said opening of said plate which in turn creates plane waves to said plurality of upper and lower fluid nodes and the body part of an individual positioned on said structure.

42. A massaging and entertainment apparatus, comprising:

a. a fluid structure having a base portion, at least two upper expandable and contractible fluid nodes extending upwardly from the base portion and at least two lower expandable and contractible fluid nodes extending downwardly from the base portion and respectively opposing the at least two upper fluid nodes;

b. means for pressurizing and depressurizing said at least two upper and lower fluid nodes at different time intervals to create a massaging effect for massaging the body part of the individual positioned on said structure; and c. means for controlling the pressurizing and depressurizing of said at least two co upper and lower fluid nodes;

d. whereby said structure has the ability to adjust to the relative pressure over a range to suit the various shapes and masses of resting bodies and also provide the massaging effect against the body part of the individual.

43. The massaging and entertainment apparatus in accordance with claim 42, wherein said controlling means includes a handheld system controller.

44. The massaging and entertainment apparatus in accordance with claim 42, wherein said means for pressurizing and depressurizing said at least two upper and lower fluid nodes includes a pneumatic means.

45. The massaging and entertainment apparatus in accordance with claim 42, further comprising a plate positioned underneath said at least two lower fluid nodes and having an opening therethrough.

46. The massaging and entertainment apparatus in accordance with claim 45, further comprising transducer means attached to said plate and located at said opening for generating plane waves around said opening of said plate which in turn creates high magnitude plane waves to said at least two upper and lower fluid nodes and the body part of an individual positioned on said structures.

47. The massaging and entertainment apparatus in accordance with claim 46, wherein said transducer means is a sonic transducer.

48. A sonic device, comprising:

a. a generally flat rigid transmission plate having an opening therethrough;

b. a sonic transducer including a large mass permanent magnet, a pair of nonmetallic spacers located on opposite sides of the permanent magnet and a pair of circular shaped suspensions located on opposite sides of the permanent magnet and abutting against the pair of spacers, a dual wound magnetic coil positioned around and surrounds the permanent magnet and a ferrous mounting coil body attached to the dual wound magnetic coil;

c. fastener means for retaining said permanent magnet, said pair of spacers and said pair of suspensions together;

d. said ferrous mounting coil body mounted to said flat rigid plate by inserting said dual wound coil through said opening, where said sonic transducer generates plane waves around said opening of said rigid plate which in turn creates plane waves to the body part of an individual positioned on said rigid plate; and e. controller means for activating and deactivating said sonic transducer;

f. whereby said sonic device creates acoustic waves generated by said rigid transmission plate through movement by the translation of said permanent magnet and provides high magnitudes of acoustic energy directly coupled to the user's body cavity.

49. The sonic device in accordance with claim 48, wherein said controller means includes a handheld system controller.

50. The sonic device in accordance with claim 48, wherein said permanent magnet is supported by iron guide rings.

51. The sonic device in accordance with claim 48, wherein said dual wound magnetic coil further comprises electrical wires for connecting to an amplifier embedded into a pneumatic supply unit.

52. A sonic device, comprising:

a. a transmission plate;

b. a sonic transducer including a permanent magnet, at least two spacers located on opposite sides of the permanent magnet and at least two suspensions located on opposite sides of the permanent magnet and abutting against the at least two spacers, a dual wound magnetic coil positioned around and surrounds the permanent magnet and a mounting coil body attached to the dual wound magnetic coil;

c. means for retaining said permanent magnet, said at least two spacers and said at least two suspensions together; and d. said mounting coil body mounted to said plate by inserting said dual wound coil through said opening, where said sonic transducer generates plane waves through said plate which in turn creates plane waves to the body part of an individual positioned on said plate;

e. whereby said.sonic device creates acoustic waves generated by said rigid transmission plate through movement by the translation of said permanent magnet and provides high magnitudes of acoustic energy directly coupled to the user's body cavity.

53. The sonic device in accordance with claim 52, wherein said permanent magnet is supported by iron guide rings.

54. The sonic device in accordance with claim 52, wherein said dual wound magnetic coil further comprises electrical wires for connecting to an amplifier embedded into a pneumatic supply unit.

55. The sonic device in accordance with claim 52, wherein said at least two spacers are nonmetallic.

56. The sonic device in accordance with claim 52, further comprising controller means for activating and deactivating said transducer means.

57. The sonic device in accordance with claim 56, wherein said controller means includes a handheld system controller.

58. A sonic device, comprising:

a. transmission means;

b. transducer means including a magnet, and at least two suspensions located on opposite sides of the magnet, a dual wound magnetic coil positioned around and surrounds the magnet and a mounting coil body attached to the dual wound magnetic coil;

c. means for retaining said magnet and said at least two suspensions together; and d. said mounting coil body mounted to said transmission means, where said transducer means generates plane waves through said transmission means which in turn creates plane waves to the body part of an individual positioned on said transmission means;

e. whereby said sonic device creates acoustic waves generated by said transmission means through movement by the translation of said magnet and provides high magnitudes of acoustic energy directly coupled to the user's body cavity.

59. The sonic device in accordance with claim 58, wherein said transmission means includes a flat rigid plate.

60. The sonic device in accordance with claim 58, wherein said magnet is supported by iron guide rings.

61. The sonic device in accordance with claim 58, wherein said dual wound magnetic coil further comprises electrical wires for connecting to an amplifier embedded into a pneumatic supply unit.

62. The sonic device in accordance with claim 58, further comprising at least two spacers located on opposite sides of said magnet and respectively between said at least two suspensions and said magnet.

63. The sonic device in accordance with claim 58, further comprising controller means for activating and deactivating said transducer means.

64. The sonic device in accordance with claim 63, wherein said controller means includes a handheld system controller.

65. A massaging and entertainment apparatus, comprising:

a. a flexible structure made of foam material;

b. a generally flat rigid plate sized to support and positioned underneath said flexible structure and having an opening therethrough;

c. a sonic transducer attached to said rigid plate and located at said opening for generating plane waves around said opening of said rigid plate which in turn creates plane waves to said flexible structure and the body part of an individual positioned on said flexible structure; and d. controller means for activating and deactivating said sonic transducer means to create a massaging effect for massaging the body part of the individual positioned on said flexible structure;

e. whereby said flexible structure has the ability to adjust to the relative pressure over a range to suit the various shapes and masses of resting bodies and also provide the massaging effect against the body part of the individual.

66. The massaging and entertainment apparatus in accordance with claim 62, wherein said controller means includes a handheld system controller.

67. A massaging and entertainment apparatus, comprising:

a. a flexible structure;

b. a plate sized to support and positioned underneath said flexible structure;

c. a sonic transducer attached to said plate for generating plane waves through said plate which in turn creates plane waves to said flexible structure and the body part of an individual positioned on said structure; and d. means for activating and deactivating said sonic transducer to create a massaging effect for massaging the body part of the individual positioned on said flexible structure;

e. whereby said flexible structure has the ability to adjust to the relative pressure over a range to suit the various shapes and masses of resting bodies and also provide the massaging effect against the body part of the individual.

68. The massaging and entertainment apparatus in accordance with claim 67, wherein said flexible structure is made of foam material.

69. The massaging and entertainment apparatus in accordance with claim 67, wherein said controlling means includes a handheld system controller.

70. A massaging and entertainment apparatus, comprising:

a. a support structure;

b. plate means positioned underneath said support structure;

c. transducer means attached to said plate means for generating plane waves which in turn creates high magnitude plane waves to said support structure and the body part of an individual positioned on said structure; and d. means for activating and deactivating said transducer means to create a massaging effect for massaging the body part of the individual positioned on said support structure;

e. whereby said structure has the ability to adjust to the relative pressure over a range to suit the various shapes and masses of resting bodies and also provide the massaging effect against the body part of the individual.

71. The massaging and entertainment apparatus in accordance with claim 70, wherein said support structure includes a foam material.

72. The massaging and entertainment apparatus in accordance with claim 70, wherein said controlling means includes a handheld system controller.

73. The massaging and entertainment apparatus in accordance with claim 70, wherein said transducer means is a sonic transducer.

* * * * *